US012122572B2

(12) United States Patent
Meager

(10) Patent No.: US 12,122,572 B2
(45) Date of Patent: Oct. 22, 2024

(54) PRESSURE EQUALIZATION APPARATUS FOR A CONTAINER AND METHODS ASSOCIATED THEREWITH

(71) Applicant: PAHA DESIGNS, LLC, Felt, ID (US)

(72) Inventor: Benjamin Meager, Felt, ID (US)

(73) Assignee: PAHA DESIGNS, LLC, Felt, ID (US)

( * ) Notice: Subject to any disclaimer, the term of this patent is extended or adjusted under 35 U.S.C. 154(b) by 511 days.

(21) Appl. No.: 16/494,152

(22) PCT Filed: Mar. 12, 2018

(86) PCT No.: PCT/US2018/022034

§ 371 (c)(1),
(2) Date: Sep. 13, 2019

(87) PCT Pub. No.: WO2018/169877

PCT Pub. Date: Sep. 20, 2018

(65) Prior Publication Data

US 2021/0122540 A1 Apr. 29, 2021

Related U.S. Application Data

(60) Provisional application No. 62/562,886, filed on Sep. 25, 2017, provisional application No. 62/511,222,
(Continued)

(51) Int. Cl.
*B67B 7/00* (2006.01)
*B65D 5/74* (2006.01)
(Continued)

(52) U.S. Cl.
CPC ..... *B65D 51/1677* (2013.01); *B65D 5/748* (2013.01); *B65D 23/06* (2013.01);
(Continued)

(58) Field of Classification Search
CPC .... B67B 7/24; B67B 7/26; B67B 7/28; B65D 5/748; B65D 51/22; B65D 51/24; A47G 19/12
(Continued)

(56) References Cited

U.S. PATENT DOCUMENTS 234,959 A 11/1880 Chalk
1,279,667 A * 9/1918 Davis ..... B65D 1/0223 222/85
(Continued)

FOREIGN PATENT DOCUMENTS

DE 19652216 8/1997
DE 19608338 9/1997
(Continued)

OTHER PUBLICATIONS

International Search Report and Written Opinion prepared by the ISA/US on Apr. 27, 2018, for International Application No. PCT/US2018/022034.
(Continued)

*Primary Examiner* — Charles P. Cheyney
(74) *Attorney, Agent, or Firm* — Sheridan Ross P.C.

(57) ABSTRACT

A device is provided that assists with equalizing air pressure within a container with the atmospheric air pressure as liquid is being poured from the container and includes one or more relatively short air tubes. The device is provided with the ability to simultaneously equalize pressure in the container while also providing a drip collection mechanism. The device may be configured for unidirectional pouring or multi-directional pouring.

18 Claims, 49 Drawing Sheets

Related U.S. Application Data filed on May 25, 2017, provisional application No. 62/470,742, filed on Mar. 13, 2017.

(51) Int. Cl.

| | |
|---|---|
| ***B65D 23/06*** | (2006.01) |
| ***B65D 47/08*** | (2006.01) |
| ***B65D 47/10*** | (2006.01) |
| ***B65D 47/20*** | (2006.01) |
| ***B65D 47/32*** | (2006.01) |
| ***B65D 51/16*** | (2006.01) |
| ***B65D 51/22*** | (2006.01) |
| ***B65D 51/24*** | (2006.01) |

(52) U.S. Cl.
CPC ..... *B65D 47/0809* (2013.01); *B65D 47/10* (2013.01); *B65D 47/2006* (2013.01); *B65D 47/32* (2013.01); *B65D 51/22* (2013.01); *B65D 51/24* (2013.01)

(58) Field of Classification Search
USPC ..... 222/81, 83, 83.5, 88, 85, 86
See application file for complete search history.

(56) References Cited

U.S. PATENT DOCUMENTS 1,426,180 A * 8/1922 Gotfredsen ..... B67B 7/28 222/83.5
1,526,342 A * 2/1925 Jones ..... B67B 7/28 222/85
2,022,342 A * 11/1935 Drood ..... B65D 25/42 222/572
2,160,705 A * 5/1939 Mcmanus ..... B67B 7/26 222/542
2,209,313 A * 7/1940 Ackley ..... B67B 7/26 222/85
2,239,275 A 4/1941 Schwab
2,320,084 A * 5/1943 Jundt ..... B67B 7/28 222/86
2,545,826 A * 3/1951 O'Hara ..... B67B 7/28 222/86
2,556,311 A * 6/1951 Winkler ..... B67B 7/28 D7/622
2,663,460 A * 12/1953 Keeney ..... B67B 7/28 222/86
2,718,053 A * 9/1955 Naert ..... B67B 7/24 30/447
2,721,381 A * 10/1955 Wiemeri ..... B67B 7/24 30/446
2,750,063 A 6/1956 Opsitnik
2,785,839 A 3/1957 Du Pree
2,796,205 A 6/1957 Kuzma
2,812,113 A 11/1957 Beall
2,835,403 A 5/1958 Scheminger, Jr.
2,949,668 A * 8/1960 Wiemeri ..... B67B 7/24 30/446
2,975,514 A * 3/1961 Pruyn ..... B67B 7/24 30/446
3,131,831 A * 5/1964 Dorchak ..... B67B 7/26 222/89
3,168,221 A 2/1965 Parker
3,285,472 A * 11/1966 Olson ..... B67B 7/28 222/86
3,506,167 A 4/1970 Orr
3,655,102 A 4/1972 Moran
3,834,594 A 9/1974 Schiemann
3,944,104 A 3/1976 Watson et al.
3,966,099 A 6/1976 Sanford, Jr. et al.
4,084,723 A * 4/1978 Parker ..... B65D 17/521 D8/40
4,153,173 A 5/1979 Ward et al.
4,452,381 A 6/1984 Freeman
4,483,464 A * 11/1984 Nomura ..... B67B 7/26 222/89
4,597,513 A 6/1986 Schiemann
4,793,514 A 12/1988 Sheets
4,838,428 A * 6/1989 Rausing ..... B67B 7/26 222/85
4,838,464 A 6/1989 Briggs
4,846,369 A * 7/1989 Dunstan ..... B67B 7/26 222/85
4,886,194 A 12/1989 Schiemann
4,911,315 A 3/1990 Shrum
5,002,209 A 3/1991 Goodall
5,104,010 A 4/1992 Codorniz et al.
5,133,482 A 7/1992 Burrows et al.
5,134,875 A 8/1992 Jensen et al.
5,228,603 A 7/1993 Pham et al.
5,232,110 A 8/1993 Purnell
5,292,021 A * 3/1994 Lyon ..... A47G 19/2266 220/717
5,340,000 A 8/1994 Ring
5,346,097 A 9/1994 Melland et al.
5,392,947 A 2/1995 Gentile
5,392,957 A 2/1995 Parsons
5,474,112 A 12/1995 Carola
5,538,165 A 7/1996 Frohn
5,605,254 A 2/1997 Wagner, III et al.
5,839,625 A 11/1998 Braginetz
5,875,921 A * 3/1999 Osgar ..... G01F 13/006 222/105
5,947,316 A 9/1999 Guillonnet
6,138,877 A 10/2000 Goff
6,170,719 B1 1/2001 Wilkinson et al.
6,196,425 B1 3/2001 Fielding et al.
6,439,433 B1 8/2002 Dubach et al.
6,460,741 B1 10/2002 Ho
6,478,058 B1 11/2002 Pears
6,644,471 B1 11/2003 Anderson
6,845,885 B2 1/2005 Morgenroth
7,073,686 B2 * 7/2006 Hanell ..... B67B 7/26 220/267
7,395,949 B2 7/2008 Ehret et al.
7,441,677 B2 10/2008 Garcia
7,464,834 B2 12/2008 Law et al.
7,543,723 B2 6/2009 Wilford et al.
8,016,146 B2 9/2011 Rekstad
8,602,235 B2 12/2013 Meager
8,684,205 B2 4/2014 Meager
8,844,761 B2 * 9/2014 Zabaleta ..... B65D 17/401 220/267
8,857,639 B2 10/2014 Meager
9,796,506 B2 10/2017 Meager
2002/0003154 A1 1/2002 Soehnlen et al.
2004/0026466 A1 2/2004 Lehner et al.
2004/0035894 A1 2/2004 Gobbini et al.
2005/0040130 A1 2/2005 Bivens
2005/0173454 A1 8/2005 Maas et al.
2006/0081662 A1 4/2006 Miura
2006/0163281 A1 7/2006 Weist
2007/0108156 A1 5/2007 Durand et al.
2007/0114200 A1 5/2007 Lane
2007/0199953 A1 8/2007 Laveault et al.
2007/0284399 A1 12/2007 Baughman et al.
2008/0078765 A1 4/2008 Steiger et al.
2008/0093324 A1 4/2008 Durand et al.
2008/0099514 A1 5/2008 Carter et al.
2008/0110849 A1 5/2008 Wachsberg
2008/0210658 A1 9/2008 Jo
2009/0159620 A1 6/2009 Nielsen
2009/0212079 A1 8/2009 Baughman et al.
2011/0042410 A1 2/2011 Paulen
2018/0134449 A1 5/2018 Meager
2020/0122887 A1 4/2020 Meager

FOREIGN PATENT DOCUMENTS

DE 202008010647 10/2008
DE 202008010648 10/2008
EP 1860037 11/2007

(56) References Cited

FOREIGN PATENT DOCUMENTS

| | | | | |
|---|---|---|---|---|
| FR | 9455 | | 11/1908 | |
| FR | 2794437 | | 12/2000 | |
| FR | 2875485 | | 3/2006 | |
| GB | 2016430 | | 9/1979 | |
| JP | 2013-047116 | | 3/2013 | |
| WO | WO 92/00883 | | 1/1992 | |
| WO | WO-9200883 A | * | 1/1992 | ..... B65D 5/068 |
| WO | WO 01/54991 | | 8/2001 | |

OTHER PUBLICATIONS

Official Action for U.S. Appl. No. 16/720,536, dated Sep. 10, 2021 12 pages.
International Search Report for PCT/US2011/023511 mailed Mar. 25, 2011, 3 pages.
Written Opinion for PCT/US2011/023511 mailed Mar. 25, 2011, 8 pages.
Official Action for Australia Patent Application No. 2011212990, dated Sep. 24, 2014 4 pages.
Notice off Acceptance for Australia Patent Application No. 2011212990, dated May 11, 2015 2 pages.
Official Action for Canada Patent Application No. 2,788,768, dated Feb. 23, 2017 4 pages.
Official Action for Canada Patent Application No. 2,788,768, dated Nov. 27, 2017 4 pages.
Notice of Allowance for Canada Patent Application No. 2,788,768, dated Aug. 21, 2018 1 page.
Extended European Search Report for European Patent Application No. 11740314.7 dated Jan. 2, 2014, 5 pages.
Official Action for European Patent Application No. 11740314.7, dated Apr. 23, 2015 5 pages.
Official Action for India Patent Application No. 7466/CHENP/2012, dated Oct. 25, 2018 6 pages.
International Search Report and Written Opinion for International (PCT) Patent Application No. PCT/US12/36430, mailed Jul. 26, 2012 9 pages.
International Preliminary Report on Patentability for International (PCT) Patent Application No. PCT/US12/36430 mailed Nov. 14, 2013, 7 pages.
Official Action for Canada Patent Application No. 2,835,097, dated Mar. 22, 2018 4 pages.
Notice of Allowance for Canada Patent Application No. 2,835,097, dated Jan. 8, 2019 1 page.
Extended Search Report for European Patent Application No. 12779363.6, dated Sep. 10, 2014 7 pages.
Official Action for European Patent Application No. 12779363.6, dated Nov. 2, 2015 5 pages.
Summons to Attend Oral Proceedings for European Patent Application No. 12779363.6, dated Sep. 7, 2016 4 page.
Result of Consultation for European Patent Application No. 12779363.6, dated Feb. 1, 2017 3 pages.
Intention to Grant for European Patent Application No. 12779363.6, dated Mar. 20, 2017 8 pages.
Intention to Grant for European Patent Application No. 12779363.6, dated Sep. 5, 2017 90 pages.
Official Action for India Patent Application No. 9020/CHENP/2013, dated Nov. 15, 2018 6 pages.
Official Action for Australia Patent Application No. 2014213555, dated Jun. 19, 2017 3 pages.
Official Action for Australia Patent Application No. 201421355, dated Mar. 27, 2018 3 pages.
Official Action for Australia Patent Application No. 2018204408, dated Aug. 7, 2019 3 pages.
Official Action for Australia Patent Application No. 2018204408, dated Dec. 17, 2019 3 pages.
Official Action for Australia Patent Application No. 2018204408, dated Jul. 21, 2020 3 pages.
Official Action for Australia Patent Application No. 2018204408, dated Jul. 30, 2020 4 pages.
Official Action for Canada Patent Application No. 2,859,379, dated Oct. 30, 2020 4 pages.
Extended Search Report for European Patent Application No. 14181089.5, dated Jan. 15, 2015 5 pages.
Official Action for European Patent Application No. 14181089.5, dated Apr. 30, 2018 4 pages.
Official Action for India Patent Application No. 3997/CHE/2014, dated Jan. 20, 2020 6 pages.
International Preliminary Report on Patentability for International (PCT) Patent Application No. PCT/US2018/022034, dated Sep. 26, 2019 8 pages.
Official Action for U.S. Appl. No. 13/019,941, mailed Jan. 9, 2013 5 pages Restriction Requirement.
Official Action for U.S. Appl. No. 13/019,941, mailed Feb. 12, 2013 5 pages Preinterview First Office Action.
Official Action for U.S. Appl. No. 13/019,941, mailed Mar. 27, 2013 22 pages.
Official Action for U.S. Appl. No. 13/019,941, mailed Sep. 13, 2013 10 pages.
Notice of Allowance for U.S. Appl. No. 13/019,941, mailed Oct. 22, 2013, 7 pages.
Official Action for U.S. Appl. No. 13/101,907, mailed Jan. 31, 2013 5 pages Restriction Requirement.
Official Action for U.S. Appl. No. 13/101,907, mailed Mar. 26, 2013 5 pages Restriction Requirement.
Official Action for U.S. Appl. No. 13/101,907, mailed May 2, 2013, 4 pages.
Official Action for U.S. Appl. No. 13/101,907, mailed Jul. 1, 2013 9 pages.
Official Action for U.S. Appl. No. 13/101,907, mailed Nov. 1, 2013, 6 pages.
Notice of Allowance for U.S. Appl. No. 13/101,907 mailed Dec. 26, 2013, 6 pages.
Official Action for U.S. Appl. No. 13/358,390, mailed Apr. 3, 2013 5 pages Restriction Requirement.
Official Action for U.S. Appl. No. 13/358,390 mailed Jun. 20, 2013, 4 pages.
Official Action for U.S. Appl. No. 13/358,390, mailed Jul. 26, 2013 8 pages.
Official Action for U.S. Appl. No. 13/358,390 mailed Jan. 28, 2014, 18 pages.
Notice of Allowance for U.S. Appl. No. 13/358,390 mailed Jun. 11, 2014, 7 pages.
Official Action for U.S. Appl. No. 13/967,860 mailed May 23, 2014, 6 pages.
Official Action for U.S. Appl. No. 13/967,860, mailed Aug. 29, 2014 8 pages.
Official Action for U.S. Appl. No. 13/967,860, mailed Oct. 27, 2014 10 pages.
Official Action for U.S. Appl. No. 13/967,860, mailed Apr. 7, 2015 13 pages.
Official Action for U.S. Appl. No. 13/967,860, dated Oct. 23, 2015 15 pages.
Official Action for U.S. Appl. No. 13/967,860, dated May 19, 2016 12 pages.
Official Action for U.S. Appl. No. 13/967,860, dated Nov. 23, 2016 12 pages.
Notice of Allowance for U.S. Appl. No. 13/967,860, dated Jun. 16, 2017 7 pages.
Official Action for U.S. Appl. No. 15/789,512, dated Jan. 31, 2019 6 pages Restriction Requirement.
Official Action for U.S. Appl. No. 15/789,512, dated Jul. 9, 2019 13 pages.
Official Action for U.S. Appl. No. 16/720,536, dated Mar. 23, 2021 6 pages Restriction Requirement.
Hearing Notice for India Patent Application No. 9020/CHENP/2013, dated Aug. 30, 2022 3 pages.
Official Action for U.S. Appl. No. 16/720,536, dated May 25, 2022 13 pages.

* cited by examiner

SECTION A-A

SECTION A-A

SECTION B-B

SECTION C-C

PRESSURE EQUALIZATION APPARATUS FOR A CONTAINER AND METHODS ASSOCIATED THEREWITH

CROSS-REFERENCE TO RELATED APPLICATIONS

This application is a national stage application under 35 U.S.C. § 371 and claims the benefit of PCT Application No. PCT/US2018/022034 having an international filing date of Mar. 12, 2018, which designated the United States, which PCT application claimed the benefit of priority under 35 U.S.C. § 119(e) to U.S. Provisional Patent Application Serial No. 62/470,742, filed Mar. 13, 2017 and entitled "Breathable Container with Integrated Drip Collection,"; U.S. Provisional Patent Application Serial No. 62/511,222, filed May 25, 2017 and entitled "Pressure Equalization Apparatus for a Container and Methods Associated Therewith," and U.S. Provisional Patent Application Serial No. 62/562,886, filed Sep. 25, 2017 and entitled "Pressure Equalization Apparatus for a Container and Methods Associated Therewith," which are incorporated herein by reference in their entirety.

FIELD

The present disclosure is related to a device that assists with equalizing air pressure within a container with the atmospheric air pressure, as liquid is being poured from the container.

BACKGROUND

A person pouring liquid from a container is often faced with the liquid pouring erratically and even splashing due to "glugging" (that is, uneven flow during pouring) caused by unbalanced pressures between the atmospheric air pressure outside the container and the air pressure within the container.

Prior devices for attempting to provide for smooth fluid pouring have performance issues, require significant materials, and/or have other limitations. Additionally, prior devices that addressed the issues associated with "glugging" did not simultaneously address issues associated with liquid dripping during or after pouring. Accordingly, there is a need for other devices to simultaneously address the glugging problem and dripping problem associated with pouring liquids from a container.

SUMMARY

It is to be understood that the present disclosure includes a variety of different versions or embodiments, and this Summary is not meant to be limiting or all-inclusive. This Summary provides some general descriptions of some of the embodiments, but may also include some more specific descriptions of other embodiments.

One or more embodiments of the one or more present disclosures are directed to a device that assists with equalizing air pressure within a container with the atmospheric air pressure, as liquid is being poured from the container. Various embodiments of the pressure equalizers described herein can accommodate various container shapes, container sizes, liquids, and pouring angles. By way of example, the pressure equalizers are suitable for beverages, chemicals, solutions, suspensions, mixtures, and other liquids. In its most basic form, the pressure equalizer comprises two main fluid flow paths: (a) a channel that allows liquid to pass out of the container; and (b) one or more air tubes or air ducts to allow air to enter the container.

In some embodiments, the second channel (e.g., the path that enables air to enter the container) may also serve to carry excess or dripped liquid back into the container body. In this way, the glugging problem and dripping problem associated with pouring liquids from a container is simultaneously addressed with a common solution. Not only does this solution result in a more desirable container, but it minimizes the amount of material required to solve both problems, further increasing the container's desirability.

Furthermore, embodiments of the present disclosure are not limited to equalizing air pressure within containers, but rather may be utilized to equalize air pressure in any container or vessel. As a couple of non-limiting examples, embodiments of the present disclosure may be employed to equalize air pressure in cartons, jugs, or any other hollow or concave structure for storing, pouring, and/or dispensing liquids.

At least one embodiment described herein utilizes one or more relatively short air tubes, as compared to the container length. The air tubes function by pressure differential and are not required to be in contact with an air cavity at the bottom of the container of liquid.

Various components are referred to herein as "operably associated." As used herein, "operably associated" refers to components that are linked together in operable fashion, and encompasses embodiments in which components are linked directly, as well as embodiments in which additional components are placed between the two linked components.

As used herein, "at least one," "one or more," and "and/or" are open-ended expressions that are both conjunctive and disjunctive in operation. For example, each of the expressions "at least one of A, B and C," "at least one of A, B, or C," "one or more of A, B, and C," "one or more of A, B, or C," and "A, B, and/or C" means A alone, B alone, C alone, A and B together, A and C together, B and C together, or A, B and C together.

The term "a" or "an" entity refers to one or more of that entity. As such, the terms "a" (or "an"), "one or more," and "at least one" can be used interchangeably herein. It is also to be noted that the terms "comprising," "including," and "having" can be used interchangeably.

As used herein, a bottle, jug, carton, or similar vessel may simply be referred to as a "container."

Various embodiments of the present disclosures are set forth in the attached figures and in the Detailed Description as provided herein and as embodied by the claims. It should be understood, however, that this Summary does not contain all of the aspects and embodiments of the one or more present disclosures, is not meant to be limiting or restrictive in any manner, and that the disclosure(s) as disclosed herein is/are understood by those of ordinary skill in the art to encompass obvious improvements and modifications thereto.

Additional advantages of the present disclosure will become readily apparent from the following discussion, particularly when taken together with the accompanying drawings.

BRIEF DESCRIPTION OF THE DRAWINGS

To further clarify the above and other advantages and features of the present disclosure, a more particular description is rendered by reference to specific embodiments, which are illustrated in the appended drawings. It is appreciated that these drawings depict only typical embodiments and are, therefore, not to be considered limiting of its scope. The present disclosure is described and explained with additional specificity and detail through the use of the accompanying drawings in which.

The drawings are not necessarily to scale.

DETAILED DESCRIPTION

One or more embodiments of the present disclosure include a pressure equalizer insert for placement in a container to allow a liquid to be poured from the container while at the same time substantially equalizing air pressure within the container with atmospheric air pressure. As a result, the liquid can be poured from the container without the typical glugging phenomena that generally accompanies pouring liquid from a container that does not possess the pressure equalizer. One or more additional embodiments include containers having container necks with the pressure equalizer device integrally formed within the container during manufacture of the container. For example, a plastic container, carton, or jug can be manufactured with the pressure equalizer device integrally formed in the container neck of the container, top of the carton, or neck of the jug when the container, carton, or jug is produced. Other embodiments provide a pressure equalizer that can be snap-fit, ultrasonically welded, or induction sealed onto the top of a container. The various embodiments of the present disclosure are described in the text below and are illustrated in the attached drawings.

Referring now to FIGS. 1-30E, various embodiments of a container, elements of a breathable attachment, and the system formed thereby will be described in accordance with at least some embodiments of the present disclosure.

Figure 1:
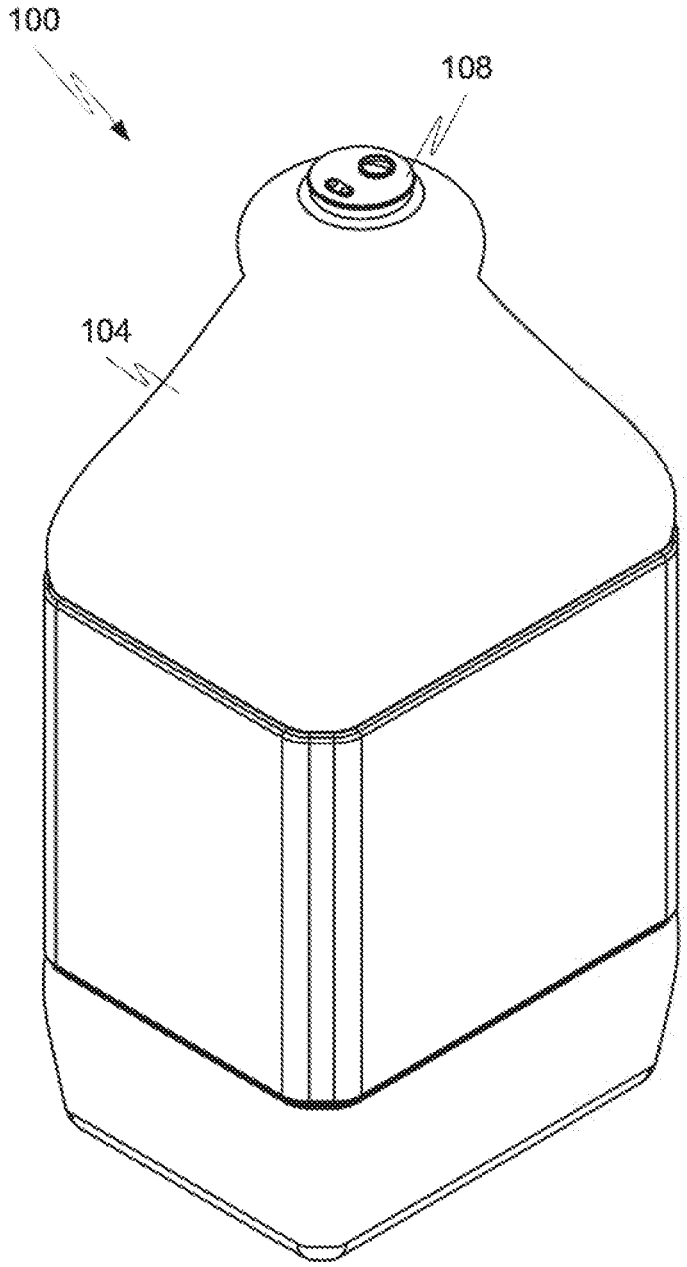
FIG. 1 is an isometric view of an illustrative container according to embodiments of the present disclosure.

As depicted in FIG. 1, the container 104 is shown to have a particular shape and format, but it should be appreciated that any type of container for a fluid may be sufficient to act as the container 104. The depicted container 104 is shown to have a narrower cross-sectional area at its opening as compared to its cross-sectional area at its middle. In some embodiments, the breathable attachment 108 may be integral with material of the container 104. As a non-limiting example, the breathable attachment 108 may actually be extruded from the same material from which the container 104 is extruded and, thus, there is no perceivable distinction between where the material of the container 104 ends and the material of the breathable attachment 108 begins. Alternatively, the breathable attachment 108 may be manufactured separately from the container 104 and then attached thereto after the container 104 has been filled with a desired liquid. The breathable attachment 108 may be joined, mated, or otherwise connected with the container 104 using any type of known mechanisms. As some non-limiting examples, the breathable attachment 108 may be welded, snap-fit, glued, or somehow connected. It's just an example and only one. In another non-depicted example, it may be possible to provide a positive male feature on the container 104 rim, with a negative or female interlocking feature on the breathable attachment 108. After the container 104 has been filled, the breathable attachment 108 may be snap-fit or otherwise interlocked with the container 104 rim. In other embodiments, the attachment 108 may be attached to a support ledge or similar feature created on the container 104 to accommodate a connection between the container 104 and the attachment 108.

Figure 2A:
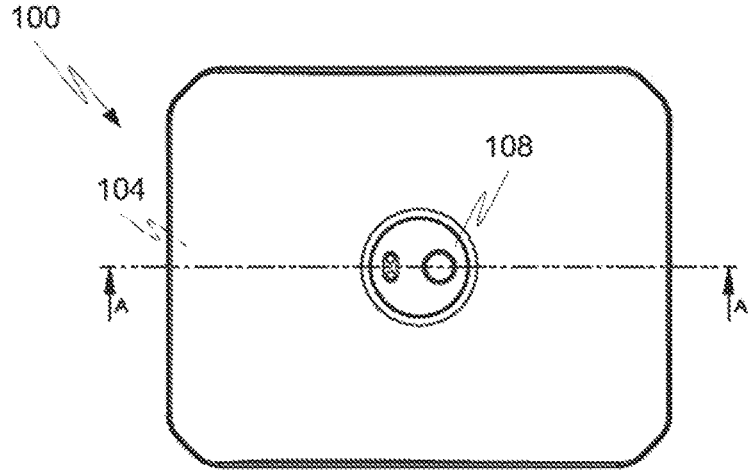
FIG. 2A is a top view of the container of FIG. 1.
Figure 2B:
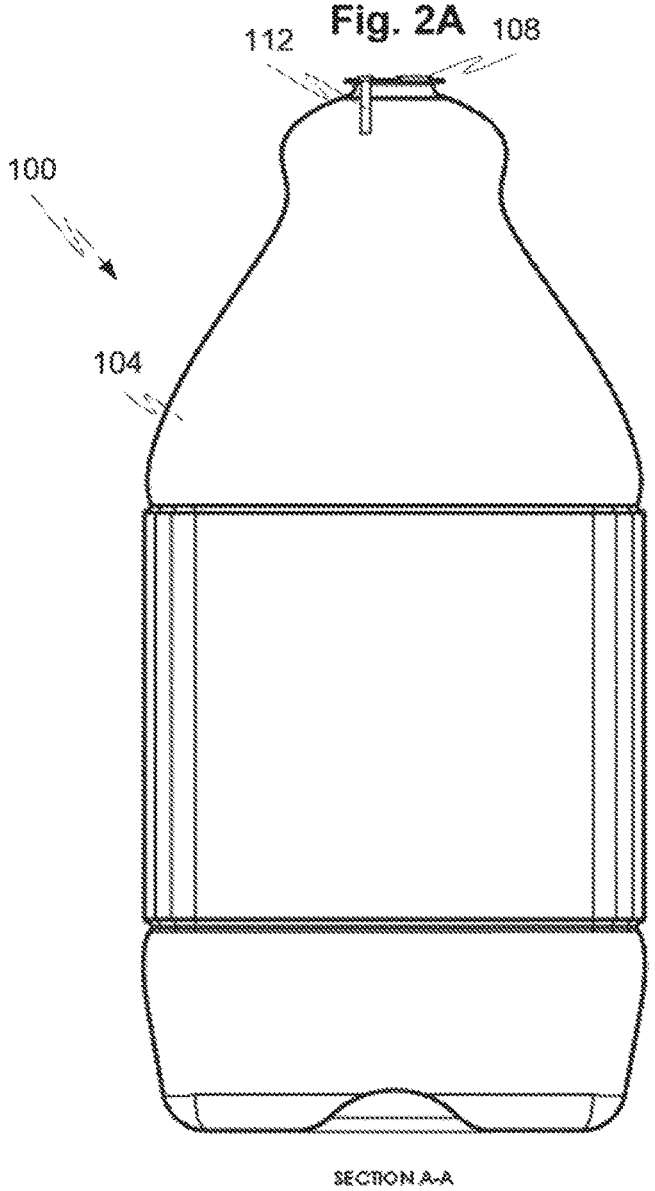
FIG. 2B is a cross-sectional view along line A-A depicted in FIG. 2A.

FIGS. 2A and 2B depict additional details of a breathable attachment 108 in accordance with at least some embodiments of the present disclosure. The breathable attachment 108 is shown to be attached to a top of the container 104 and further includes one or more air inlets 112 that extend into the volume of the container 104 (e.g., below an opening of the container 104). Further details of the breathable attachment depicted in FIGS. 1-2B are shown in FIGS. 11A-11C.

Figure 11A:
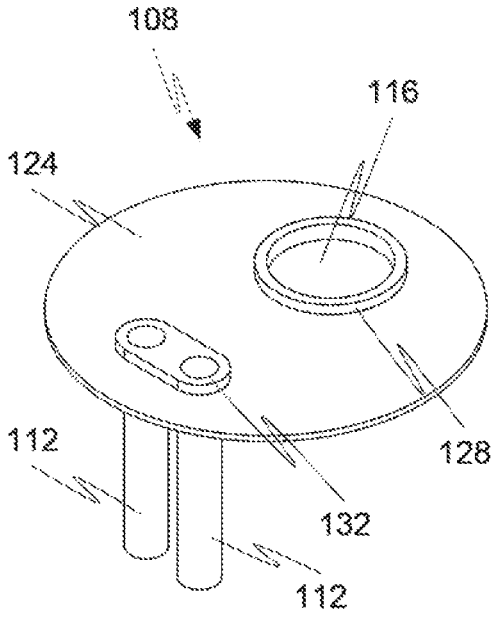
FIGS. 11A-11C depict various detailed views of a breathable attachment for a container as depicted in FIG. 1.
Figure 11B:
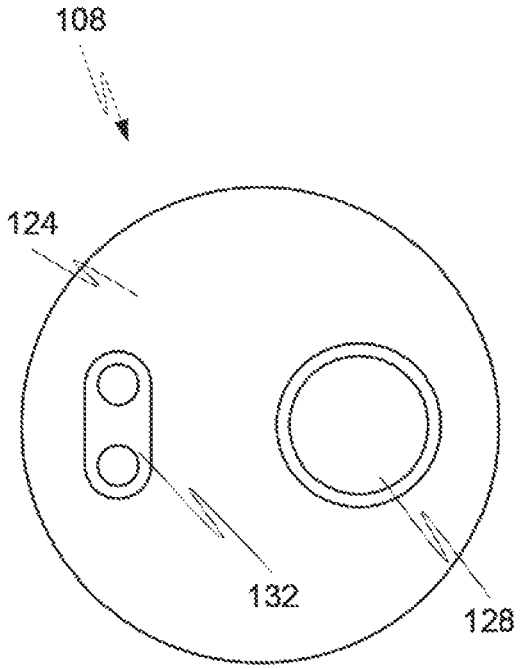
Figure 11C:
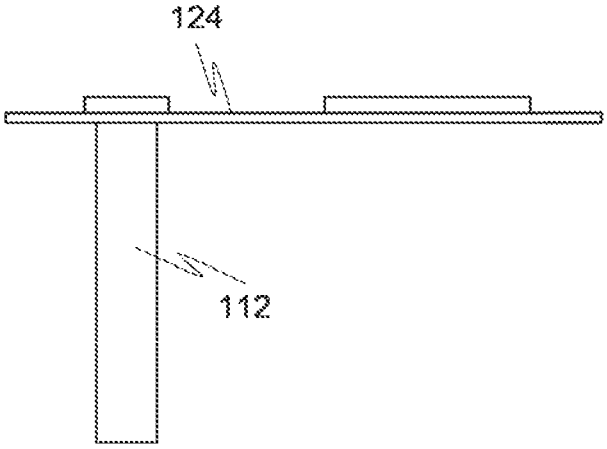
Figure 12A:
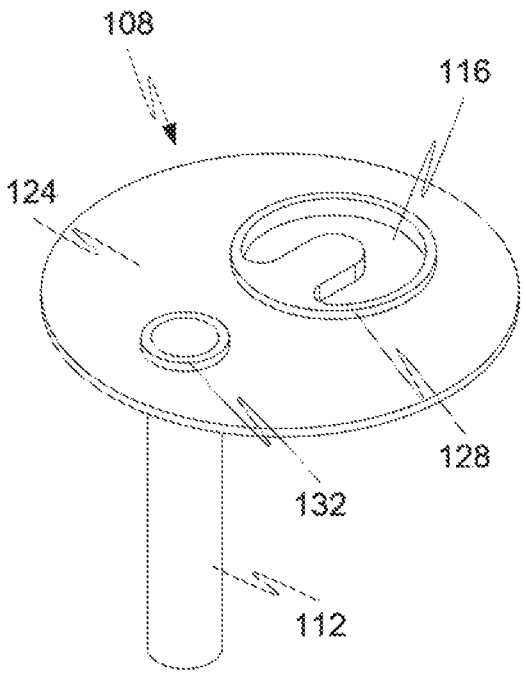
FIGS. 12A-12C depict various detailed view of a breathable attachment for a container as depicted in FIG. 7.
Figure 12B:
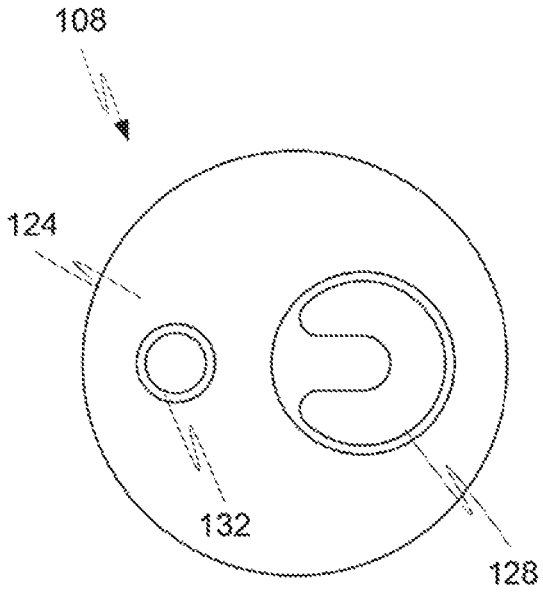
Figure 12C:
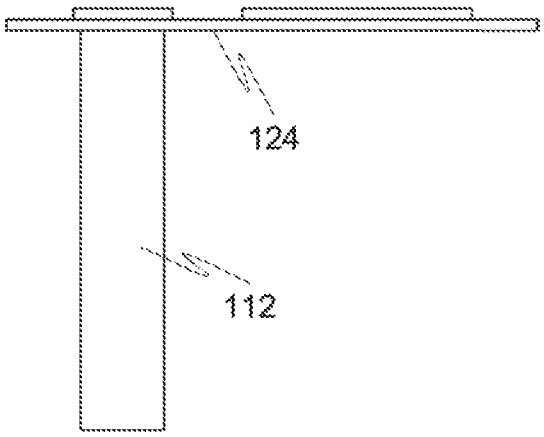
Figure 13A:
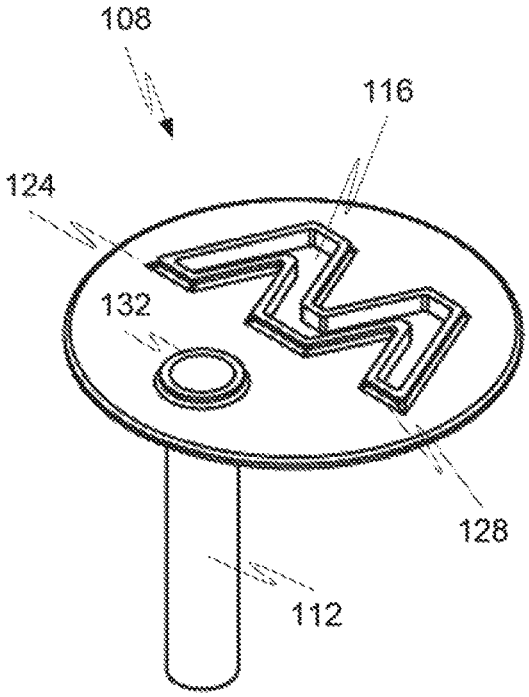
FIGS. 13A-13C depict various detailed view of a breathable attachment for a container as depicted in FIG. 9.
Figure 13B:
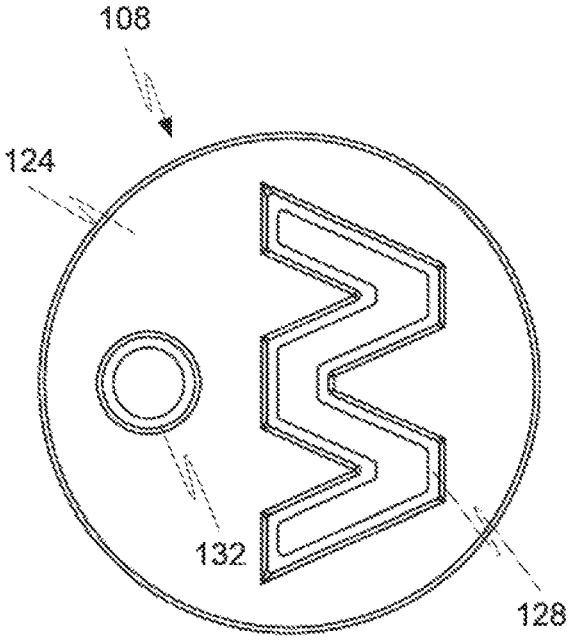
Figure 13C:
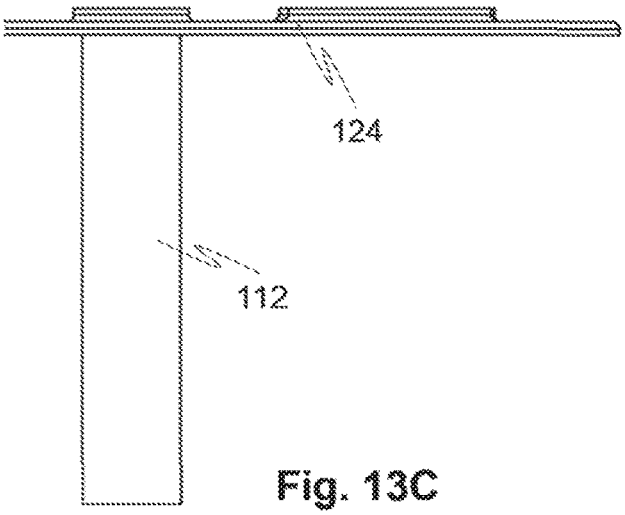

As shown in FIGS. 11A-11C, the breathable attachment 108 includes a base or platform member 124 that supports the other components of the breathable attachment 108. In some embodiments, the base member 124 has a cross-sectional area larger than a cross-sectional area of the container's 104 opening. Specifically, if the container's 104 opening is round or generally rounded, then the radius or diameter of the container's 104 opening may be smaller than a radius or diameter of the base member 124. This enables the base member 124 to be placed on top of the container 104 opening during filling without risking the breathable attachment 108 falling into the container 104.

The base member 124 is capable of having one, two, three, four, or more air inlets (otherwise referred to as air channels or breathing channels) attached thereto. In some embodiments, the air inlets 112 are connected to the base member 124 via a raised member 132. The raised member 132 may provide additional support for the interconnection between the base member 124 and air inlets 112. The raised member 132 may also help to strategically position a top of the air inlets 112 relative to the fluid opening 116 of the base member 124 so as to prevent glugging and otherwise enable a smooth pouring of fluid from the container 104.

The fluid opening 116 is surrounded by a rim 128. The rim 128 may also be considered a raised member similar to element 132. In some embodiments, the rim 128 that surrounds the fluid opening 116 helps to ensure that fluid flowing out of the container 104 does not leak or drip back into the air inlets 112. It may also help to ensure that excess fluid does not spill over the rest of the base member 124.

In some embodiments, the height of the rim 128 and the height of the raised member 132 may be approximately the same (as compared to the top surface of the base member 124). This relative positioning of the rim 128 and raised member 132 can further help to ensure a smooth pour of fluid from the container 104.

Figure 3:
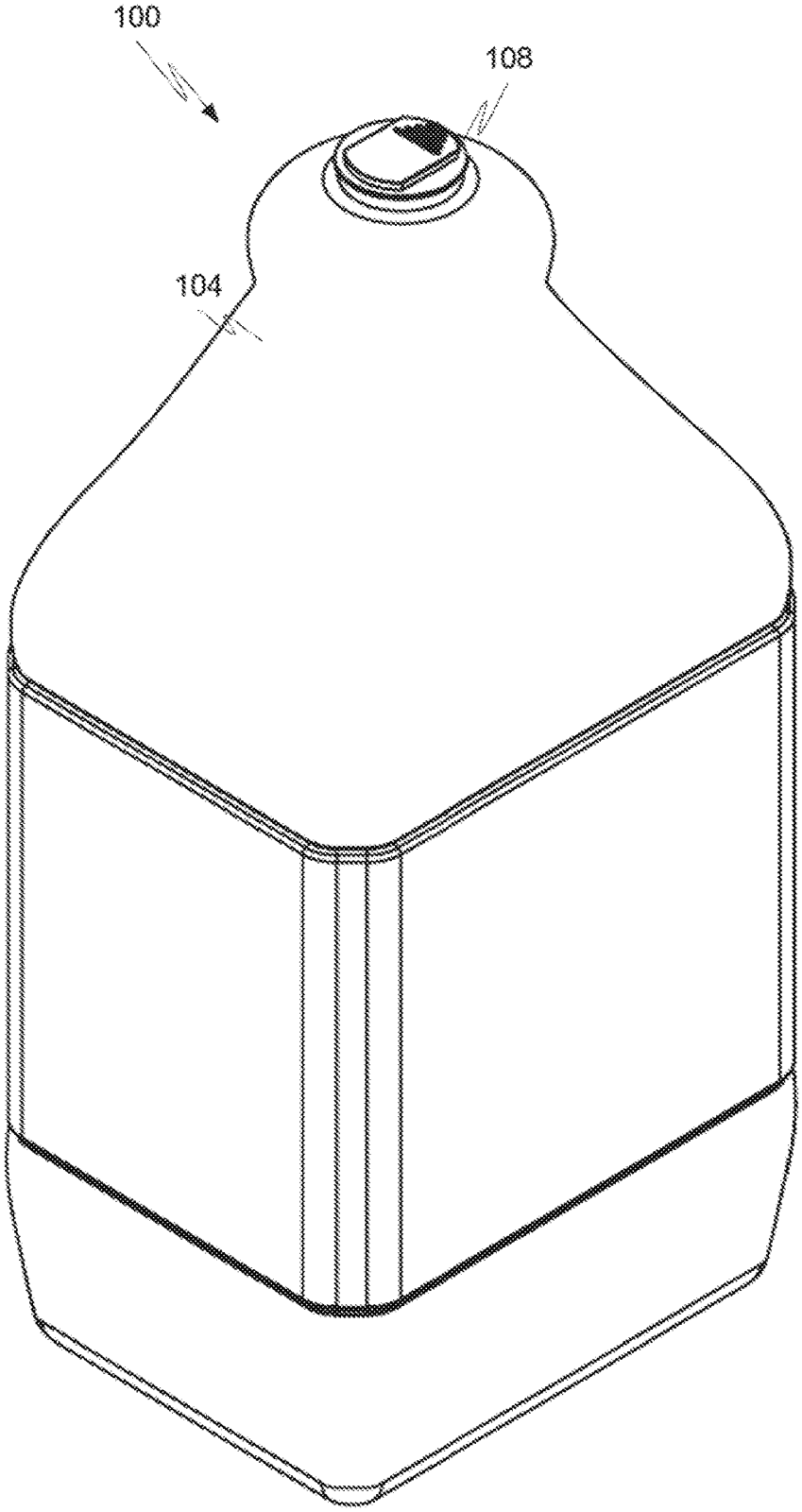
FIG. 3 is an isometric view of another illustrative container according to embodiments of the present disclosure.
Figure 4A:
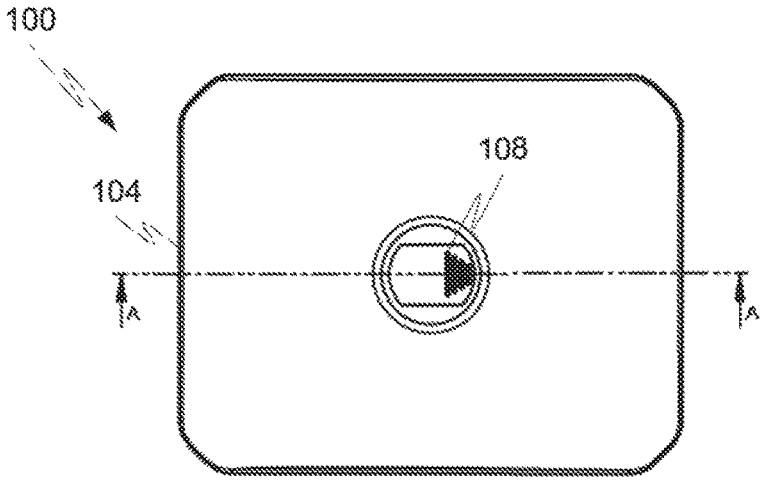
FIG. 4A is a top view of the container of FIG. 3.
Figure 4B:
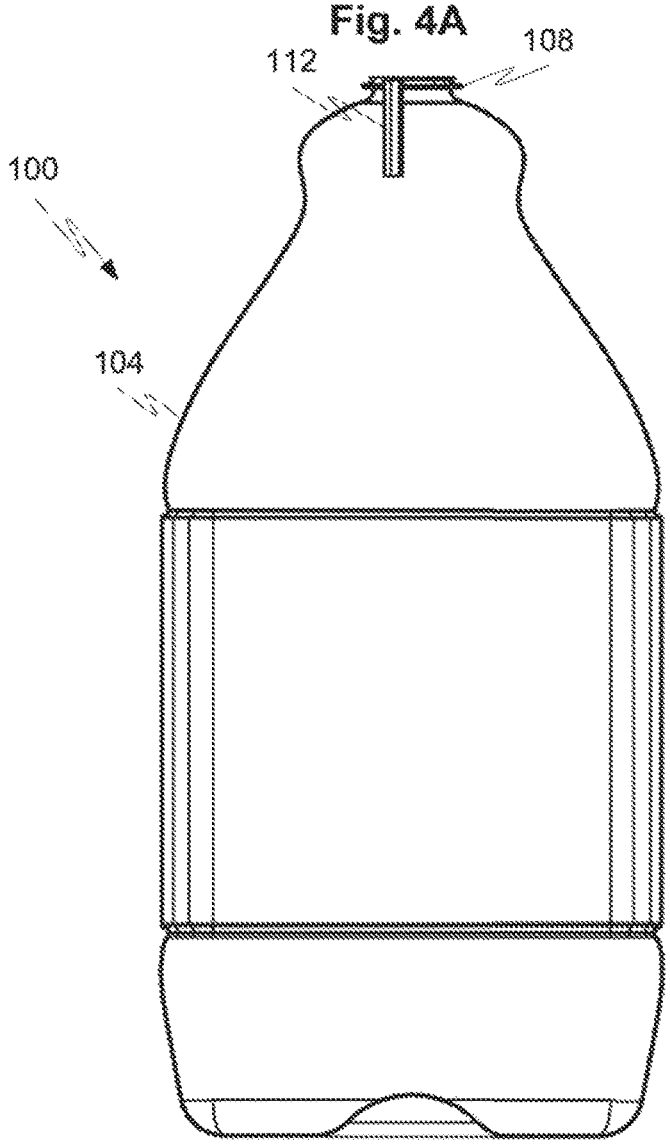
FIG. 4B is a cross-sectional view along line A-A depicted in FIG. 4A.
Figure 15A:
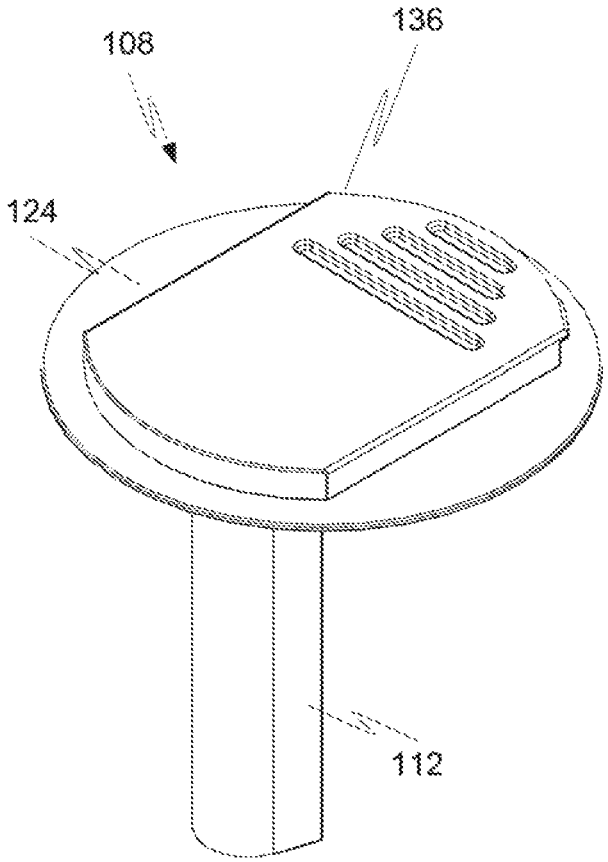
FIGS. 15A-15C depict various detailed view of a breathable attachment for a container as depicted in FIG. 3.
Figure 15B:
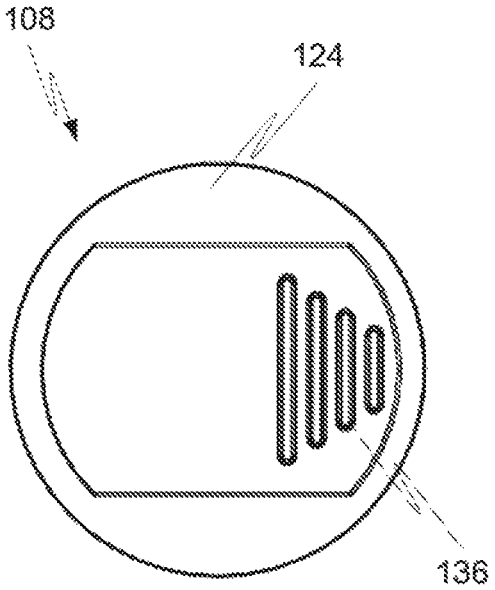
Figure 15C:
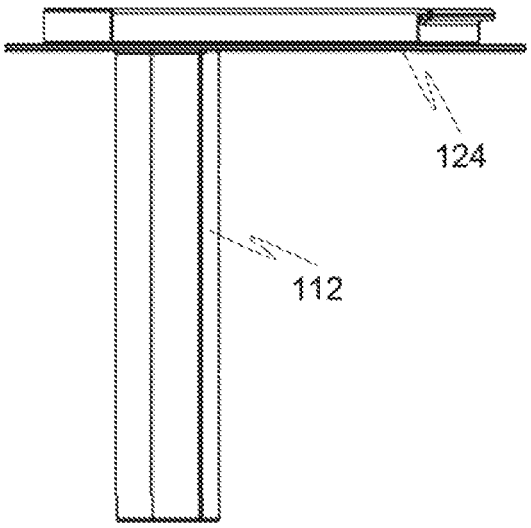

FIGS. 3-4B depict another example of a container 104 and breathable attachment 108 connected thereto. The breathable attachment 108 may be similar or identical to the other breathable attachments depicted and described herein except that this particular breathable attachment 108 further includes a lid, which may also be referred to as a flip-top, cover, or the like. Additional details of the breathable attachment 108 shown in FIGS. 3-4B is shown in FIGS. 15A-C. As shown in these figures, the lid 136 covers both the fluid opening as well as the opening(s) of the air inlets 112. It should be appreciated that the lid 136 can be fully removed from the base member 124 or it may be connected to the base member 124 via a pivot point, hinge, or the like.

Figure 5:
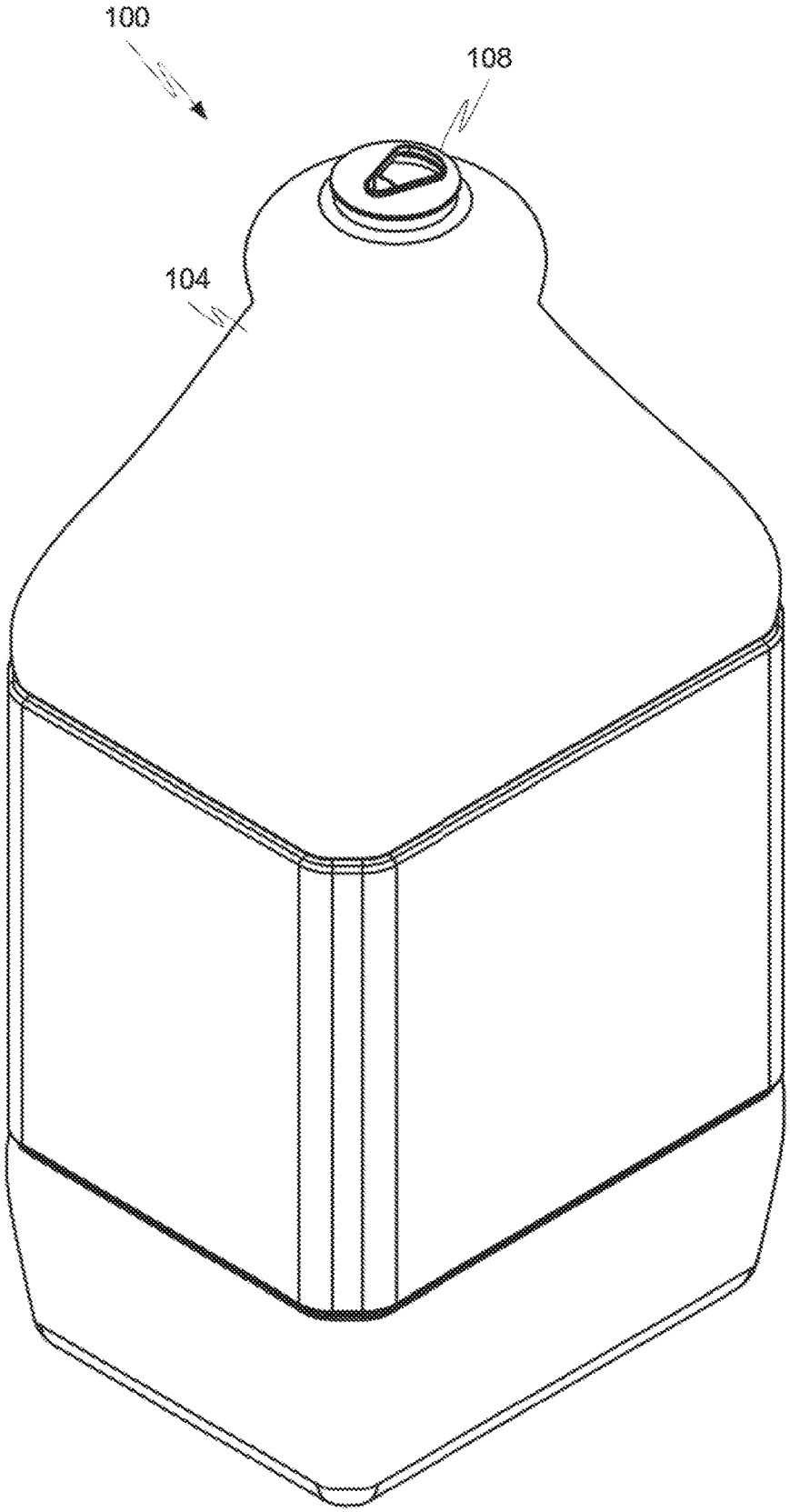
FIG. 5 is an isometric view of another illustrative container according to embodiments of the present disclosure.
Figure 6A:
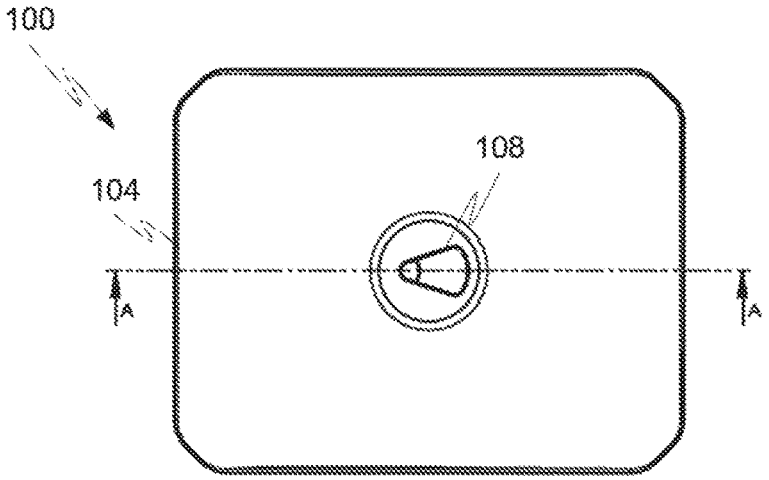
FIG. 6A is a top view of the container of FIG. 5.
Figure 6B:
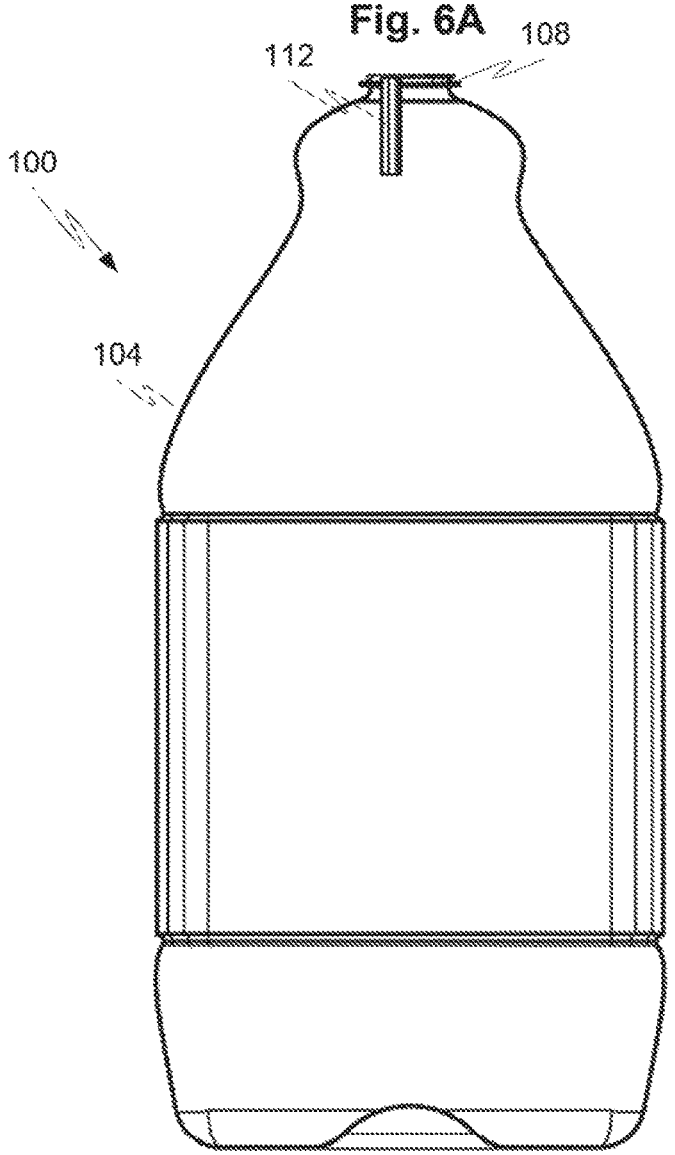
FIG. 6B is a cross-sectional view along line A-A depicted in FIG. 6A.

FIGS. 5-6B depict another example of a container 104 and breathable attachment connected thereto. The breathable attachment in this example is shown to have an air inlet 112 at least partially integrated into the fluid opening. It should be appreciated that the lid 136 of FIGS. 3-4B may be used for the breathable attachment 108 of FIGS. 5-6B, FIGS. 1-2B, and/or any other breathable attachment examples depicted and described herein.

Figure 14A:
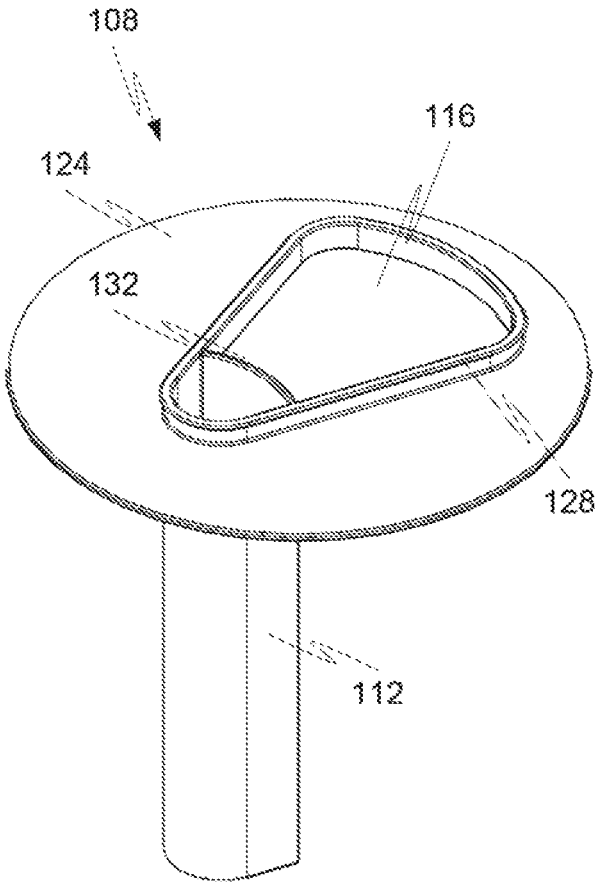
FIGS. 14A-14C depict various detailed view of a breathable attachment for a container as depicted in FIG. 5.
Figure 14B:
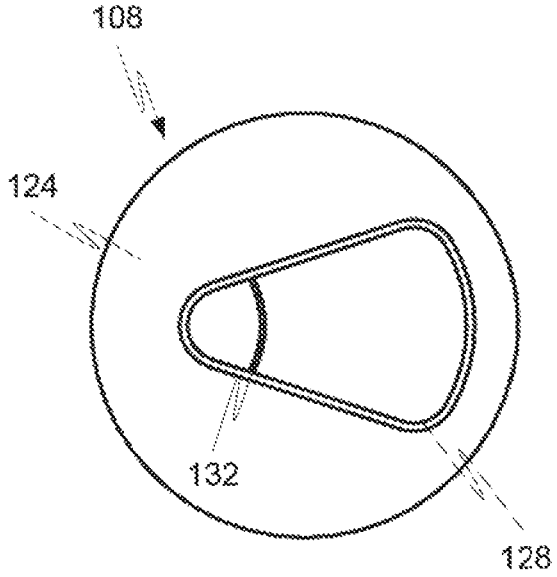
Figure 14C:
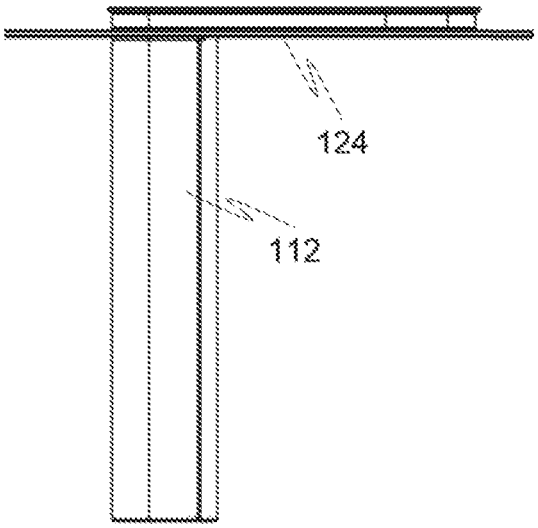

FIGS. 14A-C depict further details of the breathable attachment 108 from FIGS. 5-6B. In particular, the air inlet 112 is shown to be integrated within the fluid opening 116. Even more specifically, the rim 128 that surrounds the fluid opening 116 contains the air inlet 112 therein. Further still, the raised member 132 of the air inlet 112 traverses across the rim 128. Viewed another way, it can be said that the rim 128 is an extension of the raised member 132 and both the rim 128 and raised members 132 may be considered integrally combined with one another. That is, at least a portion of the rim 128 also acts as a raised member 132 for the air inlet 128 and, conversely, at least a portion of the raised member 132 also acts as a rim 128 for the fluid opening 116. Again, as with other breathable attachments 108, the top of the raised member 132 and rim 128 may be substantially co-planar, although this may not be required.

Figure 7:
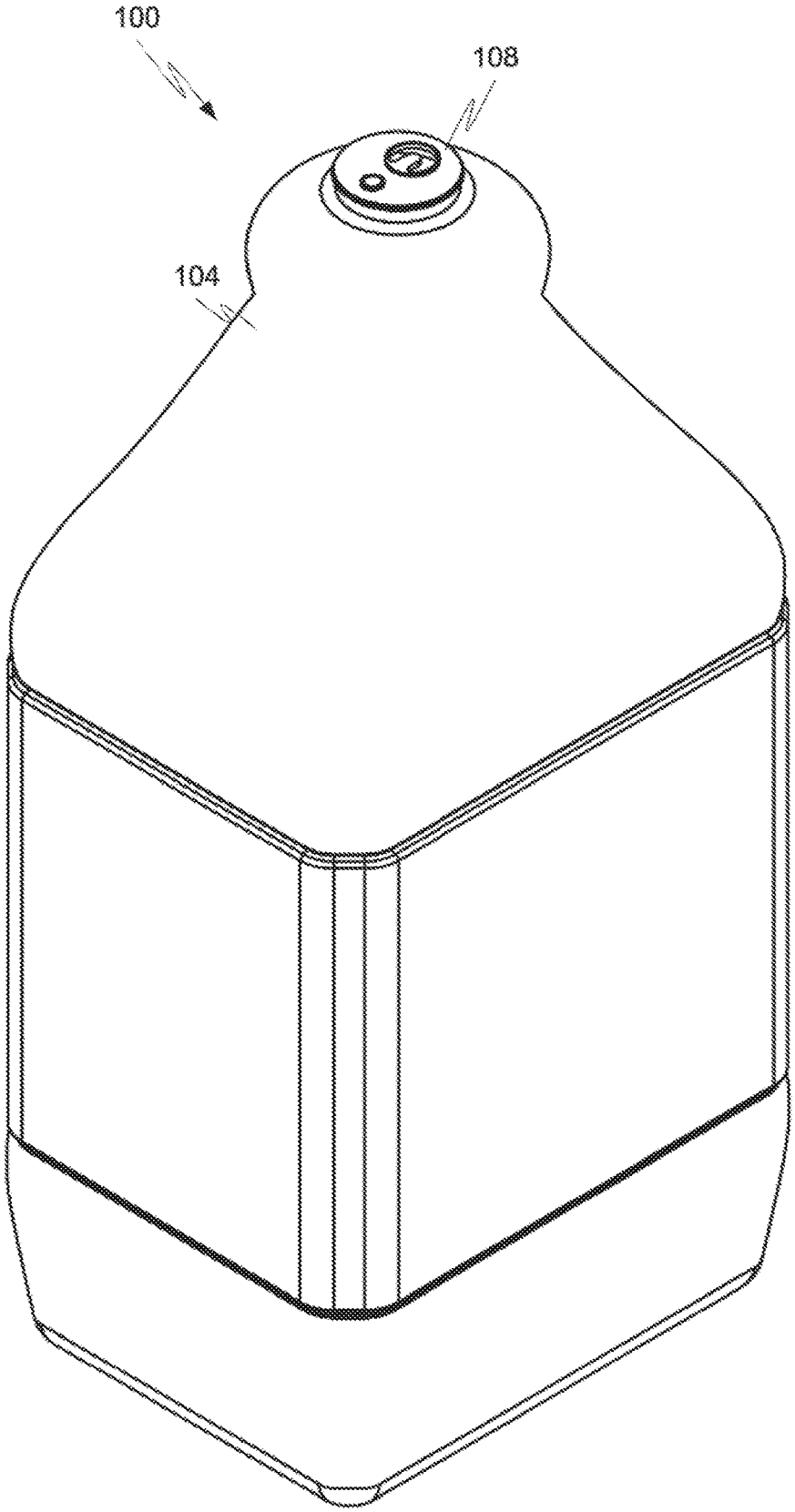
FIG. 7 is an isometric view of another illustrative container according to embodiments of the present disclosure.
Figure 8A:
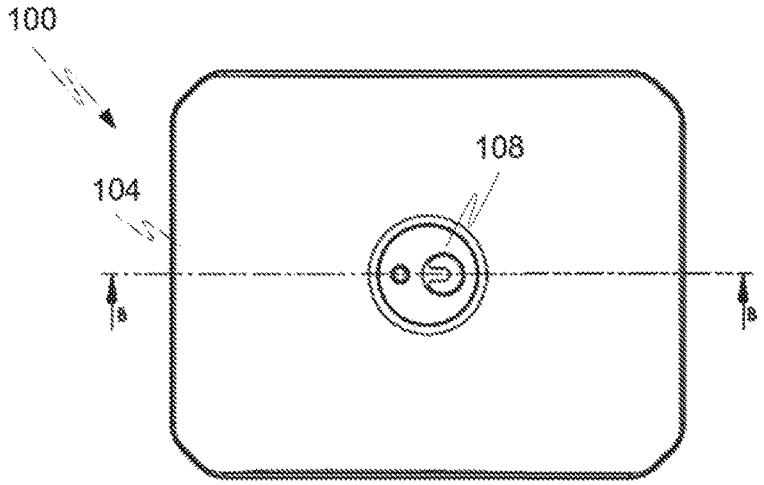
FIG. 8A is a top view of the container of FIG. 7.
Figure 8B:
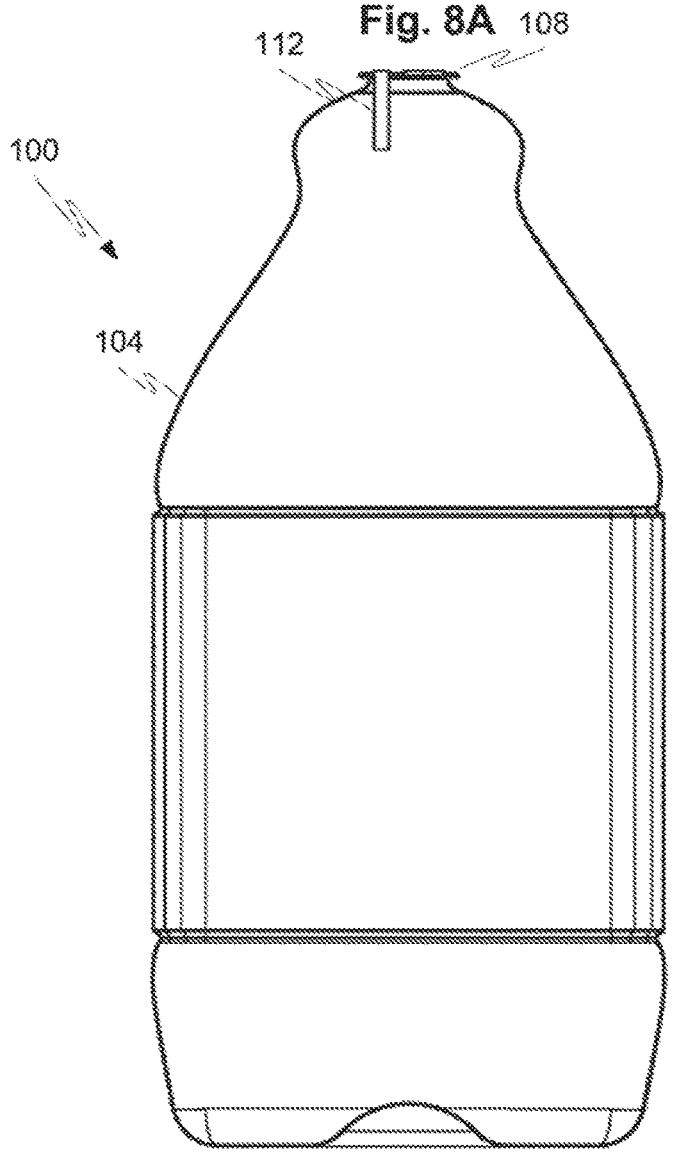
FIG. 8B is a cross-sectional view along line A-A depicted in FIG. 8A.

FIGS. 7-8B depict further details of another container 104 and breathable attachment 108. Details of this particular breathable attachment 108 are further shown in FIGS. 12A-C. This particular type of breathable attachment 108 has a shaped fluid opening 116 with an extensive rim 128. The rim 128 is shown to include a tongue that extends into a portion of the fluid opening 116. The air inlet 112 and raised member 132 are generally similar to the same components as shown in FIGS. 11A-C except that there is only a single air inlet 112.

Figure 9:
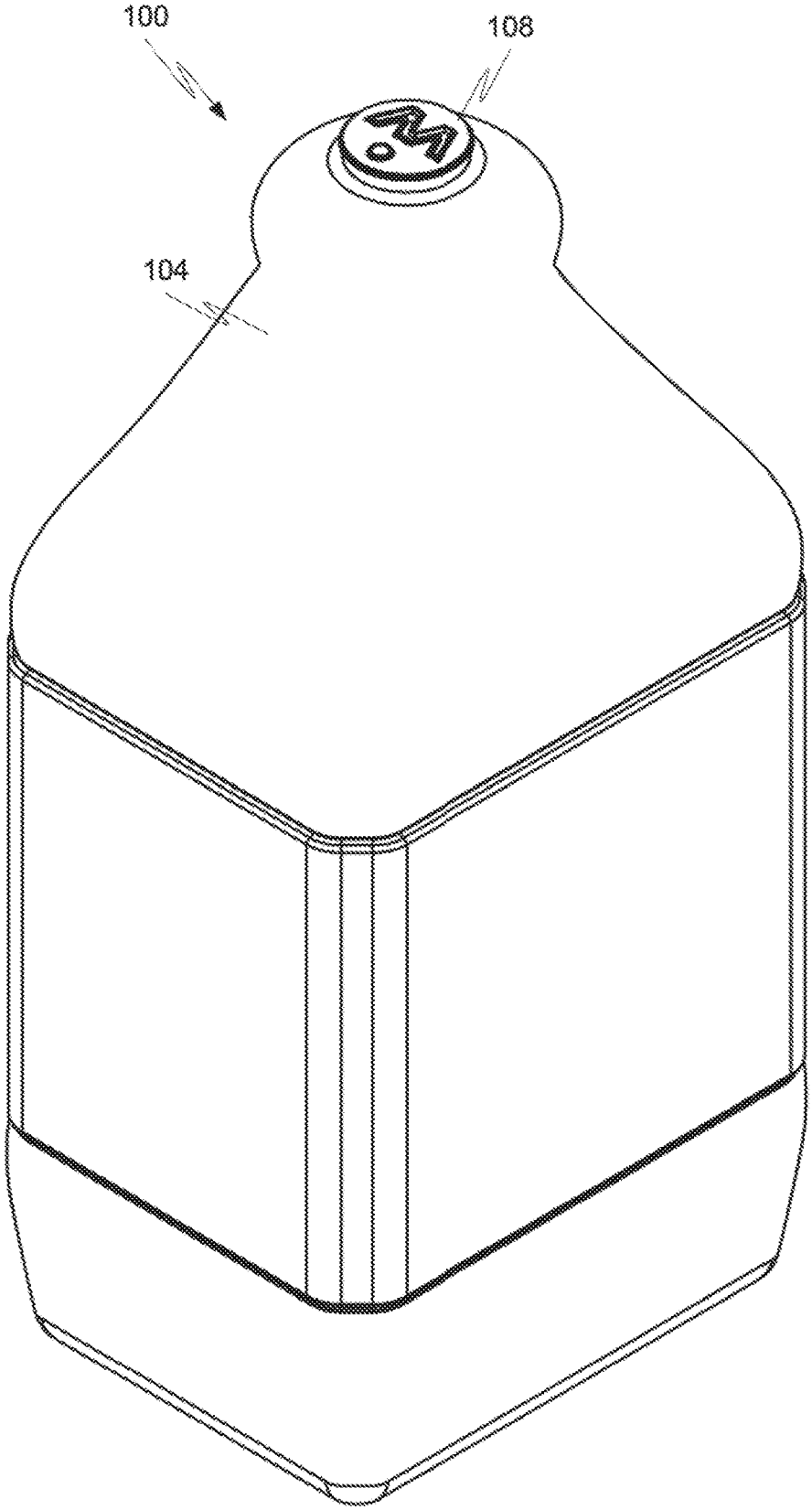
FIG. 9 is an isometric view of another illustrative container according to embodiments of the present disclosure.
Figure 10A:
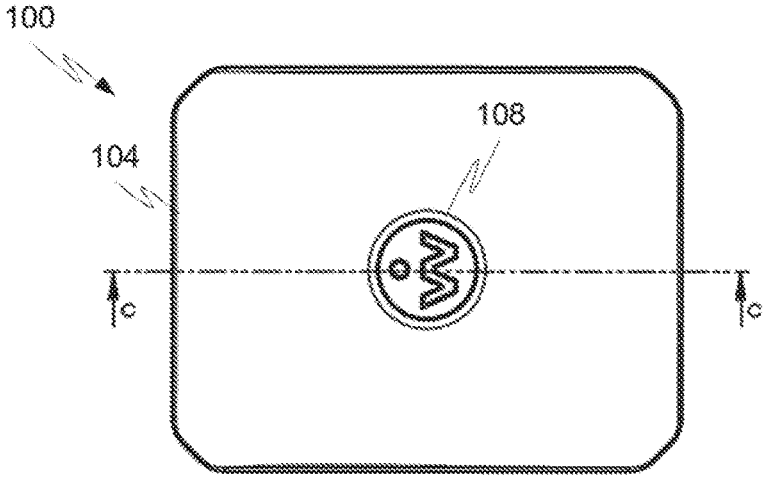
FIG. 10A is a top view of the container of FIG. 9.
Figure 10B:
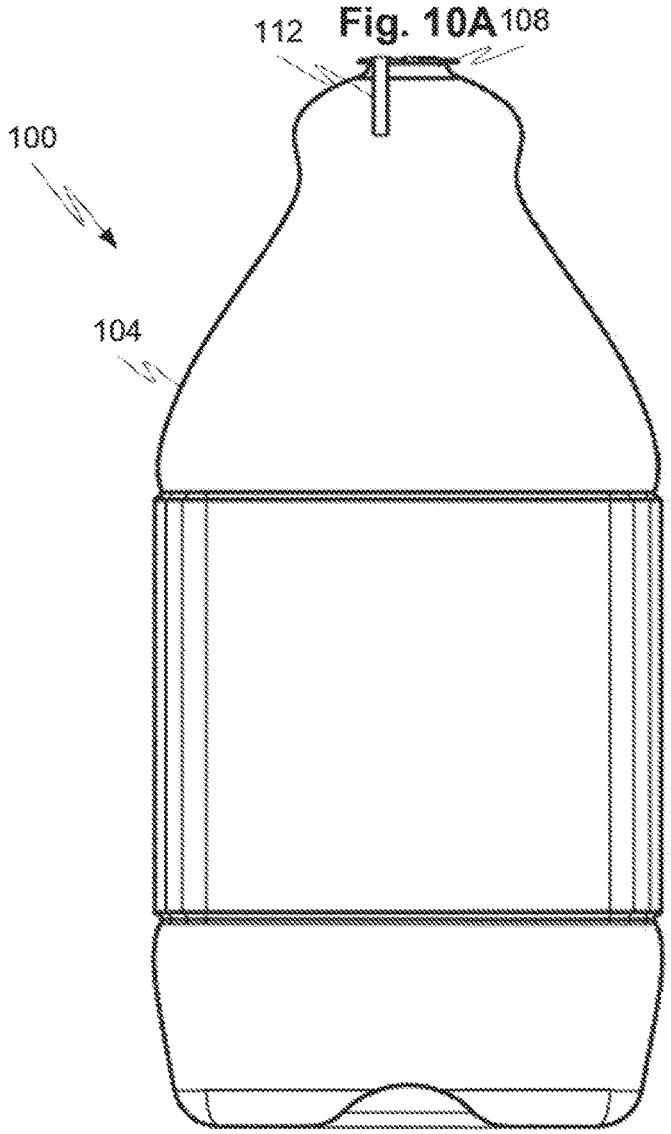
FIG. 10B is a cross-sectional view along line A-A depicted in FIG. 10A.

FIGS. 9-10B depict further details of another container 104 with a breathable attachment 108. Details of this particular breathable attachment 108 are further shown in FIGS. 13A-C. This particular configuration of a fluid opening 116 helps illustrate that the shape of the fluid opening 116 can vary without departing from the scope of the present disclosure.

Figure 16A:
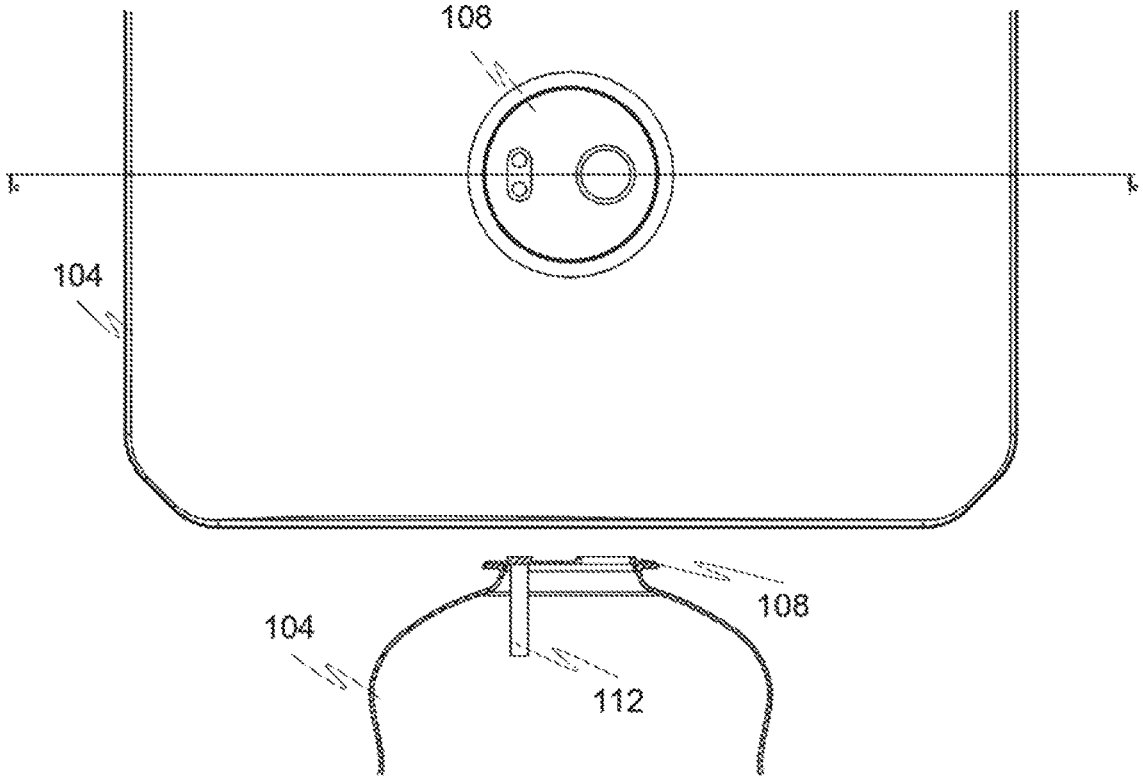
FIGS. 16A and 16B depict further details of a breathable attachment in communication with a container in accordance with embodiments of the present disclosure.
Figure 16B:
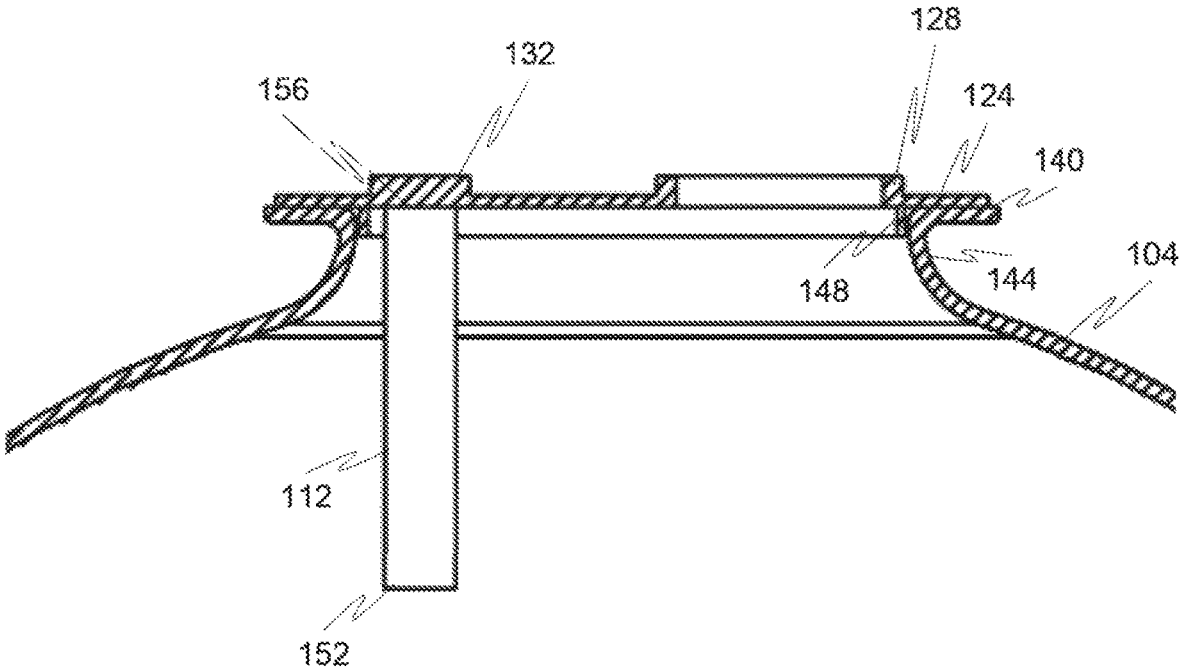

With reference now to FIGS. 16A-B, further details of components that can be incorporated into a breathable attachment 108 will be described in accordance with at least some embodiments of the present disclosure. The components in these figures can be incorporated into any one of the breathable attachments 108 depicted and described herein.

FIG. 16B specifically shows that the container 104 may include a lip 140 connected to a main body portion of the container 104 via a container neck 144. The lip 140 is shown to extent away from the container opening. In some embodiments, the lip 140 may be used to convey the container 104 during manufacturing and/or filling. The base member 124 is shown as resting on top of the lip 140 and being supported thereby. It should be appreciated that any type of connection mechanism (e.g., welding, snap-fit, gluing) can be used to join the base member 124 to the lip 140.

The breathable attachment 108 is also shown to include a mating member 148 that interfaces with the container 104 inside of the container's opening. The mating member 148 may correspond to a feature that threads or snap-fits inside of a corresponding feature provided in the neck 144 of the container 104.

As discussed hereinabove, the air inlet(s) 112 may be connected with the base member 124 via the raised member 132. This may also correspond to a second end 156 of the air inlet 112. The second end 156 may oppose a first end 152 of the air inlet 112. Air may flow from the second end 156 toward the first end 152 when fluid is flowing out of the container, thereby enabling a pressure equalization within the volume of the container 104.

Figure 17A:
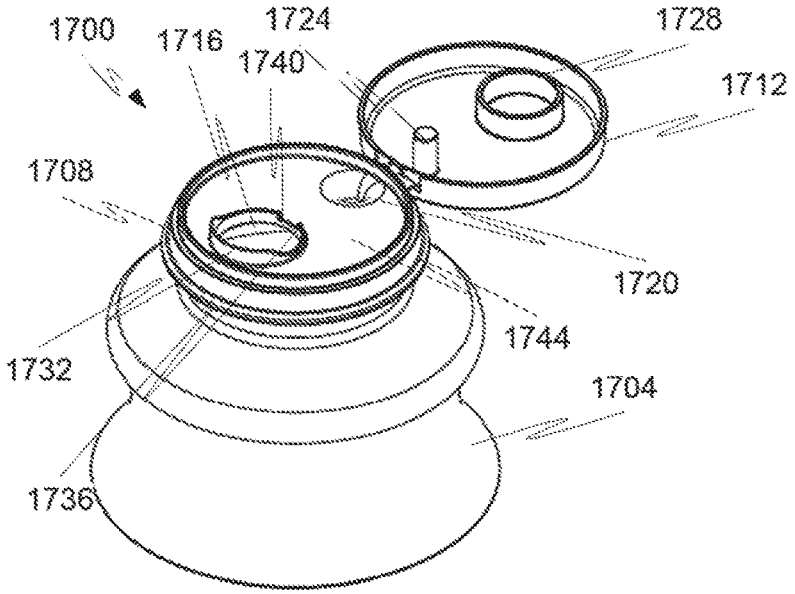
FIGS. 17A-17C depict another example of a breathable container in accordance with embodiments of the present disclosure.
Figure 17B:
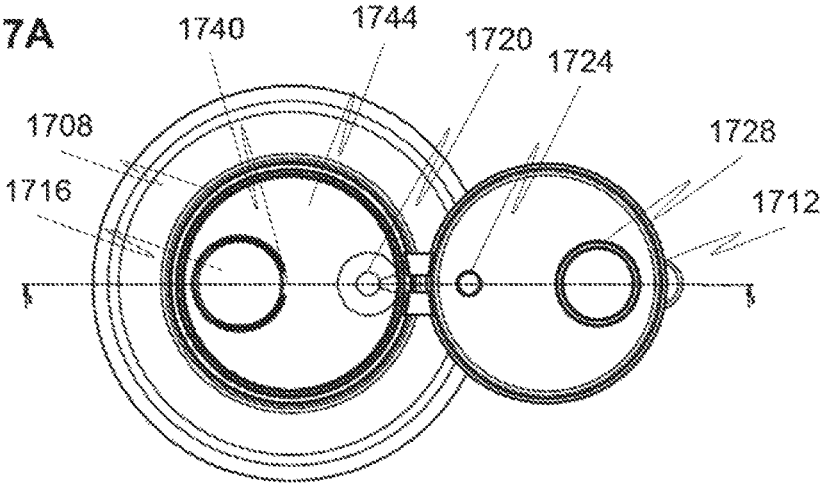
Figure 17C:
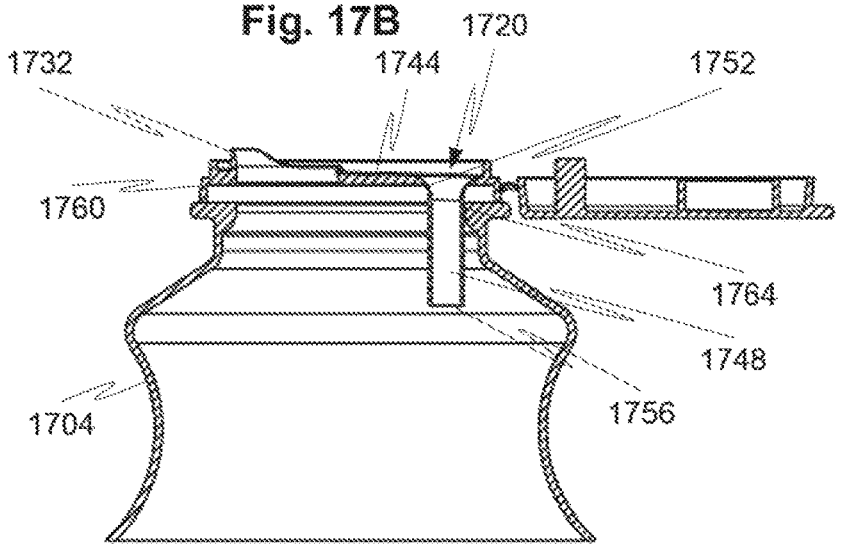

With reference now to FIGS. 17A-C, yet another example of a breathable container 1700 will be described in accordance with at least some embodiments of the present disclosure. The container 1700 is shown to include a container body 1704 and a container lid 1708. The container body 1704 may be similar or identical to any of the other containers (e.g., container 104) depicted and described herein. Specifically, the container body 1704 may be responsible for holding the fluid whereas the container lid 1708 may be responsible for providing an opening that is closeable. In the depicted embodiment, the lid 1708 includes a hinged cap 1712, a first opening 1716, and a second opening 1720. The first opening 1716 may correspond to a main fluid passageway whereas the second opening 1720 may correspond to an air inlet or pressure equalizer for the container 1700. As will be discussed in further detail herein, the air inlet 1720 may have a smaller dimension (e.g., radius or diameter) as compared to the first opening 1716 and may be used to allow air into the container body 1704 while fluid flows out of the first opening 1716. Thus, as fluid exits the first opening 1716, air can enter the container body 1704 via the second opening 1720, thereby equalizing the pressure within the container body 1704. This effectively enables the fluid to be poured from the container 1700 without glugging. In the absence of glugging, the fluid exiting the container body 1704 can pour smoothly and be controlled more easily than if glugging were to occur.

The hinged cap 1712 is shown to include a first stopper 1724 and a second stopper 1728. The stoppers 1724, 1728 may seal or otherwise secure the openings 1716, 1720 when the cap 1712 is in a closed position. The stoppers 1724, 1728 may correspond to optional elements, but can be useful to minimize undesired fluid leakage from the container lid 1708.

The first opening 1716 is shown to be at least two times larger in diameter than the second opening 1720, thereby providing an easier path of fluid exit from the container body 1704 as compared to the second opening 1720. In some embodiments, the first opening 1716 may have a diameter that is at least three times larger than the diameter of the second opening 1720. The first opening 1716 and second opening 1720 are shown to be aligned across the middle of the lid 1708, which is directly aligned with the center of the hinge on which the hinged cap 1712 pivots. It should be appreciated, however, that such a central alignment is not required.

The first opening 1716 is also shown to include a raised lip 1732, a sidewall 1736, and a flowback groove 1740. The raised lip 1732 helps to ensure that liquid pouring from the first opening 1716 does not leak or make a mess on the rest of the lid 1708. In other words, the raised lip 1732 creates a longer pouring surface that extends beyond the end of the lid 1708 when the container 1700 is tilted at a pouring angle.

The sidewall 1736 of the first opening 1716 is shown to have a lower height as compared to the raised lip 1732. The purpose of the sidewall 1736 is to coerce fluid flowing out of the first opening 1716 toward the raised lip 1732, thereby increasing pour accuracy. As will be discussed in further detail herein, the sidewall 1736 may extend completely around the first opening 1716 or the sidewall 1736 may be interrupted by the flowback groove 1740.

The flowback groove 1740 is aligned directly between a center of the first opening 1716 and a center of the second opening 1720. The flowback groove 1740 helps facilitate fluid dripping back into the second opening 1720 when the container 1700 is in an upright (e.g., non-pouring) orientation. More specifically, as seen in the cross-sectional view of FIG. 17C, there is a lid canopy 1744 that extends around the opening of the container body 1704 and which connects the first opening 1716 with the second opening 1720. The lid canopy 1744 is shown to have a slight tilt from front to back, which facilitates fluid flow from the first opening 1716 toward the second opening 1720 when the container 1700 is in an upright orientation. Thus, any excess liquid remaining on the sidewall 1736 or raised lip 1732 can flow directly back into the first opening 1716 or flow back across the lid canopy 1744 to the second opening 1720.

The cross-sectional view of FIG. 17C also shows that the second opening 1720 is connected with an air inlet tube 1748. The tube 1748 includes a top end 1752 that interfaces with the lid canopy 1744 and a bottom end 1756 that extends past the neck of the container body 1704 and into the shoulder of the container body 1704. The top end 1752 of the air inlet tube 1748 exhibits a smooth or contoured edge that enables fluid on the lid canopy 1744 to easily flow back into the air inlet tube 1748 when the container 1700 is in an upright position. As can be appreciated, when the container 1700 is tilted and fluid is flowing from the first opening 1716, the air inlet tube 1748 acts as an air passageway that allows air to enter the container body 1704, thereby equalizing the pressure within the container body 1704. Although the air inlet tube 1748 is shown to have a vertical orientation when the container 1700 is in an upright position, it should be appreciated that any type of air inlet tube orientation can be accommodated. For instance, rather than being substantially orthogonal to the opening of the container body 1704, the air inlet tube 1748 may extend at a diagonal angle relative to the opening of the container body 1704 thereby positioning the bottom end 1756 of the air inlet tube 1756 nearer the sidewall of the container shoulder, which will help the air inlet tube 1748 access an air pocket in the container body 1704 rather than fluid when the container 1700 is tilted and fluid is pouring from the first opening 1716. The air inlet tube 1764 has an outer sidewall that contacts the mouth opening of the container body 1704.

The orientation of the first opening 1716 and second opening 1720 relative to one another and relative to the sidewalls of the container opening is also important. As can be seen in FIG. 17C, the raised lip 1732 (e.g., the outer end of the first opening 1716) is substantially aligned with the opening of the container. Such an alignment enables an efficient fluid flow across the container opening through the first opening 1716. The outer perimeter 1760 of the lid 1708 is shown to secure around the opening of the container body 1704. It should be appreciated that the lid 1708 may be snap fit, welded, or otherwise secured to the container body 1704 using any type of known adhesive, glue, fitment, fastener, or the like. Much like the first opening 1716, the second opening 1720 is positioned relative to the container opening to facilitate as large a distance between the first opening 1716 and second opening 1720 as possible. In the depicted embodiment, however, the air inlet tube 1748 is placed directly against (e.g., in direct contact with) the mouth of the container opening. However, because the second opening 1720 has the rounded top end 1752, the top-most portion of the top end 1752 is positioned outside the mouth of the container opening. The lid 1708 is also shown to have a rim extending around its entire circumference to help ensure that fluid on the lid canopy 1744 does not spill outside the lid 1708. This outer rim is positioned beyond the outer sidewall of the container neck and is substantially tangential with the second opening 1720. By pushing the first and second openings 1716, 1720 as far apart as possible, the second opening 1720 effectively operates as an air inlet during pouring orientations but then operates as a spill or fluid collection opening that returns excess fluid from the lid 1708 back into the container body 1704. It should be appreciated that if the first and second openings 1716, 1720 were not pushed as far apart as possible, then the likelihood of fluid exiting from the second opening 1720 during a pouring orientation (e.g., when the container 1700 is tilted related to gravitational forces) would increase, which basically makes it more difficult for air to enter the second opening 1720 against the fluid flow, thereby making pressure equalization more difficult or impossible. This may result in undesirable glugging or non-smooth fluid flow from the container 1700.

Figure 18A:
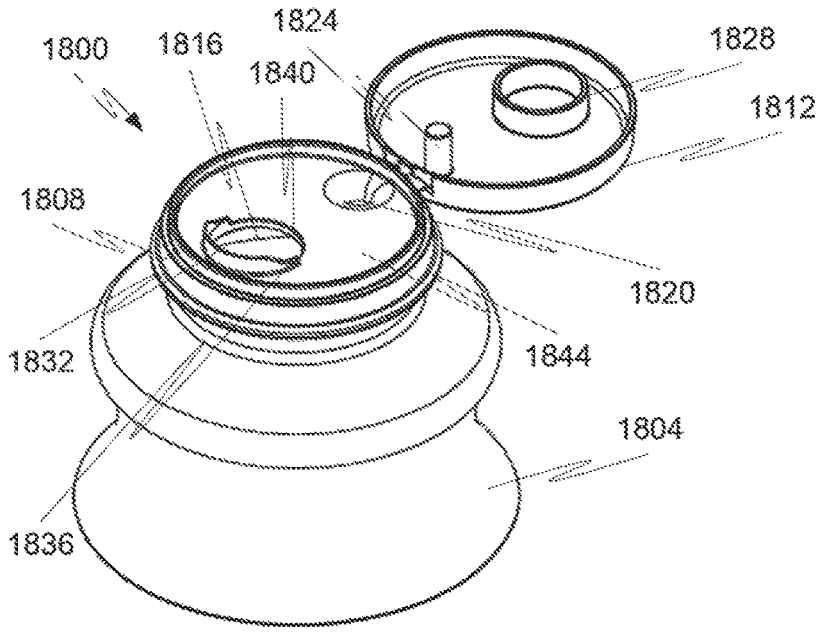
FIGS. 18A-18C depict another example of a breathable container in accordance with embodiments of the present disclosure.
Figure 18B:
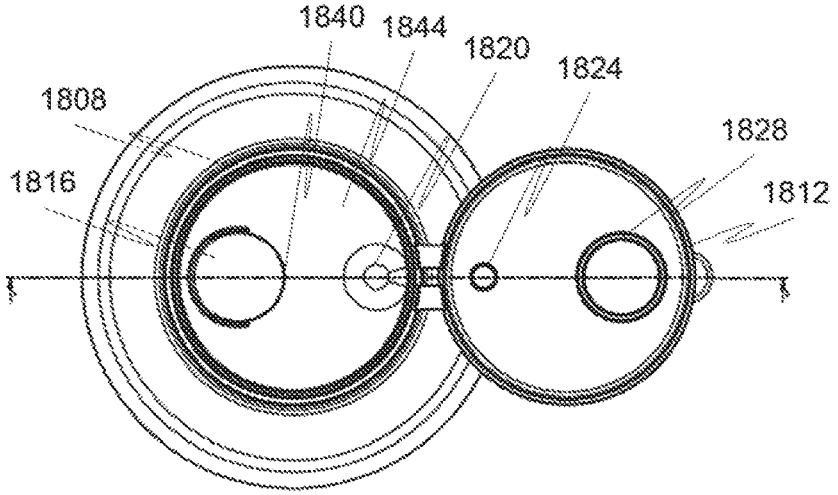
Figure 18C:
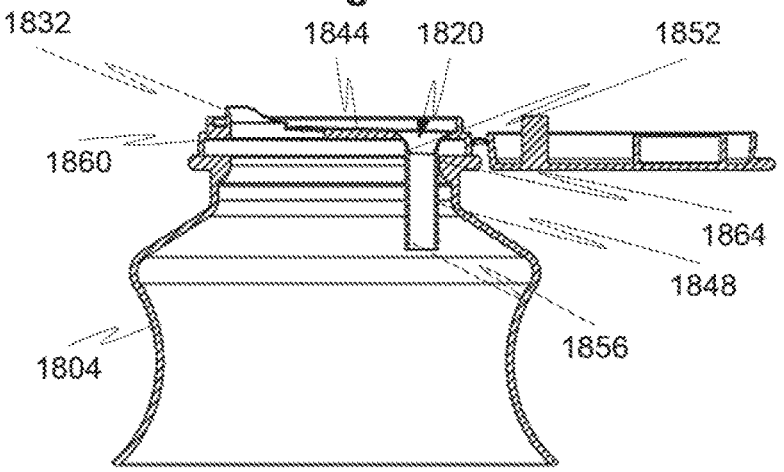

FIGS. 18A-C depict another example of a container 1800 having a lid 1808 equipped with a pair of openings 1816, 1820, that are similar to openings 1716, 1720. The container 1800 also includes a container body 1804, which may be similar to container body 1704. The lid 1808 of the container 1800 is shown to include a hinged cap 1812 with a first and second stopper 1824, 1828, which may be similar to the hinged cap 1712. The lid 1808 also includes a lid canopy 1844 that connects the first opening 1816 with the second opening 1820. The second opening 1820 has an air inlet tube 1848 attached thereto that includes a top end 1852 and a bottom end 1856. The air inlet tube 1848 behaves similarly to the air inlet tube 1748. Moreover, the position of the second opening 1820 and air inlet tube 1848 relative to the container opening is similar in that the outer sidewall 1864 of the air inlet tube 1848 directly contacts the opening of the container mouth.

The lid 1808 also includes an outer perimeter 1860 that is similar to outer perimeter 1760. The outer perimeter may support an outer rim of the lid 1808 to help prevent fluid from flowing out beyond the outer perimeter 1860. The outer rim of the lid 1808 may also seal with the outer perimeter of the hinged cap 1812 when the cap 1812 is closed.

The lid 1808 differs from lid 1708 in the formation of the components around the first opening 1816. In particular, the first opening 1816 is shown to have the raised lip 1832 that is similar to raised lip 1732 and a sidewall 1836 that is similar to sidewall 1736, except that the sidewall 1836 does not extend around as much of the first opening 1816 as the sidewall 1736. Thus, the flowback groove 1840 created by the opening in the sidewall 1836 is larger than the flowback groove 1740. The flowback groove 1840 in this example extends around more than 40% of the first opening's 1816 perimeter. This extension of the flowback groove 1840 may help to facilitate flowback of fluid from the first opening 1816 to the second opening 1820 when the fluid has a higher viscosity than water. Much like the other lid 1708, the second opening 1820 is positioned at an elevation that is slightly below the opening of the flowback groove 1840. Thus, the lid canopy 1844 is tilted downwardly from the first opening 1816 toward the second opening 1820 to facilitate the flow of fluid from the first opening 1816 to the second opening 1820 when the container 1800 is positioned in an upright orientation. It should be appreciated, however, that the first opening 1816 and second opening 1820 may be positioned at the same elevation and the lid canopy 1844 does not have any tilt associated therewith. The rounded profile of the top end 1852 of the second opening 1820 may be enough to coerce fluid flow from the lid canopy 1844 back into the second opening 1820 and down the air inlet tube 1848 when the container 1800 is in an upright orientation.

Figure 19A:
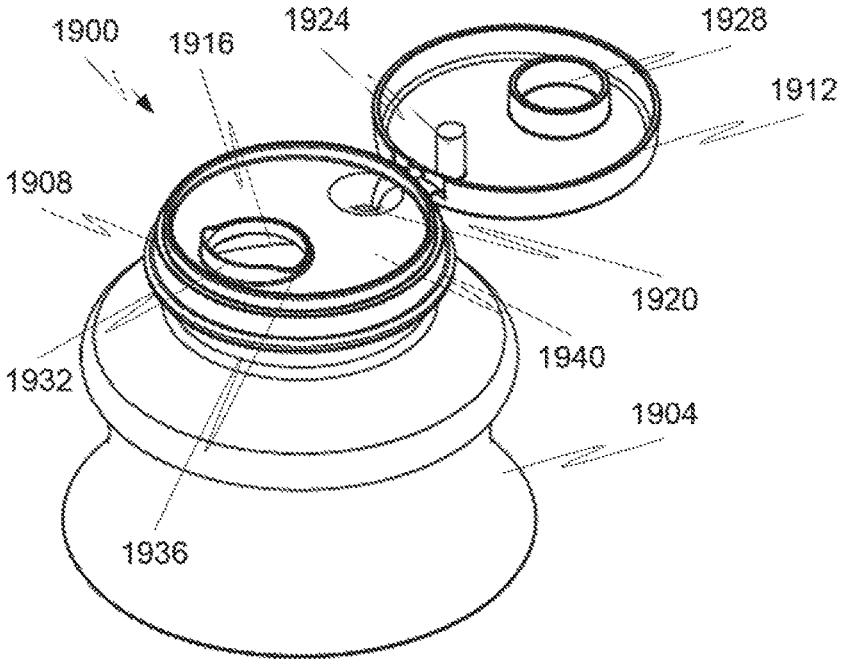
FIGS. 19A-19C depict another example of a breathable container in accordance with embodiments of the present disclosure.
Figure 19B:
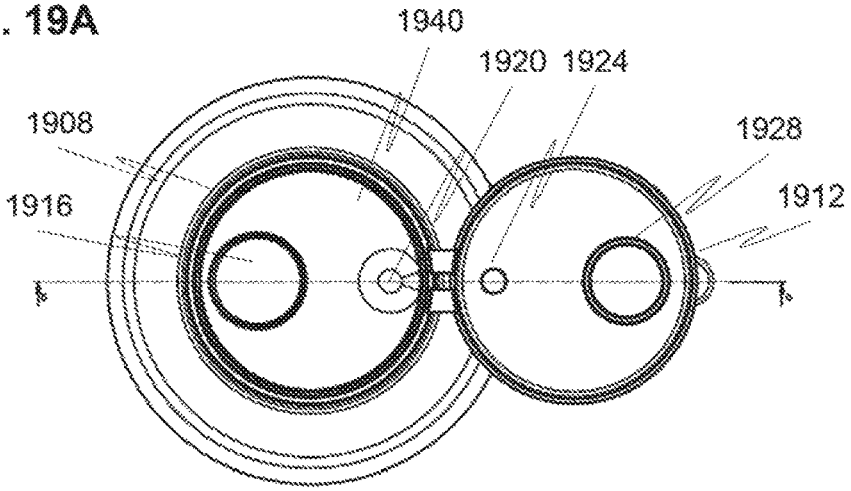
Figure 19C:
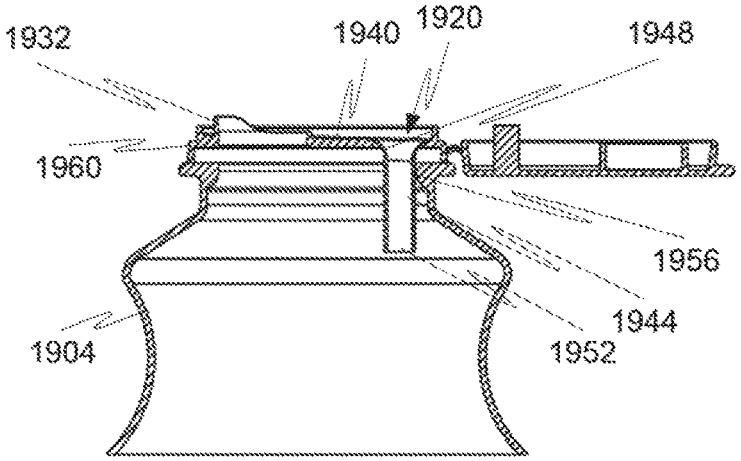

FIGS. 19A-C show yet another variation of the container 1900 with a container body 1904 and lid 1908. The lid 1908 may be similar or identical to other lids depicted and described herein except that the sidewall 1936 extending around the first opening 1916 does not have an interruption and, therefore, does not include a flowback groove. Thus, the raised lip 1932 and sidewall 1936 circumnavigate the entirety of the first opening 1916. Such a configuration may be useful when the container 1904 is used for holding liquids like water and liquids with a higher viscosity since such liquids will not likely collect around the first opening 1916 when being poured out. In such circumstances, only liquids that have collected at the outer end of the raised lip 1932 will flow back across the lid canopy 1940 toward the second opening 1920. All other liquids will reenter the container body 1904 via the first opening 1916. As with the other container lids, the container lid 1908 is shown to include a hinged cap 1912 having a first and second stopper 1924, 1928 as well as an outer perimeter 1960. The second opening 1920 is shown to be connected to the air inlet tube 1944, which includes a top end 1948, bottom end 1952, and an outer sidewall 1956 in contact with the mouth of the container.

Figure 20A:
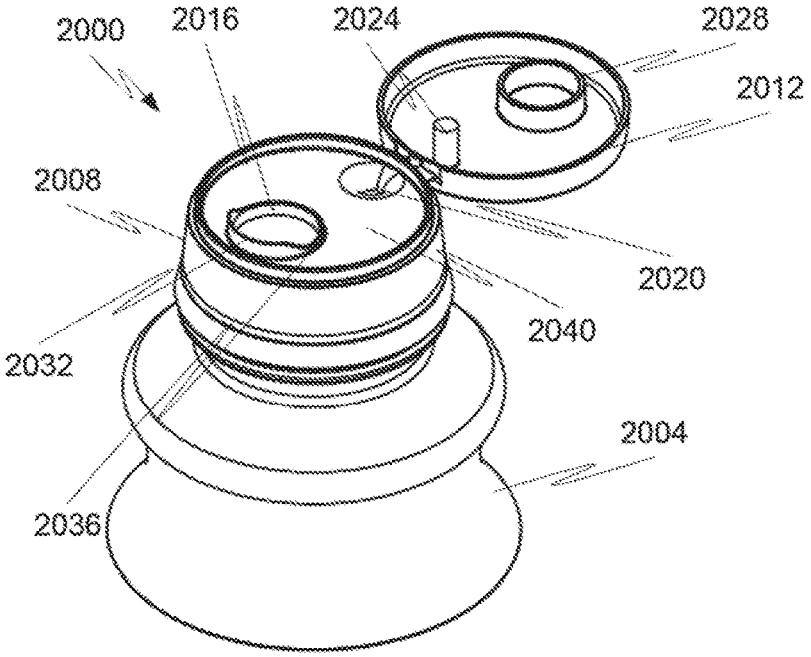
FIGS. 20A-20C depict another example of a breathable container in accordance with embodiments of the present disclosure.
Figure 20B:
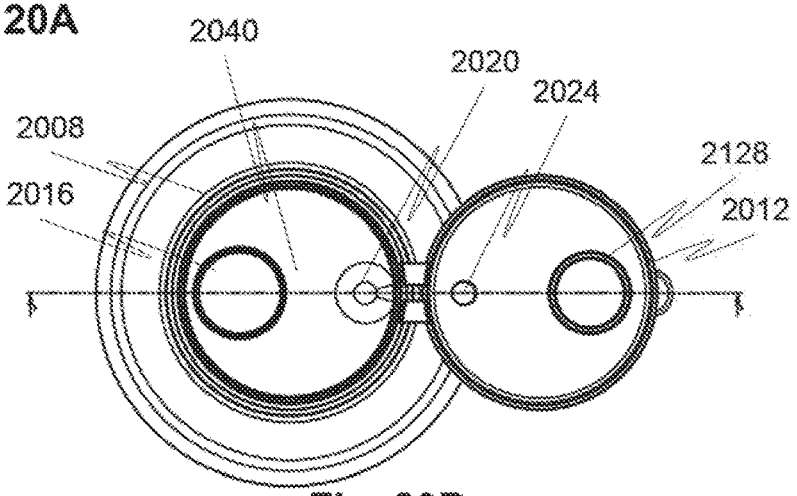
Figure 20C:
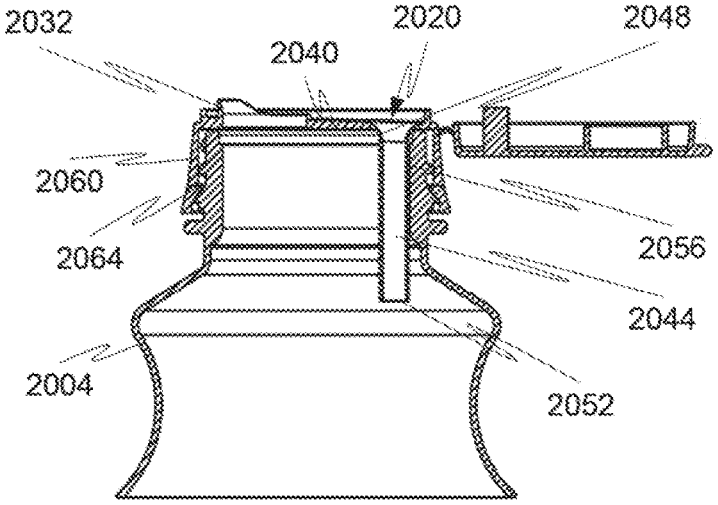

FIGS. 20A-C depict another variation of the container 2000 with a container body 2004 and lid 2008. The container 2000 is similar to container 1900 except that the lid 2008 is not integrally-connected, welded, or snapped onto the container body 2004. Rather, the container body 2004 has a threaded 2064 onto which the lid 1908 is screwed. More specifically, the outer perimeter 2060 of the lid 2008 comprises a threaded portion that mates or interacts with the threads 2064 of the neck of the container 2000. This enables a container body 2004 to be built according to normal specifications and then a modular lid 2008 can be screwed onto the top of the container. The lateral distance between the outer perimeter 2060/thread 2064 and the sidewall 2056 of the air inlet tube 2044 may be controlled such that the air inlet tube 2044 is pressed into contact with the inner wall of the mouth, thereby pinching the mouth of the container between the air inlet tube 2044 and the outer perimeter 2060 of the lid 2008.

Figure 21A:
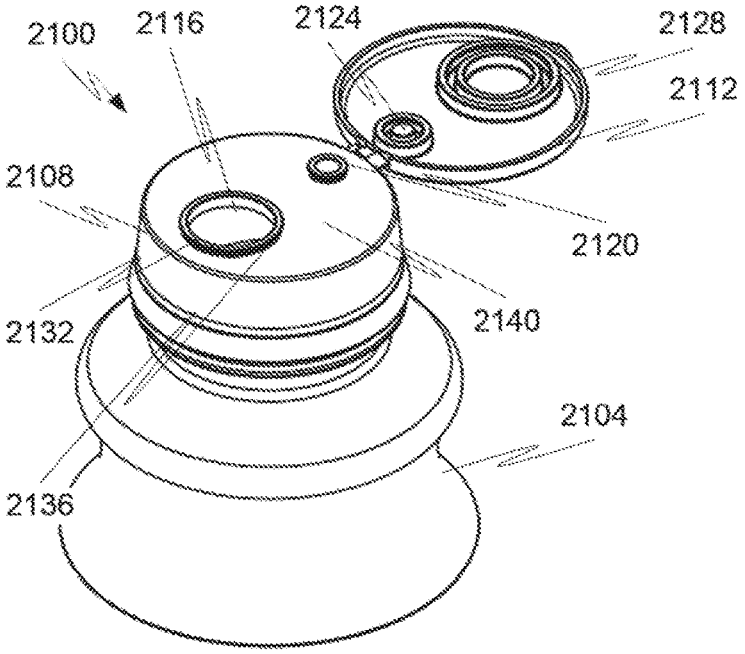
FIGS. 21A-21C depict another example of a breathable container in accordance with embodiments of the present disclosure.
Figure 21B:
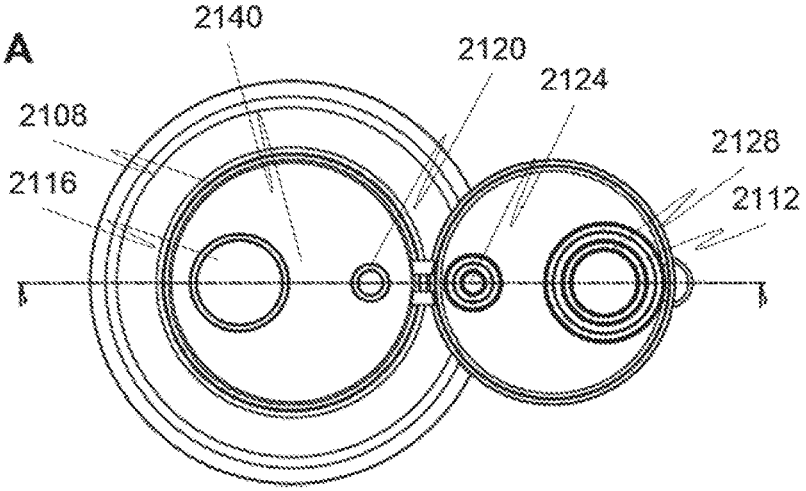
Figure 21C:
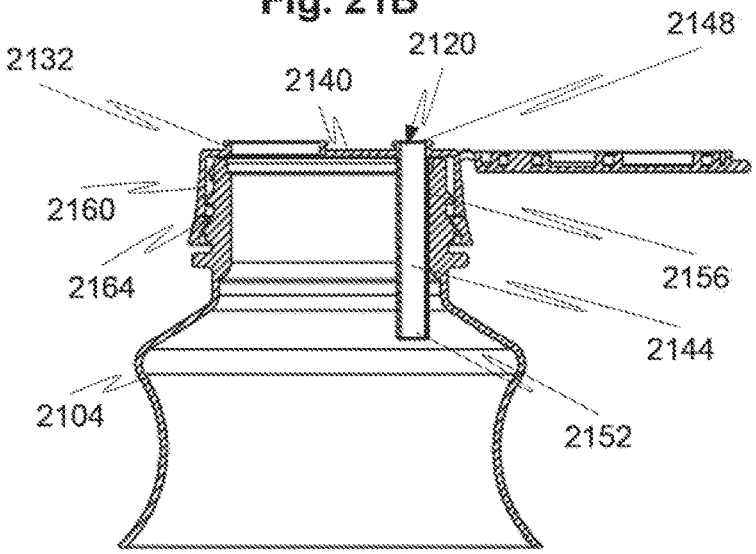

FIGS. 21A-C depict yet another variation of container 2100 in accordance with at least some embodiments of the present disclosure. The container lid 2108 is shown to thread onto the top of the container body 2104 much like the container lid 2008. In particular, the lid 2108 includes an outer perimeter 2160 and thread 2164 that interface with a threaded portion of the container mouth (much like a bottle cap). The lid canopy 2140 extends substantially across the mouth opening and connects the first opening 2116 and the second opening 2120. In this particular design, the lid canopy 2140 extends substantially parallel with the mouth of the container, thereby minimizing the profile/height of the lid 2108.

The lid 2108 differs from other lids shown thus far in that lid 2108 has a substantially continuous sidewall 2132 that circumnavigates the first opening 2116. The substantially continuous sidewall 2132 has a substantially constant height and is raised relative to the lid canopy 2140. Similarly, the second opening 2120 is positioned above the lid canopy 2140. In such a design, the second opening 2120 also exhibits a rim or sidewall that extends around the second opening 2120. Compared with other configurations, this particular configuration may not be as well-suited for collecting liquid drip back from the first opening 2116; however, both rims around the openings 2116, 2120 can interface with stoppers 2124, 2128 to substantially seal liquid in the container when the hinged cap 2112 is closed. Also, because the first opening 2116 does not have an extended lip, the height/profile of the hinged cap 2112 can be kept relatively small, thereby minimizing the amount of material needed to produce the lid 2108.

Although the top of sidewall 2132 is shown to be substantially parallel with the top of the rim surrounding the second opening 2120, it should be appreciated that such a configuration is not required. For instance, the rim around the second opening 2120 may be positioned higher than the sidewall 2132 or the sidewall 2132 may be positioned higher than the rim around the second opening 2120.

Figure 22A:
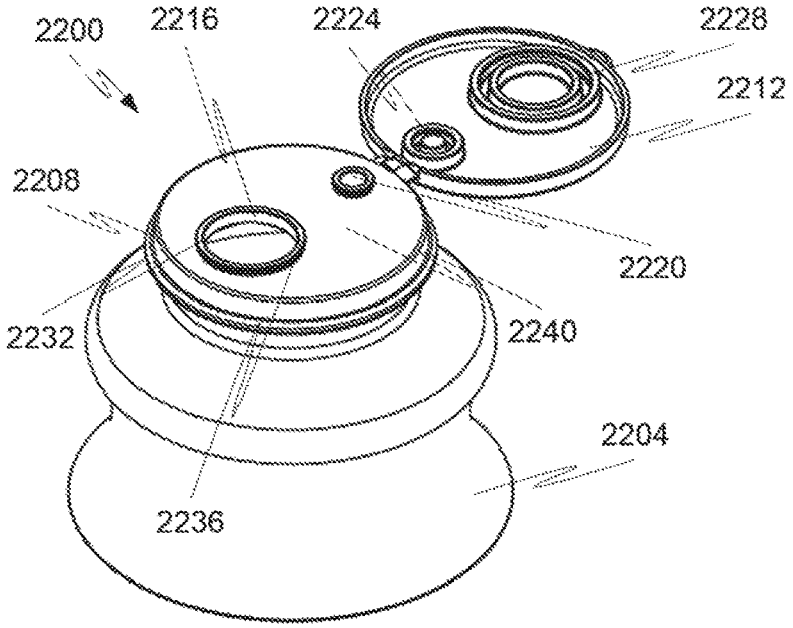
FIGS. 22A-22C depict another example of a breathable container in accordance with embodiments of the present disclosure.
Figure 22B:
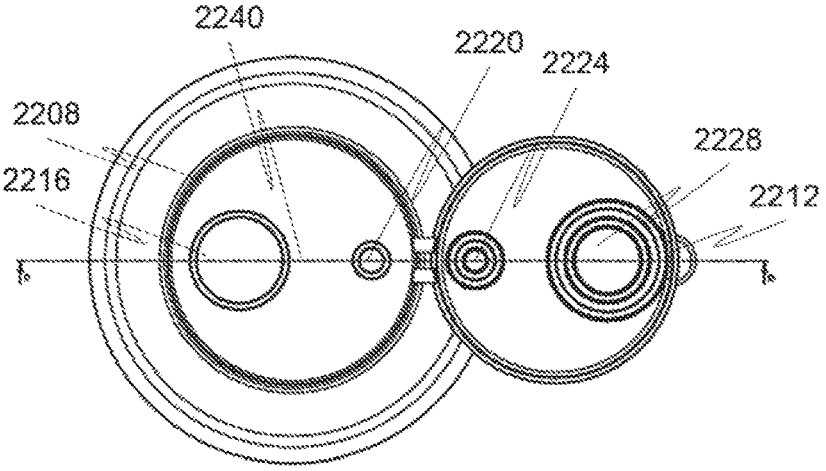
Figure 22C:
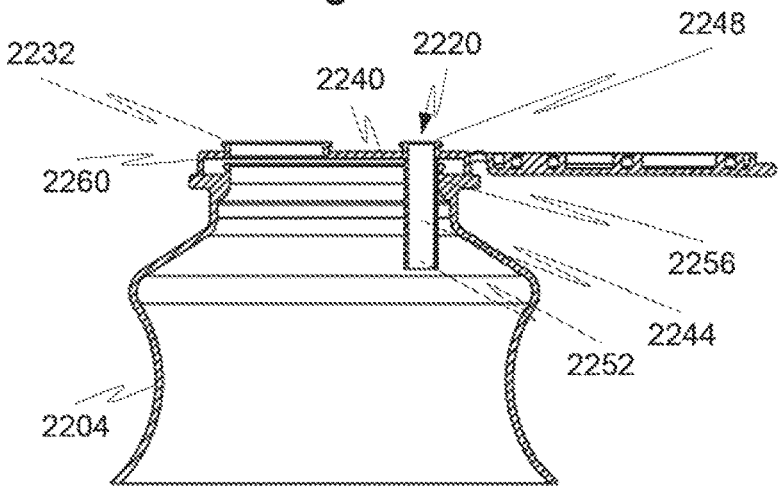

FIGS. 22A-C depict an alternatively variation of a container 2200 in accordance with at least some embodiments of the present disclosure. The container 2200 is shown to include a lid 2208 similar to lid 2108 except that lid 2208 does not thread or screw onto the container 2204. Rather, the lid 2108 interfaces with the container similar to lids 1708, 1808, and 1908. The lid 2208 is similar to lid 2108, however, in that the first opening 2216 is circumnavigated by a sidewall 2232. The second opening 2220 is also shown to have a sidewall or rim of approximately the same height as the sidewall 2232. Furthermore, the lid canopy 2240 is shown to extend substantially orthogonal to the first opening 2216 and/or second opening 2220.

Also similar to lid 2108, the lid 2208 includes a hinged cap 2212 that has stoppers 2224, 2228 that close and seal openings 2216, 2220. When closed, both stoppers may substantially enclose and seal the openings 2216, 2220.

Also similar to lid 2108, the lid 2208 includes an air inlet tube 2244 that has a top end 2248 and bottom end 2252. The top end 2248 is flanged at its top with the rim whereas the bottom end 2252 extends beyond the container mouth/neck into the shoulder of the container body 2204.

Figure 23A:
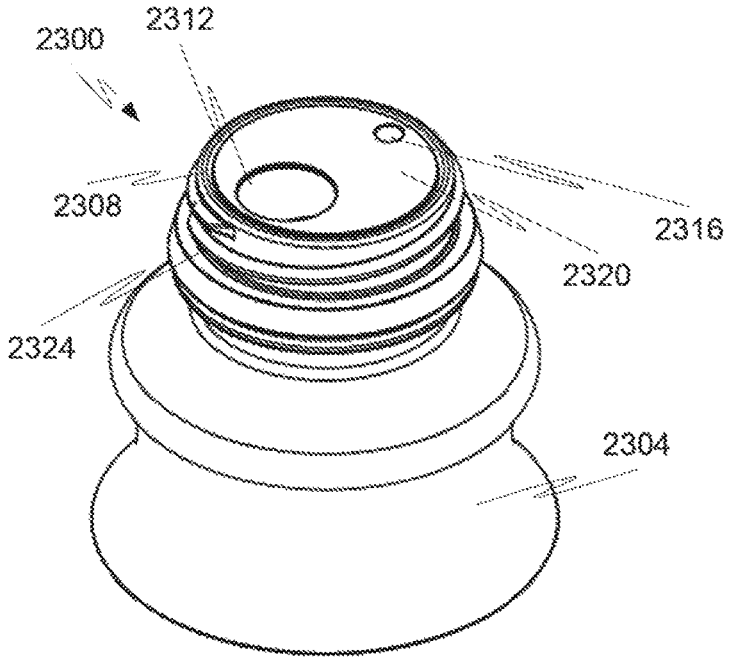
FIGS. 23A-23C depict another example of a breathable container in accordance with embodiments of the present disclosure.
Figure 23B:
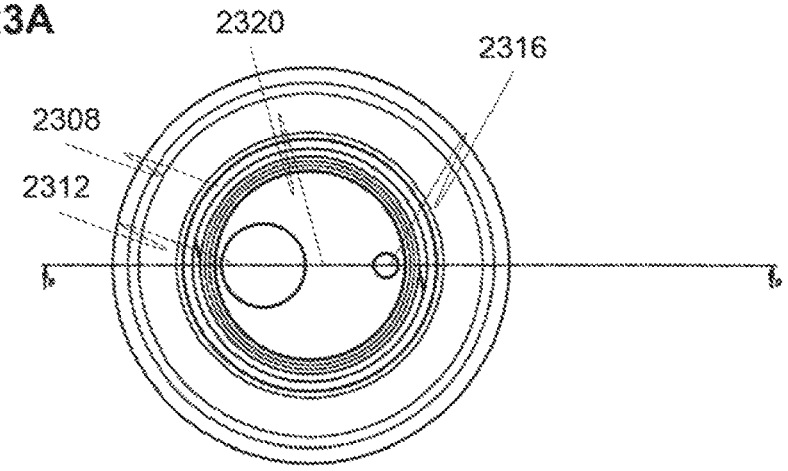
Figure 23C:
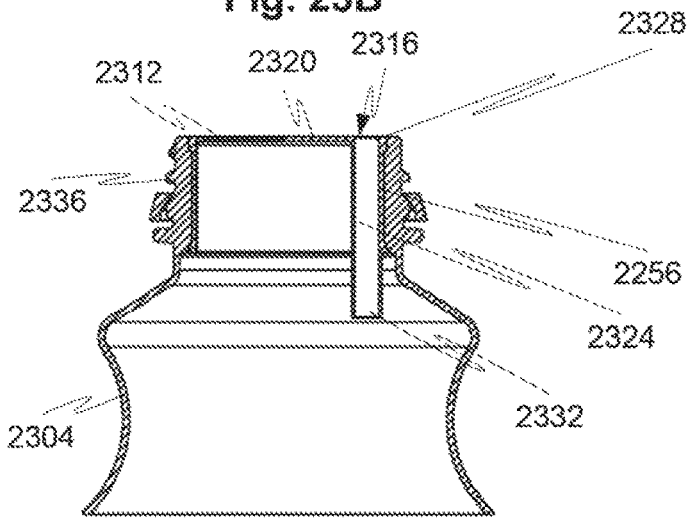

With reference now to FIGS. 23A-C, another variation of container 2300 will be described in accordance with at least some embodiments of the present disclosure. The container 2300 in this example is shown to have lid 2308 with a lid canopy 2320 that is integrated into the mouth of the container. In this example, a planar piece of material is provided as the lid canopy 2320 and this material extends across the opening of the mouth of the container. The lid canopy 2320 includes a first opening 2312 and second opening 2316. The size of the first opening 2312 is at least twice the size of the second opening 2316. The first opening 2312 is shown to be a simple opening in the lid canopy 2320 whereas the second opening 2316 is connected with an air inlet tube 2324. The top end 2328 of the air inlet tube 2324 is substantially planar with the lid canopy 2320 and the bottom end 2332 of the air inlet tube 2324 extends through the container neck into the shoulder of the container body 2304. Although not shown, a traditional screw-on cap may be used to seal the container by interfacing with threading 2336 on the outer circumference of the container neck. Further, the sidewall 2256 of the air inlet tube is integrated with or welded to the inner wall of the container neck. In this way, less material is used to achieve the container top as compared with a modular lid that is separately manufactured and connected with the container.

Figure 24A:
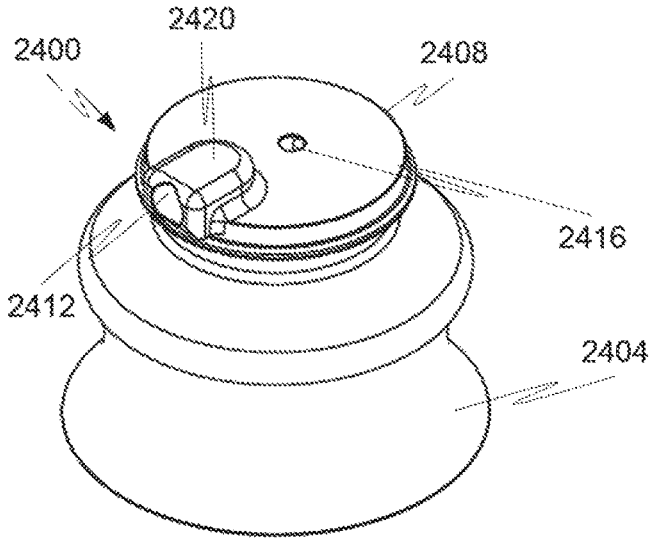
FIGS. 24A-24C depict another example of a breathable container in accordance with embodiments of the present disclosure.
Figure 24B:
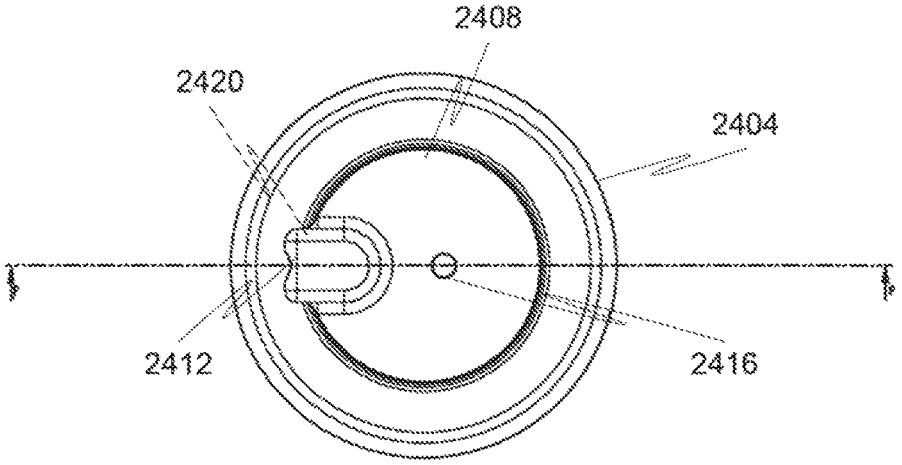
Figure 24C:
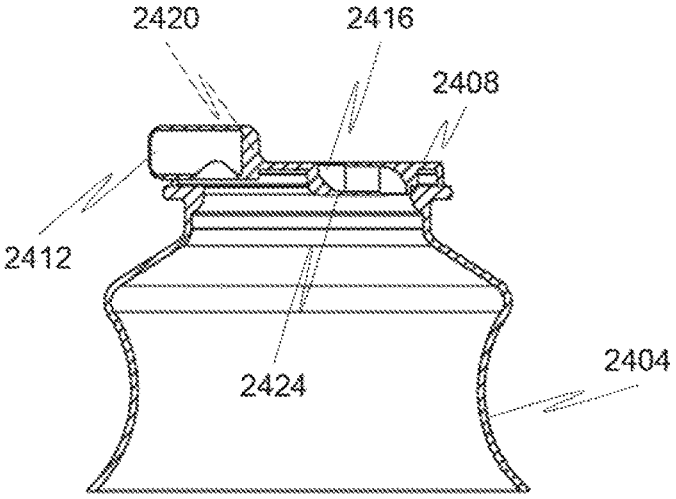

With reference now to FIGS. 24A-C, another variation of container 2400 will be described in accordance with at least some embodiments of the present disclosure. The container 2400 is shown to include a body 2404 and lid 2408 connected thereto. The lid 2408 is shown to be snap connected to the body 2402, but it should be appreciated that the lid 2408 may be welded, glued, or otherwise attached to the body 2404 using any type of known technique.

The lid 2408 includes both a main fluid exit channel 2412 and an air entrance channel 2416. In the depicted embodiment, the cross-sectional area of the main fluid exit channel 2412 is larger than the cross-sectional area of the air entrance channel 2416. Furthermore, the main fluid exit channel 2412 is positioned orthogonally with respect to the opening of the air entrance channel 2416. Such a configuration facilitates a side pour, which effectively means that the container 2400 does not have to be tipped as much to begin pouring fluid therefrom as compared to configurations where the fluid has to be poured out of the top of the lid. The main fluid exit channel 2412 is established with a raised feature 2420 biased toward one side of the lid 2408. The raised feature 2420 elevates the top of the main channel opening 2412 relative to the air entrance channel 2416. This particular configuration also shows the air entrance channel 2416 to extend below the bottom of the main fluid exit channel 2412. This extension of the air entrance channel 2416 is established with a bottom portion 2424 of the lid that extends below the opening 2416 and transverse to the container opening, thereby extending the length that air has to travel before entering the body 2404. By extending the air entrance channel 2416 and positioning the air entrance channel 2416 toward the opposite side of the main fluid exit channel 2412, a user will begin tipping the container 2400, which will initially invoke a fluid flow from the main fluid exit channel 2412. With the air entrance channel 2416 being higher and having a particularly extended length transverse to the container opening, air will begin to flow into the body 2404 as fluid exits. This intake of air will not only help to equalize the pressure inside the body 2404, but the flow of air into the body 2404 will substantially prohibit or counteract fluid that might otherwise try to exit out of the air entrance channel 2416. The longer the path of the air entrance channel 2416, the longer the fluid has to fight against incoming air, which effectively ensures that air will continue to travel inward toward the body 2404 while fluid, choosing the path of least resistance, will bias its flow out of the main fluid exit channel 2412. Also, by having the main fluid exit channel 2412 be larger in cross-section than the air entrance channel 2416, a greater proportion of fluid will exit the body, thereby increasing the negative pressure that pulls air into the body 2404 via the air entrance channel 2416.

Figure 25A:
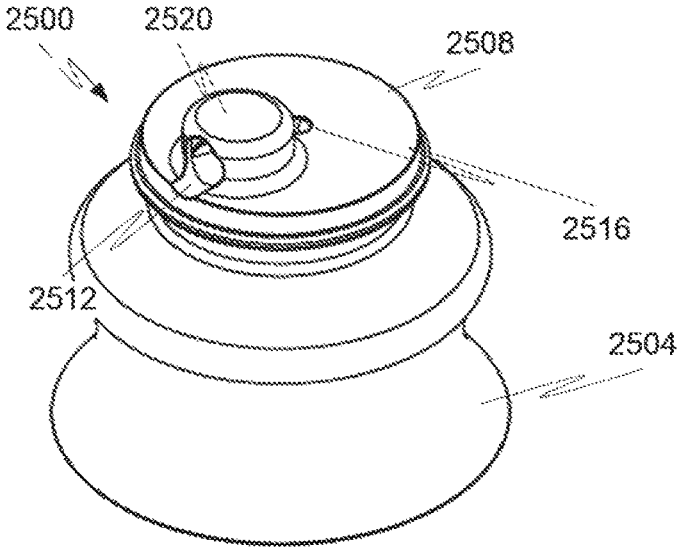
FIGS. 25A-25C depict another example of a breathable container in accordance with embodiments of the present disclosure.
Figure 25B:
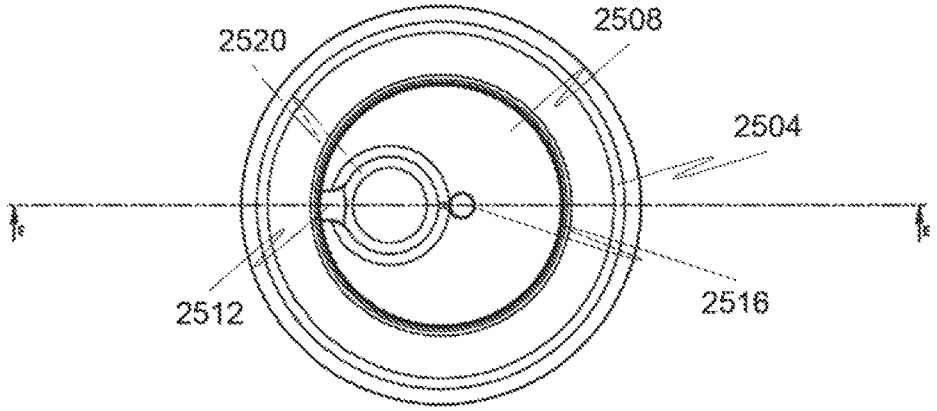
Figure 25C:
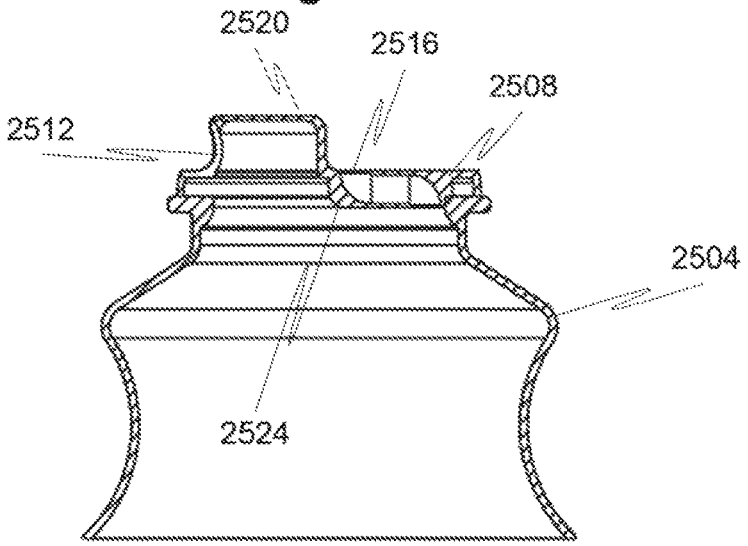

FIGS. 25A-C depict another variation of the front pour container 2500. In this configuration, the container 2500, similar to container 2400, still exhibits a body 2504 and lid 2508. The lid 2508 includes a main fluid exit channel 2512 as well as an air entrance channel 2516 that is extended at least partially transverse to the container opening (e.g., along a length of the lid 2508). This particular configuration shows the raised feature 2520 to have a circular or button shaped configuration. Also, in contrast to container 2400 where the raised feature 2420 extends beyond the end of the lid 2408 and beyond the container opening (e.g., a sidewall establishing the container opening), the raised feature 2520 extends straight up and the main fluid exit channel 2512 is positioned within the main container opening. This shortens the path that fluid has to travel to exit the body 2504, thereby providing a shorter path of flow for such exiting fluid. The air entrance channel 2516 is still shown to include a bottom portion 2524 that is positioned below the container opening. Again, the bottom portion 2524 helps to extend the length of the air entrance channel 2516, thereby helping to ensure that air enters the body 2504 rather than having fluid exit the body 2504 via the air entrance channel 2516.

Figure 26A:
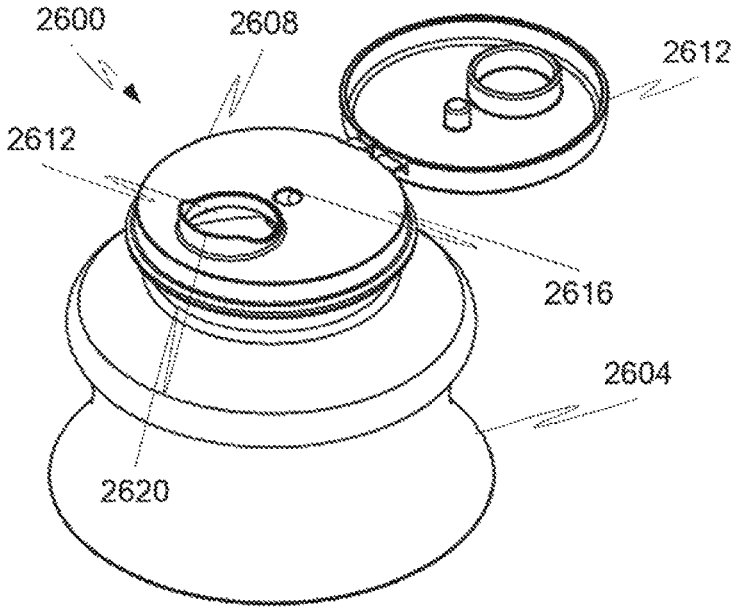
FIGS. 26A-26C depict another example of a breathable container in accordance with embodiments of the present disclosure.
Figure 26B:
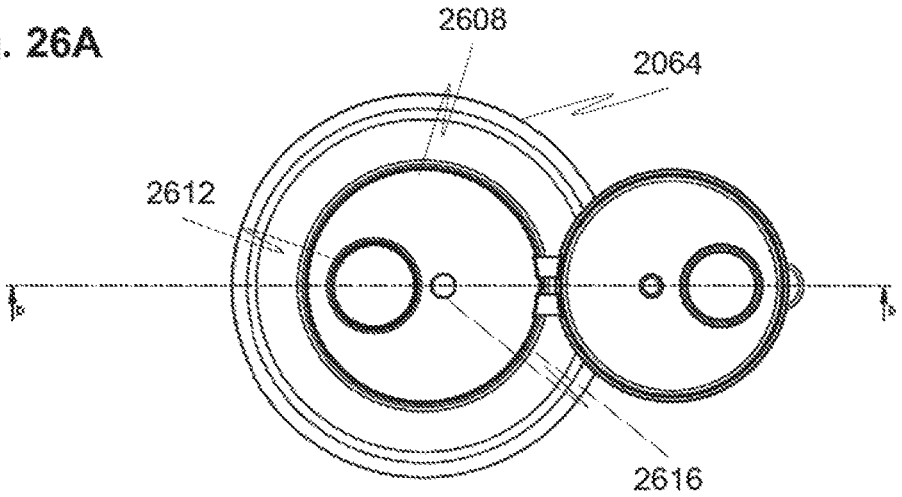
Figure 26C:
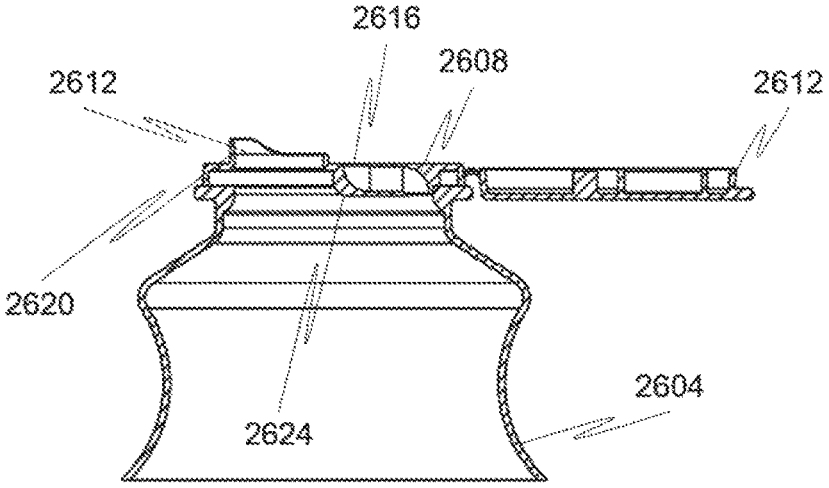
Figure 27A:
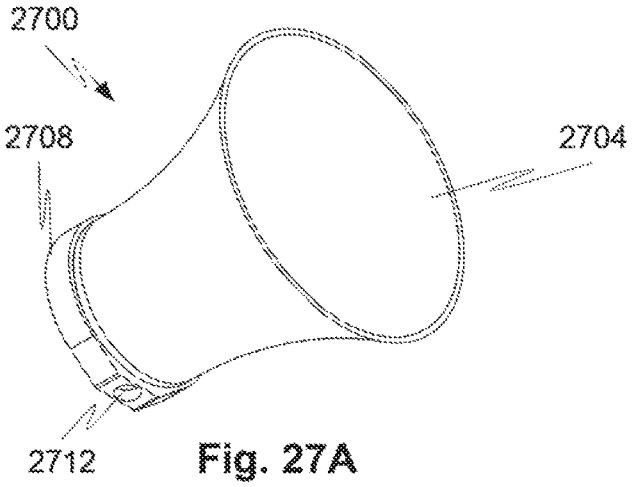
FIGS. 27A-27E depict another example of a breathable container in accordance with embodiments of the present disclosure.
Figure 27B:
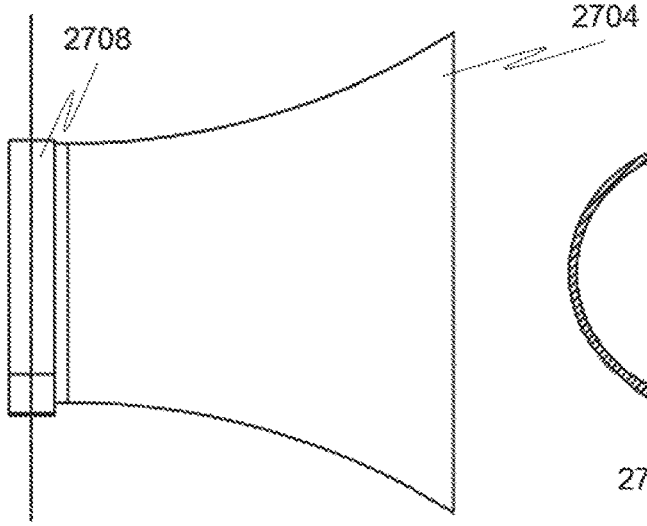
Figure 27C:
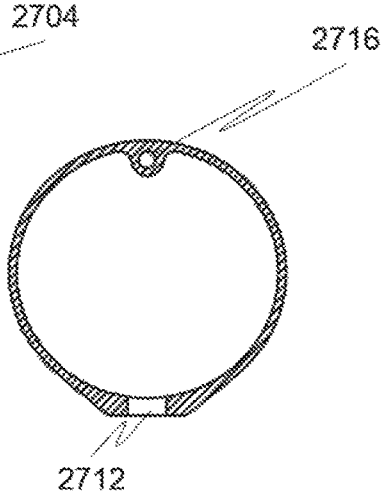
Figure 27D:
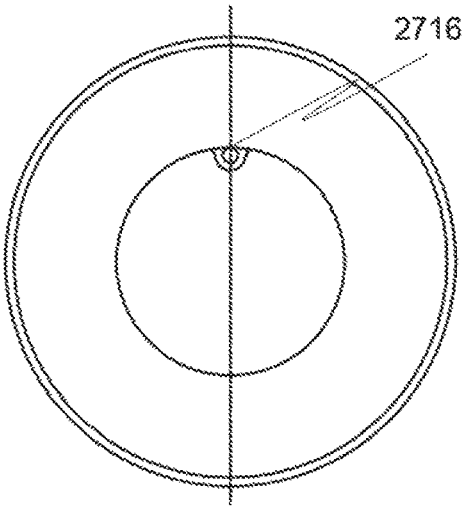
Figure 27E:
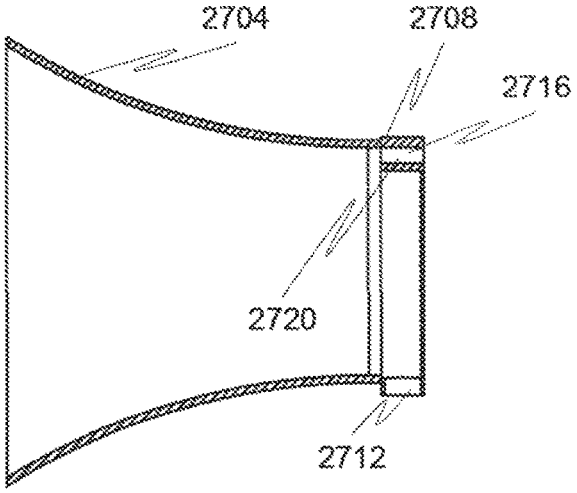
Figure 28A:
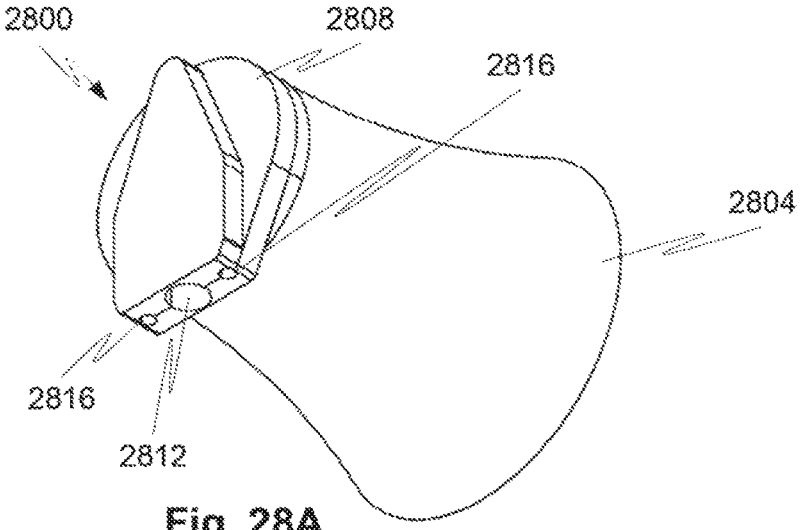
FIGS. 28A-28E depict another example of a breathable container in accordance with embodiments of the present disclosure.
Figure 28B:
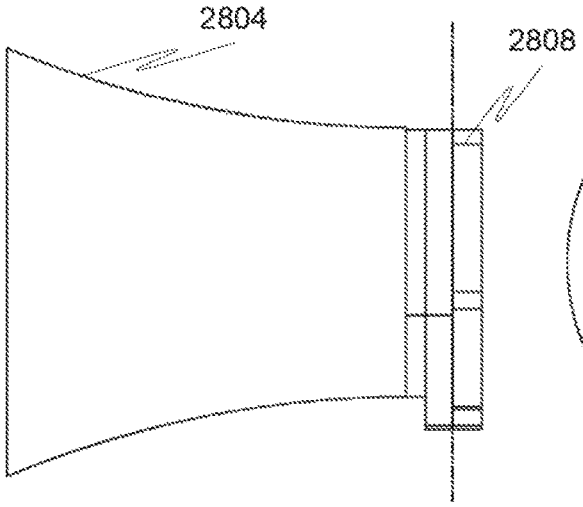
Figure 28C:
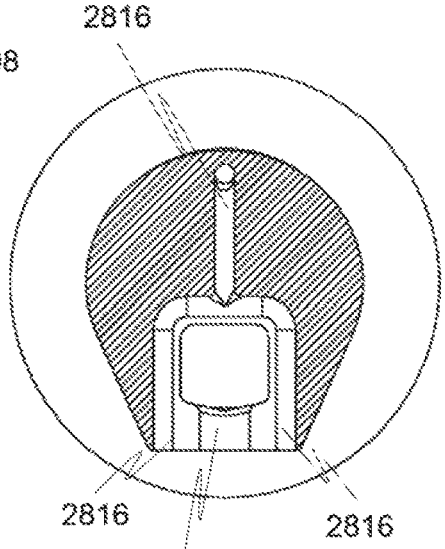
Figure 28D:
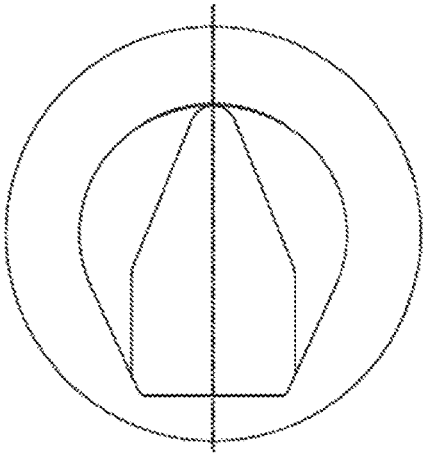
Figure 28E:
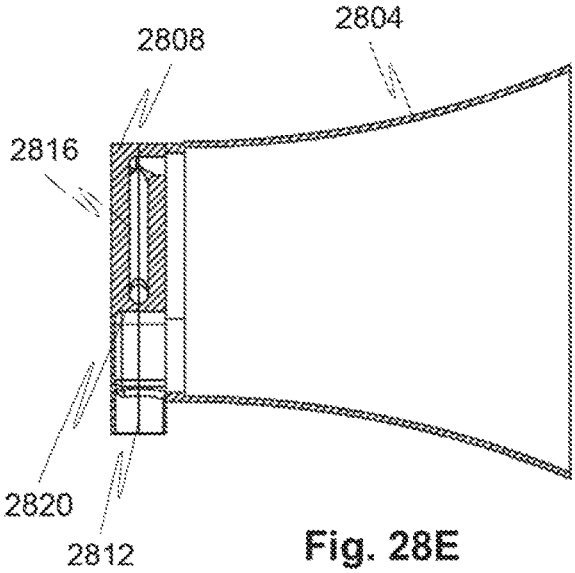
Figure 29A:
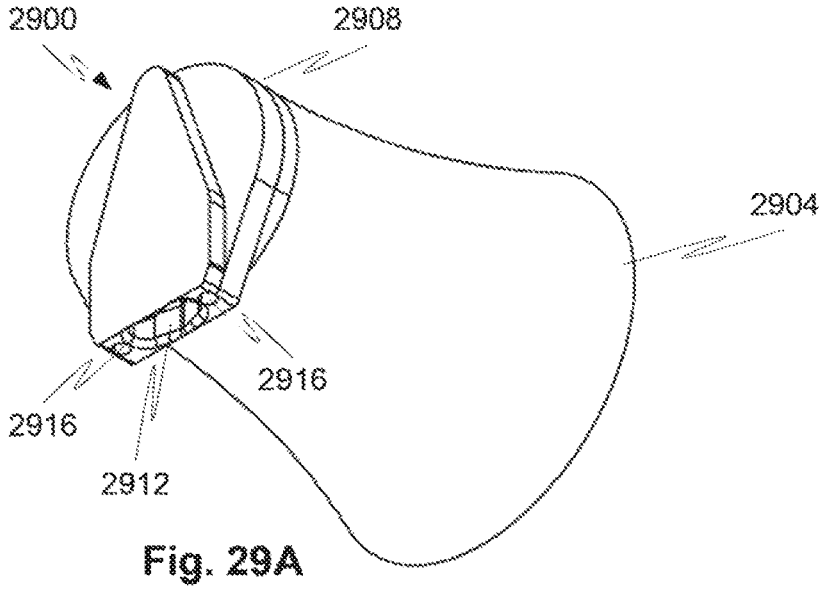
FIGS. 29A-29E depict another example of a breathable container in accordance with embodiments of the present disclosure.
Figure 29B:
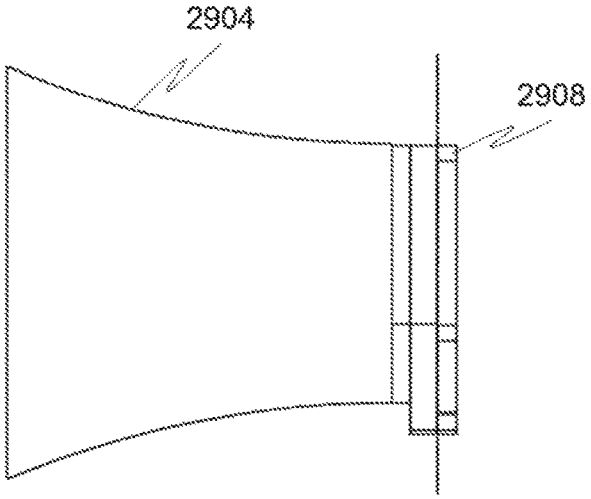
Figure 29C:
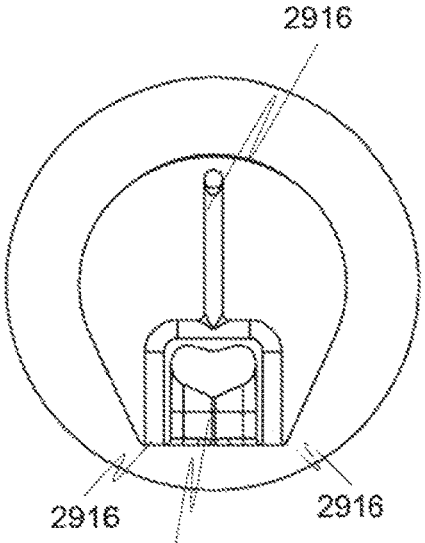
Figure 29D:
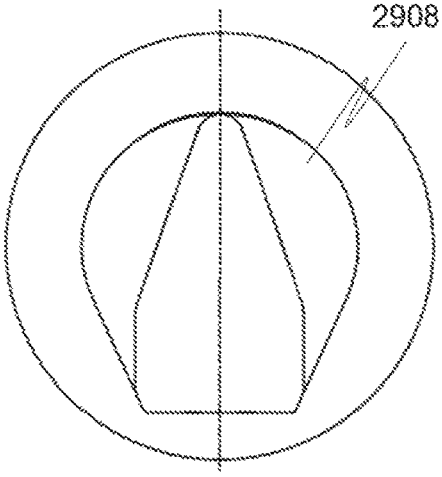
Figure 29E:
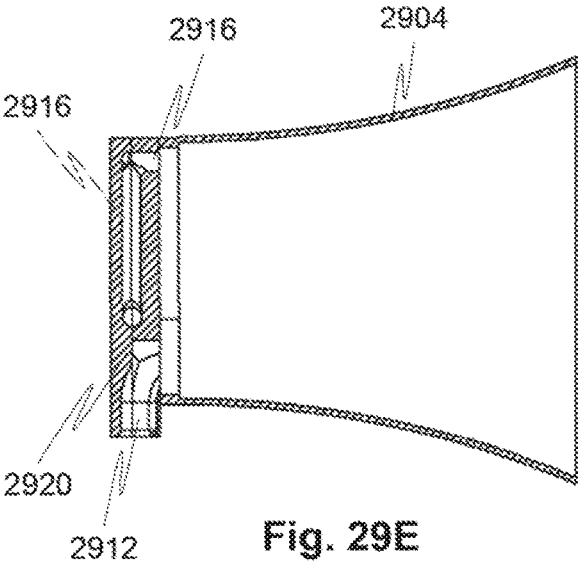
Figure 30A:
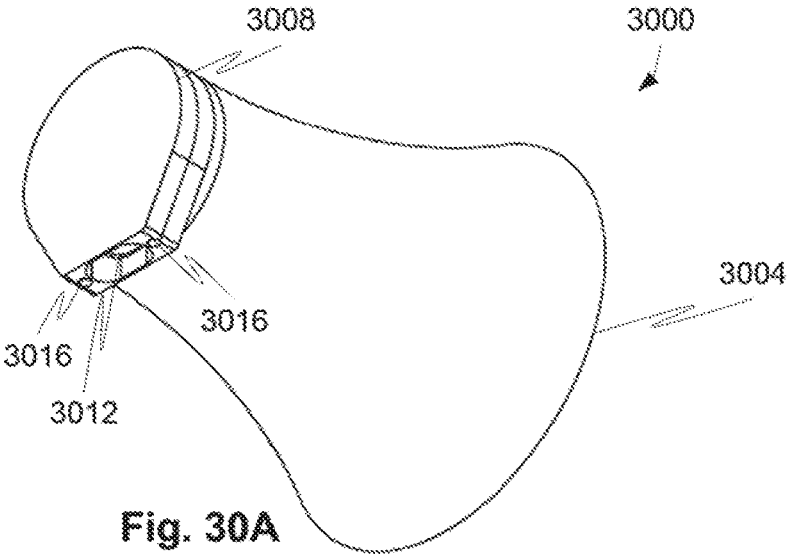
FIGS. 30A-30E depict another example of a breathable container in accordance with embodiments of the present disclosure.
Figure 30B:
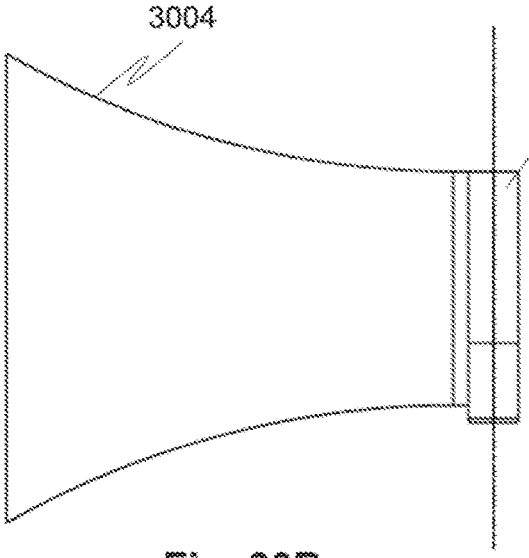
Figure 30C:
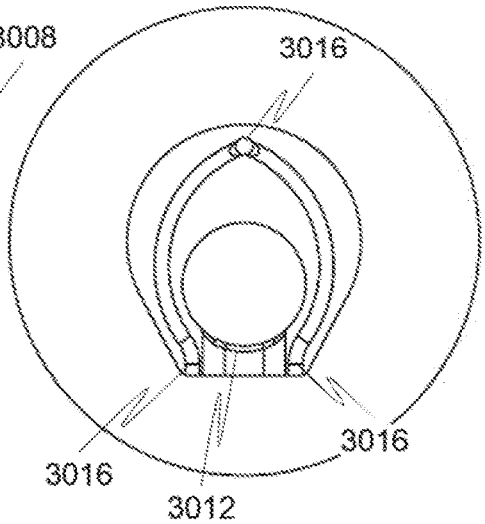
Figure 30D:
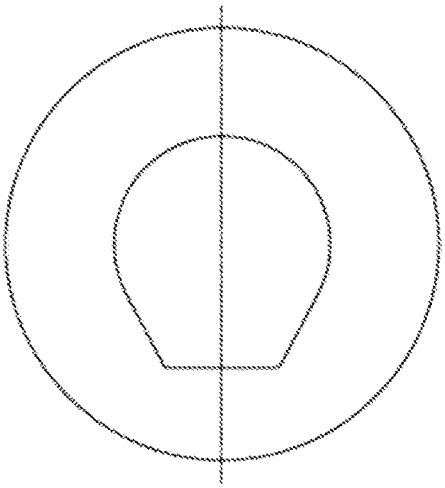
Figure 30E:
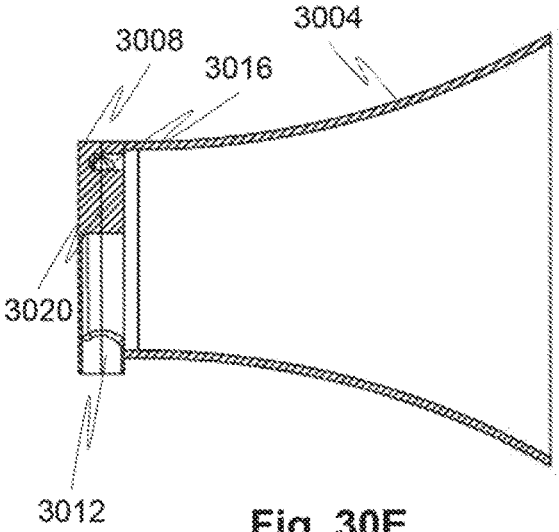

FIGS. 26A-C depict still another variation of a container 2600. This particular configuration is a hybrid of the front pour variations depicted and described herein as well as the variation depicted and described in FIGS. 17A-23C. Container 2600 is shown to include a lid 2608 that is snap fit, welded, or otherwise produced separately from body 2604 and then attached thereto. Of course, the lid 2608 can be an integral portion of the container 2604 without departing from the scope of the present disclosure. The lid 2608 has a main portion and a hinged cap 2612 that can flip to cover both the main fluid exit channel 2612 as well as the air entrance channel 2616. This particular configuration shows that the main fluid exit channel 2612 only has a lip, rather than a raised feature as shown in FIGS. 24A-26C. However, this lid 2608 has an extended air entrance channel 2616 that extends transversely (e.g., in parallel with) the container opening. This configuration is established with the help of the bottom portion 2624 that extends the air entrance channel 2616 without necessarily requiring an air tube to extend substantially past a shoulder of the body 2604. Again, one advantage to such a configuration is that it helps to establish and maintain a desired fluid flow out of the container via the main fluid exit channel 2612 while also facilitating a desired pressure equalization flow or air into the body via the air entrance channel 2616. If the air entrance channel 2616 were not extended with the help of a bottom portion 2624, then fluid may be able to pass out of both channels 2612, 2616 and a desired fluid flow that is substantially continuous and smooth would not be possible.

FIGS. 27A-E depict still another variation of container 2700. This particular variation shows the container 2700 to include a body 2704 and lid 2708. This lid 2708 is shown to be welded or otherwise integrated into the body 2704, but the opening for the main fluid exit channel 2712 is substantially sideways (e.g., orthogonal) to the top of the container 2700. This configuration shows the top wall of the lid 2708 acting to define the top of the main fluid exit channel 2712 and then making a 90 degree turn to also act as the inner wall for the air entrance channel 2716. The air entrance channel 2716 is still extended (as opposed to being a simple hole in the lid 2708) to resemble an air inlet tube by having the sidewall of the lid 2708 extend downward to the bottom of the lid 2708. This extension of the air entrance channel 2716 helps to create an extended fluid path 2720 that facilitates air flow into the container 2704 when fluid is exiting the main fluid exit channel 2712. This also helps to prevent fluid from flowing out of the air entrance channel 2716 in an undesirable fashion.

The configuration of container 2700 and other containers depicted and described herein may be configured for pouring at different container orientations. For instance, and in accordance with at least some embodiments, a front pour configuration may be provided along with a lip or similar structure at the main fluid exit channel. Specifically, a container may have the spout for front pour pouring at an angle that tips down towards the bottom of the container (e.g., beyond 90 degrees). If a normal bottle begins pouring at a 0 degree orientation, and front pour container begins pouring at 90 degrees, then inclusion of a lip to the front pour spout may result in a container that pours beyond 90 degrees. For instance, an initial pouring angle may be achieved at 130 degrees if a lip is provided on a front pour container.

FIGS. 28A-E depict another variation of container 2800 in which a front pour configuration is provided and in which the opening for the air entrance channel 2816 is co-planar with the opening for the main fluid exit channel 2812. In this example, the lid 2808 is connected to the body 2804 of the container 2800 and openings for both channels 2812, 2816 are orthogonally oriented with respect to the top of the body 2804 and with respect to the top of the lid 2808. The air entrance channel 2816 is shown to have a longer path to the body 2804 than the main fluid exit channel 2812. This means that once fluid flow from the main fluid exit channel 2812 is established and air flow into the air entrance channel 2816 is established, then the likelihood of fluid flowing against the inflowing air in the air entrance channel 2816 is very low. Another advantage to this configuration is that the openings for both channels 2812, 2816 being coplanar enables a single mechanism to cover and close both channels (e.g., a single cover can snap into place over all openings simultaneously). It should be appreciated that such a cap may include a snap-fit cap, a threaded cap, or any other type of closure system. In some embodiments, a screw cap can be used to cover all holes (entrance and exit channel openings) by having all channel openings fit into a round exterior shape.

Again, the air entrance channel 2816 is shown to extend substantially transverse to the container opening, but the air entrance channel 2816 extends around the main fluid exit channel 2812 and both channels are substantially coplanar with one another at least until the channels make a turn into the body 2804 of the container 2800.

FIGS. 29A-E and 30A-E depict variations of the container 2800 in which containers 2900, 3000 are also configured for frontal pouring and in which the openings of the air entrance channels 2916, 3016 are substantially coplanar with the opening of the main fluid exit channel 2912, 3012. The examples of these configurations is meant to show that the air entrance channels 2916, 3016 can take any desired configuration and follow any path along the length of the lid 2908, 3008. Moreover, the lid 2908, 3008 can be configured to have a common piece of material that establishes both channels. By having a common piece of material (or two pieces of material) forming the channels and by having the channels exposed on the same side surface of the lid, the container can be manufactured relatively easily and a single cap can be used to cover all channels at substantially the same time.

With reference now to FIGS. 31A-35D, additional details of another breathable container will be described in accordance with at least some embodiments of the present disclosure. The breathable container 3100 is shown to include a container body 3104 enclosed by a cap 3112, which is connected to the body 3104 via a lid rim 3108. Collectively, the cap 3112 and lid rim 3108 operate to enclose a primary container volume 3116 of the body 3104 and to maintain liquid therein until such time as the cap 3112 is moved to a position that allows fluid to flow from the container body 3104. Although the body 3104 is shown to have a particular configuration, it should be appreciated that the container body 3104 may have any shape or form and may be made from any suitable material. Non-limiting examples of such materials include, without limitation, plastic, metal, wood, cork, rubber, or any other composite of such materials.

The lid rim 3108 interfaces with the body 3104 at a top portion of the body 3104. In the depicted embodiment, the lid rim 3108 comprises a female threading that can be threaded onto a corresponding male threading of the body 3104. Other interfaces can also be used between the body 3104 and lid rim 3108, such as snap fittings, glue, etc. Alternatively, the lid rim 3108 may be permanently connected to the body 3104 and the cap 3112 may be releasably attachable to the lid rim 3108 to enable access to the primary container volume 3116.

Figure 31A:
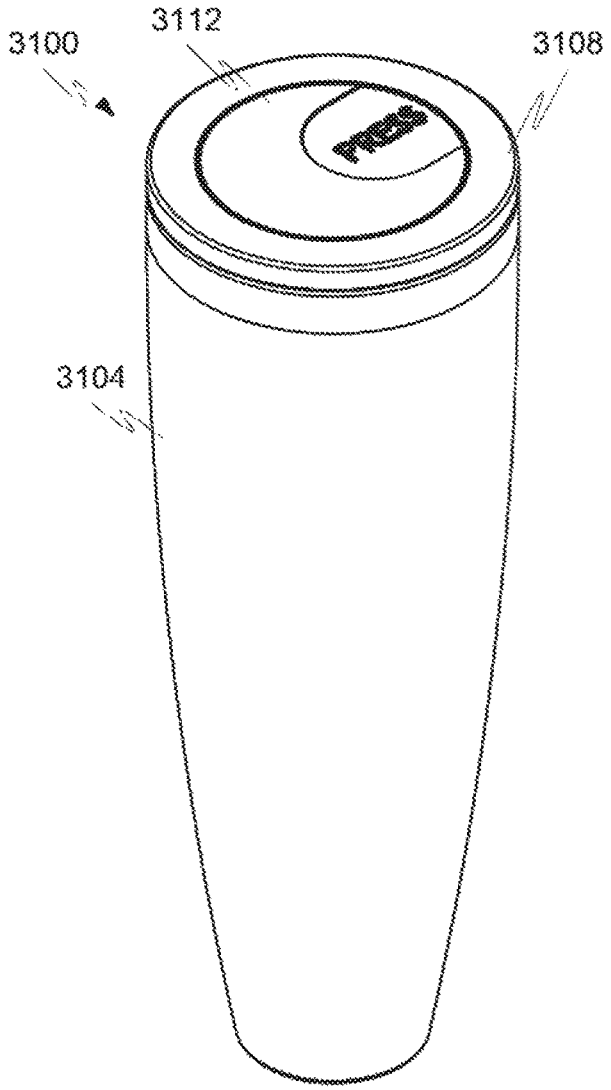
FIGS. 31A-35D depict another example of a breathable container and components thereof in accordance with embodiments of the present disclosure.
Figure 31C:
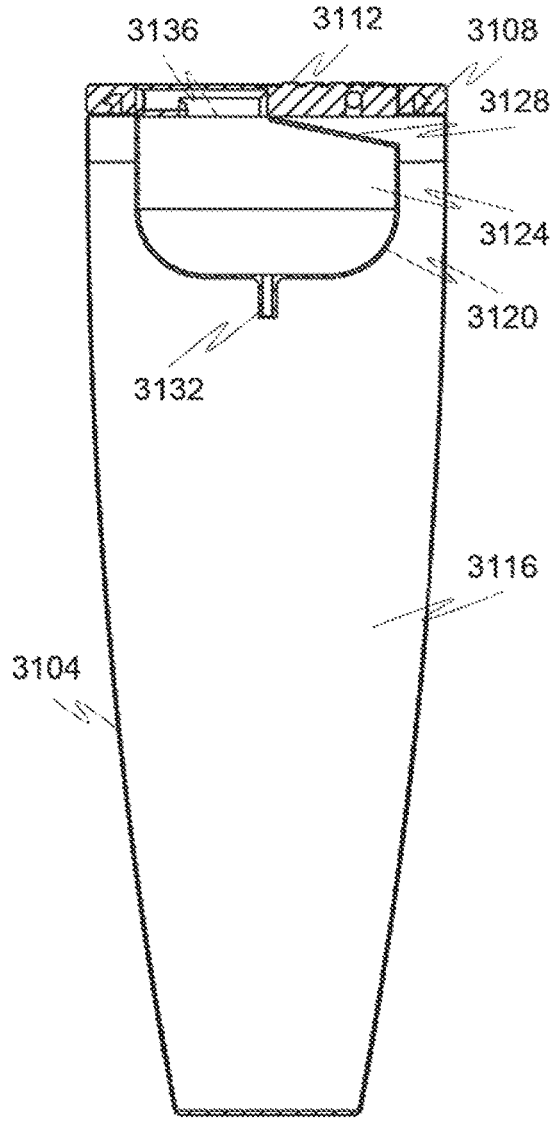
Figure 31B:
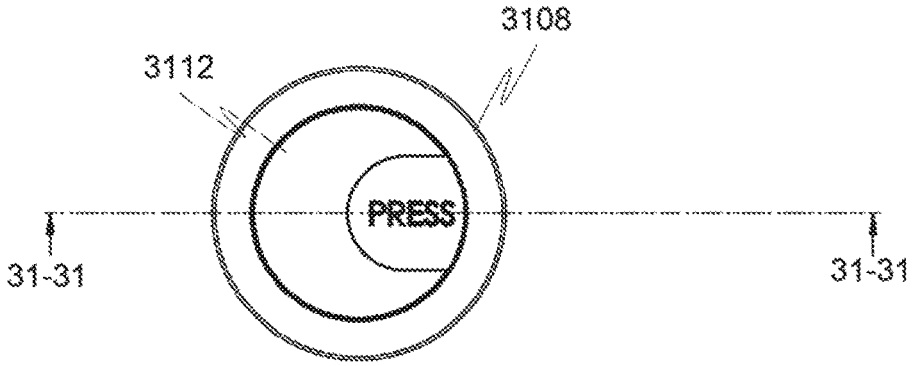
Figure 31D:
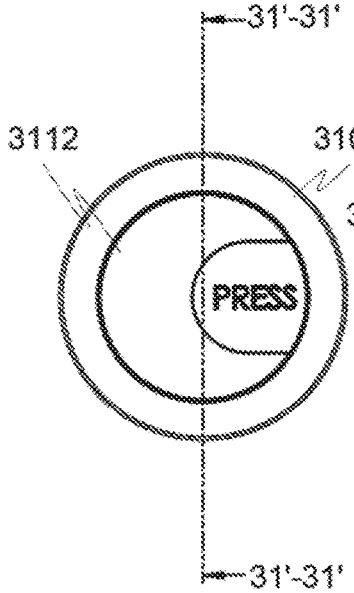
Figure 31E:
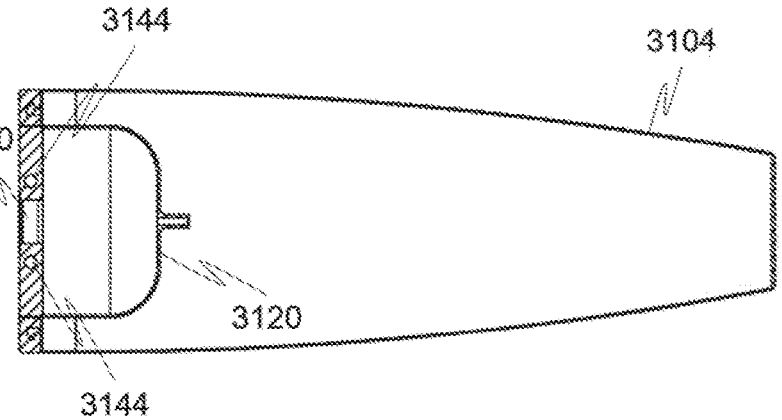
Figure 31F:
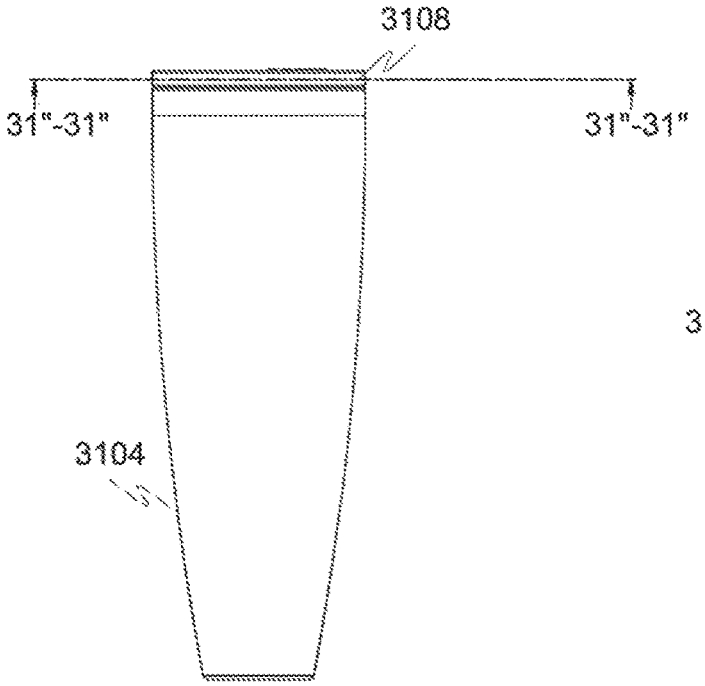
Figure 31G:
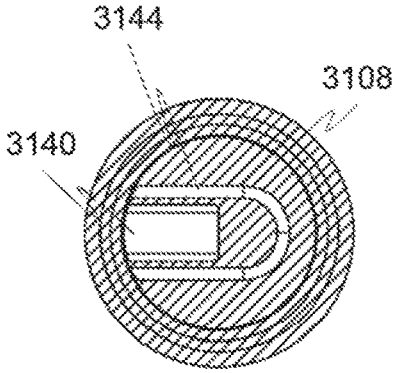

As shown in FIG. 31C, the lid rim 3108 may support an integrated measuring cup 3120 at a bottom side thereof. The measuring cup 3120 may define a secondary container volume 3124 within the primary container volume 3116. The shape or form of the measuring cup 3120 does not need to be limited to the depicted shape. Rather, the measuring cup 3120 may be any shape and size that fits within the primary container volume 3116.

In the depicted embodiment, the measuring cup 3120 has cylindrical sidewalls that taper down toward a vent 3132. As will be discussed in further detail herein, the vent 3132 allows for fluid and/or air to pass between the secondary container volume 3124 and the primary container volume 3116. The measuring cup 3120 is also shown to include a mouth 3128 at its upper portion (e.g., near or in proximity to the cap 3112). In some embodiments, the mouth 3128 corresponds to a section of the cylindrical side wall of the measuring cup 3120 that has been removed. The mouth 3128 may correspond to a second opening in the measuring cup 3120 that allows fluid to pass between the secondary container volume 3124 of the measuring cup 3120 and the primary container volume 3116. In a non-limiting example, the mouth 3128 may have a slanted profile that is wider at one end of the measuring cup 3120 sidewall and the opening of the mouth 3128 may taper toward a center point of the measuring cup 3120. Even more specifically, the mouth 3128 may taper toward the cap 3112 where is meets a main fluid channel entry 3136 in the cap 3112.

The measuring cup 3120 may use the mouth 3128 as a main fluid passageway between the primary container volume 3116 and secondary container volume 3124. Thus, as fluid is emptied from the body 3104, the mechanism for filling the secondary container volume 3124 may correspond to flipping the body 3104 of the container 3100 upside-down such that the cap 3112 is positioned below the bottom of the container body 3120. When upside-down, gravity or similar forces may cause fluid from the primary container volume 3116 to flow into the secondary container volume 3124 via the mouth 3128. As fluid enters the secondary container volume 3124 the entering fluid may displace other fluid or air previously contained in the secondary container volume 3124. The displaced fluid or air may escape the secondary container volume 3124 to the primary container volume 3116 via the vent 3132. As the container 3100 remains upside-down for a period of time, the measuring cup 3120 will become equalized and filled with as much fluid as possible from the primary container volume 3116 while air or a lighter fluid will be displaced into the primary container volume 3116. If a sufficient amount of fluid is within the body 3104, then the measuring cup 3120 will become completely filled with fluid and a corresponding volume of air or lighter fluid will enter into the primary container volume 3116. This upside-down positioning of the container 3100 may correspond to a resting or storage positioning such that the measuring cup 3120 fills with a predetermined amount of liquid from the primary container volume 3116.

When the container 3100 is taken out of its storage position (e.g., the upside-down positioning), the user may flip the container 3100 back over such that the primary container volume 3116 is positioned below the secondary container volume 3124. This may cause some liquid to flow out of the secondary container volume via the mouth 3128. Additionally, a significantly smaller amount of liquid (e.g., 10 times less) may flow much slower out of the vent 3132. Yet, if the size of the vent 3132 is selected properly, then only a minor and insignificant amount of liquid will flow from the vent 3132 (e.g., the size of the vent should be selected based on viscosity of the liquid in the container to prevent a stream flow of liquid from the vent 3132). However, the vent 3132 is still large enough in diameter to allow air or a lighter/less viscous fluid to flow out of the vent 3132 when the container 3100 is positioned upside-down.

Figure 32A:
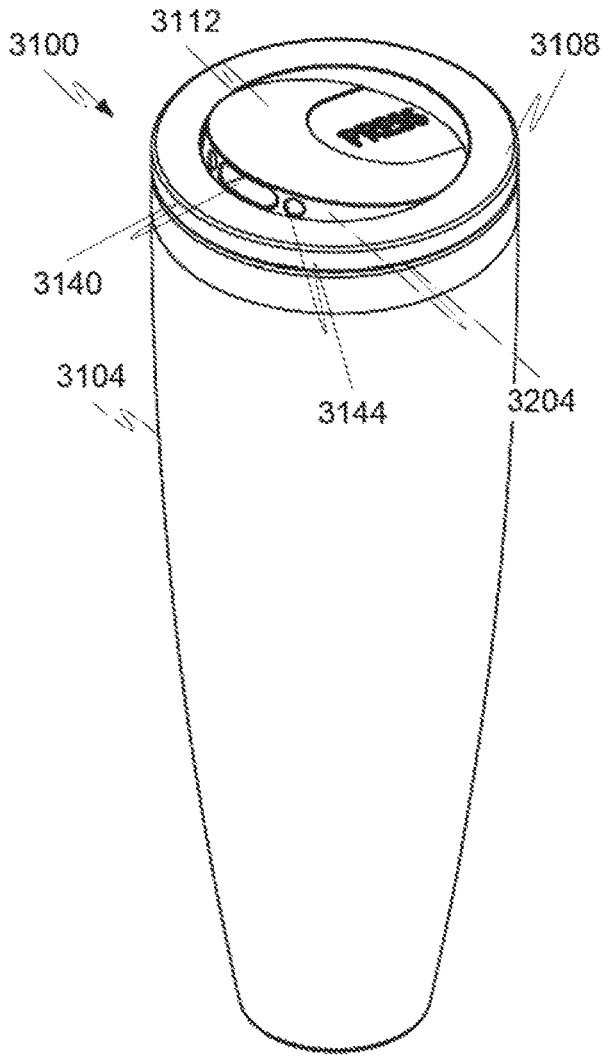
Figure 32C:
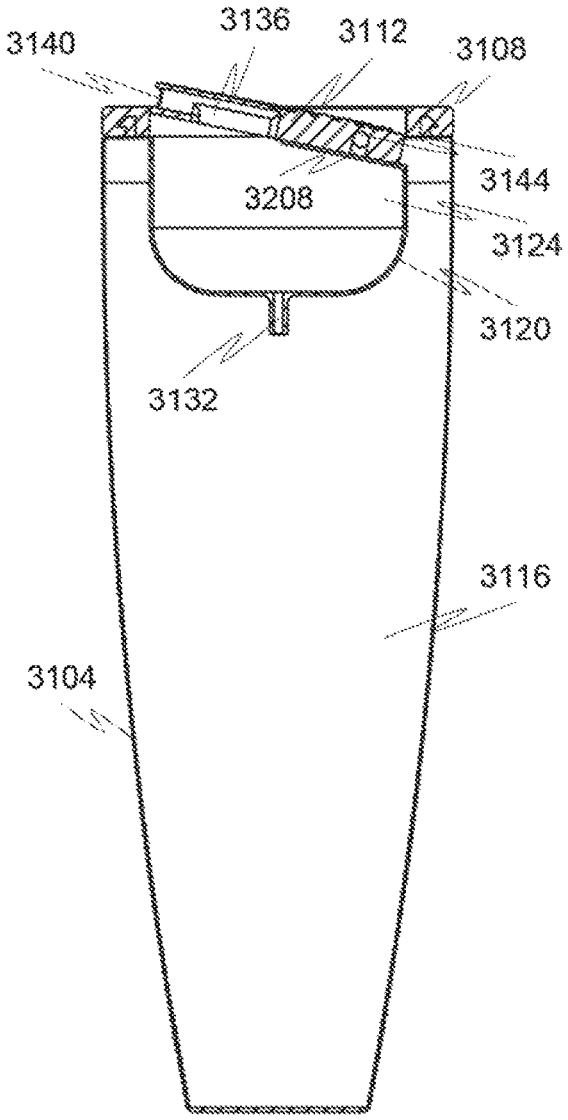
Figure 32B:
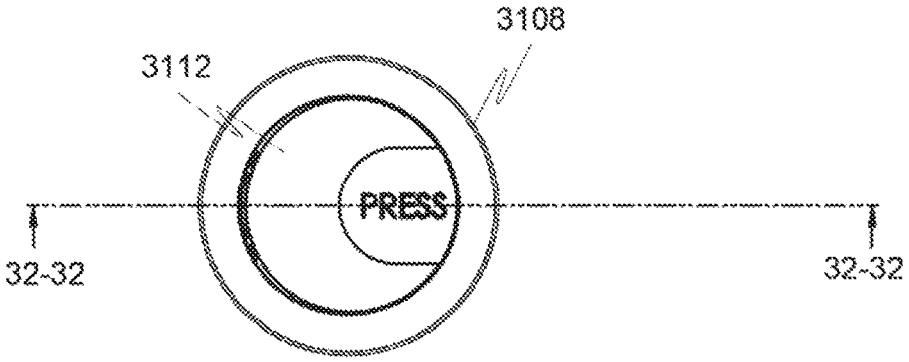
Figure 33A:
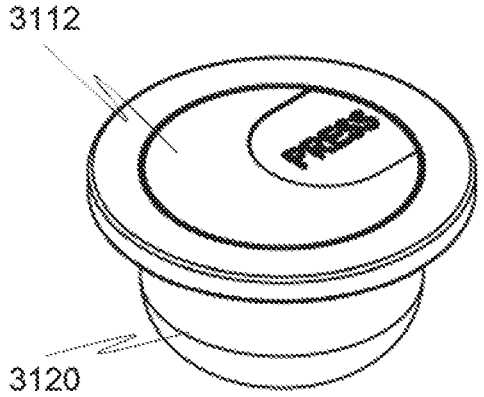
Figure 33B:
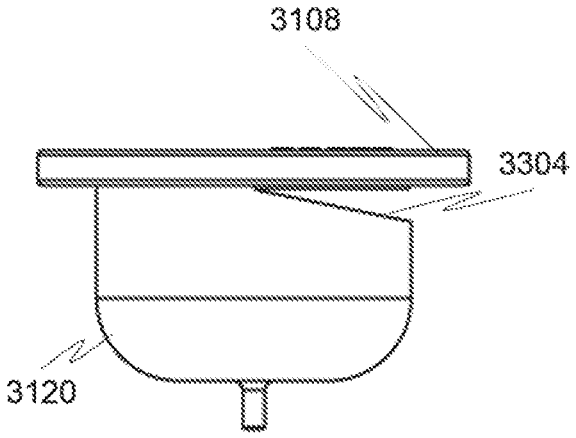
Figure 33C:
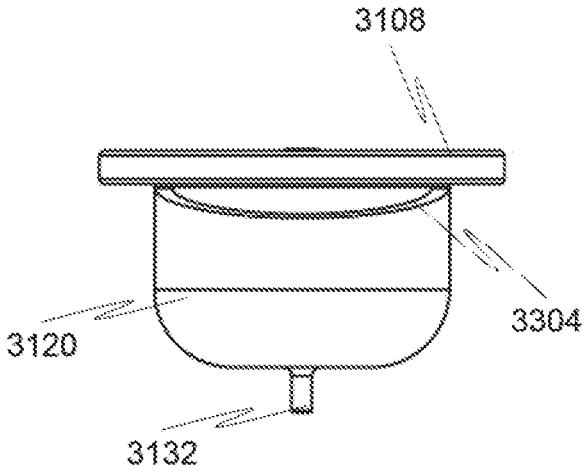
Figure 33D:
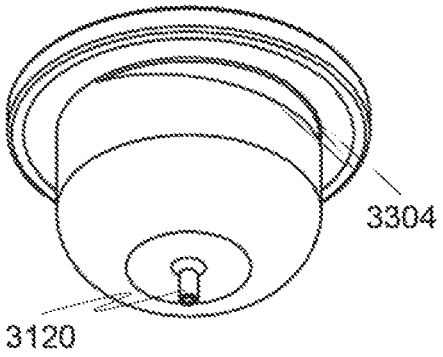

As can be seen in FIGS. 32A-C, the cap 3112 can be moved between a first (closed) position and a second (opened) position. In most scenarios, the cap 3112 is closed when the container 3100 is upside-down and in a storage position so that fluid does not escape. On the other hand, when an amount of fluid is desired from the container 3100, the cap 3112 may be moved to an opened position, thereby exposing a main fluid channel 3140 to the outside environment. This also completes the fluid pathway from the secondary container volume 3124 to the outside environment (via the main fluid channel entry 3136 and main fluid channel 3140).

In the depicted embodiment, the cap 3112 is shown to include a cap side edge 3204 that exposes the main fluid channel 3140 as well as an air inlet tube 3144. As will be discussed in further detail herein, the main fluid channel 3140 may provide the pathway for fluid to flow from the secondary container volume 3124 out of the container 3100. Meanwhile, the air inlet tube 3144 may provide an air pathway for air to flow back into the secondary container volume 3124, thereby equalizing the pressure in the secondary container volume 3124 as fluid flows from the secondary container volume 3124. As discussed in connection with other embodiments, the air inlet tube 3144 effectively prevents glugging of the fluid flowing from the main fluid channel 3140. Although two air inlet tube 3144 entry points are shown in the depicted embodiments, it should be appreciated that the air inlet tube 3144 may have one, two, three, four, or more entry points exposed via the cap side edge 3204.

The depicted embodiment also shows the exposed main fluid channel 3140 and air inlet tubes 3144 as being positioned on the cap side edge 3204 that opposes the mouth 3128. This can provide several benefits. First, when the cap 3112 is moved to its opened position, the mouth 3128 may be formed such that the mouth 3128 becomes sealed or closed by the cap 3112. Secondly, the placement of the mouth 3128 opposite the exposed ends of the main fluid channel 3140 and air inlet tubes 3144 helps to enforce a directional pouring away from the mouth 3128. Thus, embodiments of the present disclosure effectively create a container 3100 that can self-measure an amount of fluid by containing a certain amount of fluid in the measuring cup 3120 and then by effectively sealing off the measuring cup 3120 from the primary container volume 3116 when the cap 3112 is in an opened positioned (e.g., by sealing the mouth 3128). This means that the container 3100 can again be inverted for pouring (as opposed to being inverted with the cap 3112 closed, which causes the secondary container volume 3124 to fill with fluid from the primary container volume 3116). When inverted for pouring, only the fluid contained in the secondary container volume 3124 will flow out of the main fluid channel 3140. Meanwhile, air will enter the secondary container volume 3124 via the air inlet tube 3144. The pouring of fluid will continue until such time as the secondary container volume 3124 is emptied. While a minimal but insignificant amount of fluid may try to enter the secondary container volume 3124 via the vent 3124, the vent 3124 may be sized to have a cross-sectional area that is at least ten times smaller than the opening of the main fluid channel 3140 (e.g., a diameter of no more than 4 mm) to ensure that a steady flow of fluid out of the measuring cup 3120 via the vent 3124 is prevented. Accordingly, a measured amount of fluid can be poured by the container 3100. Once the measured amount of fluid is poured out of the container 3100, the cap 3112 can be closed and the container 3100 can be placed back into a storage (e.g., upside-down) position. Initially, when in the storage position, the fluid from the primary container volume 3116 will flow into the secondary container volume 3124 via the mouth 3128, which is again opened due to the closure of cap 3112. Fluid will flow into the secondary container volume 3124 until it is filled with a measured amount of fluid or until so little fluid remains in the primary container volume 3116 that the secondary container volume 3124 cannot be filled.

As shown, the thickness of the cap 3112 and the size of the mouth 3128 may be selected to work in cooperation with one another. Specifically, the thickness of the cap 3112 may be at least the size of the largest opening in the mouth 3128 and, in some embodiments, the thickness of the cap 3112 may be at least 2-5 mm thicker than the largest opening in the mouth 3128. This enables the cap 3112 to effectively seal or close the mouth 3128 when the cap 3112 is in an opened position. Furthermore, the cap 3112 is shown to pivot across its center of mass and down toward the mouth 3128.

With reference now to FIGS. 33A-35D additional details of the cap 3112 and measuring cup 3120 will be described in accordance with at least some embodiments of the present disclosure. As discussed above, the cap 3112 may be pivotally connected to the measuring cup 3120 and within the lid rim 3108. The lid rim 3108 is shown to have the largest diameter and, in some embodiments, the cap 3112 may have a similar or identical diameter to the diameter of the cylindrical portion of the measuring cup 3120. The mouth 3128 is shown to be formed in the measuring cup 3120 by removing a section of the cylindrical portion of the measuring cup 3120. The mouth 3128 is shown to have a mouth edge 3304 along its edge. In some embodiments, the mouth edge 3304 provides a resting or stop location for the cap 3112 when the cap 3112 is placed into an opened position. Specifically, when the cap 3112 is rotated/pivoted open, the bottom face of the cap 3112 may rest against the mouth edge 3304, but seal the mouth 3128. This seal effectively prevents fluid from flowing between the secondary container volume 3124 and primary container volume 3116, at least for a time since the only remaining pathway will correspond to the vent 3132, which is significantly smaller than the mouth 3128 and does not allow a continuous stream of fluid to flow therethrough.

Figure 34:
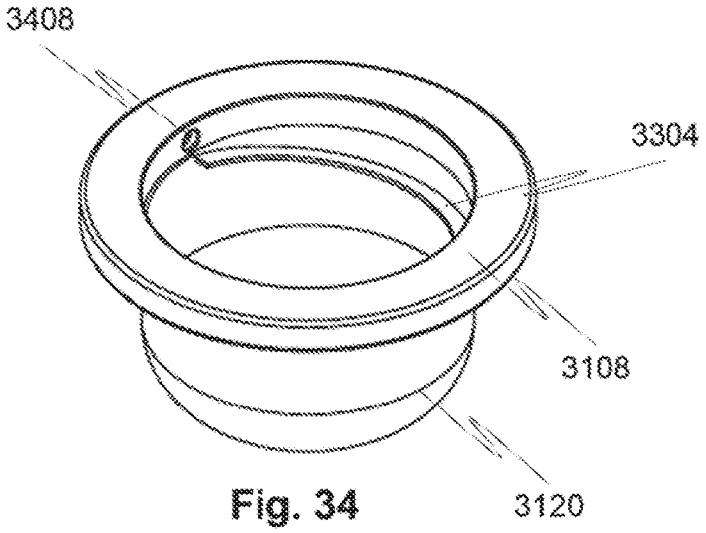
Figure 35A:
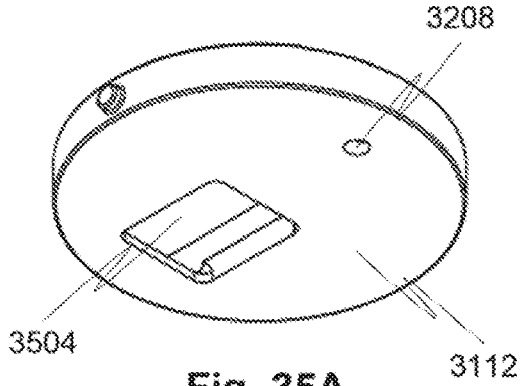
Figure 35B:
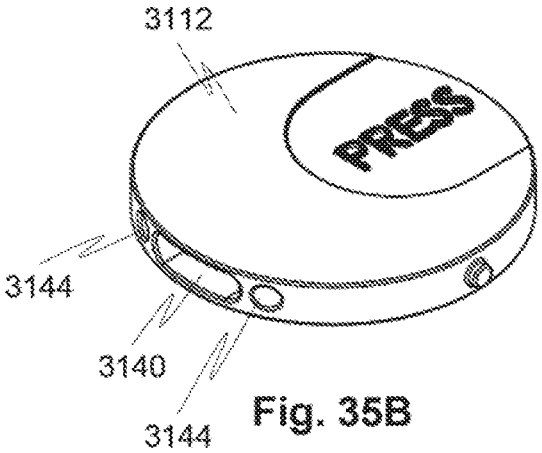
Figure 35C:
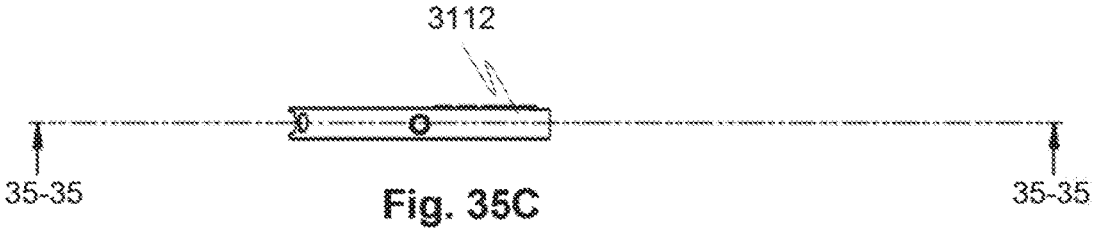
Figure 35D:
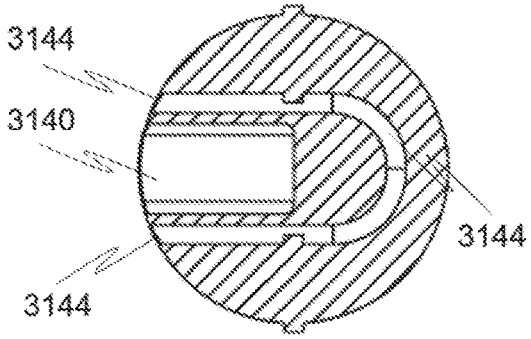
Figure 36A:
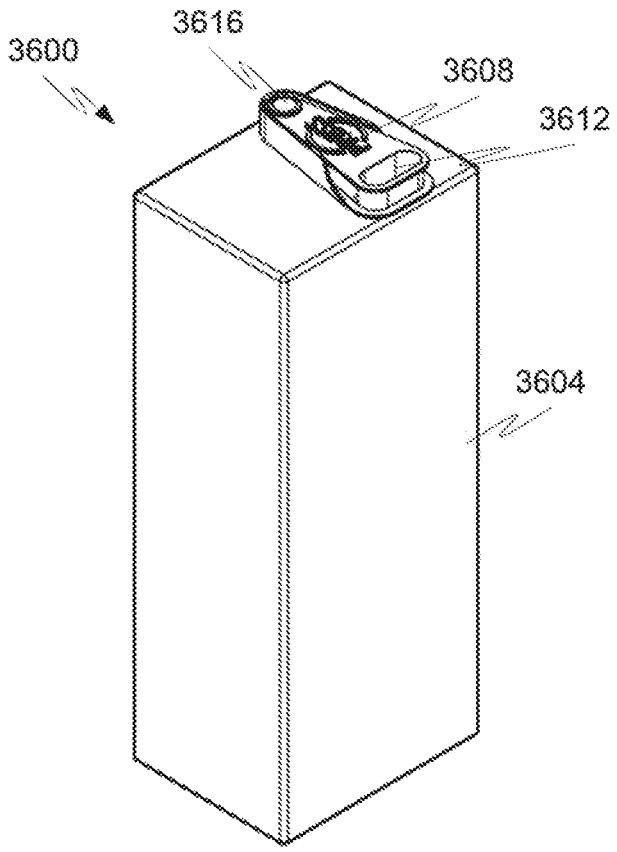
FIGS. 36A-37C depict another example of a breathable container in accordance with embodiments of the present disclosure.
Figure 36C:
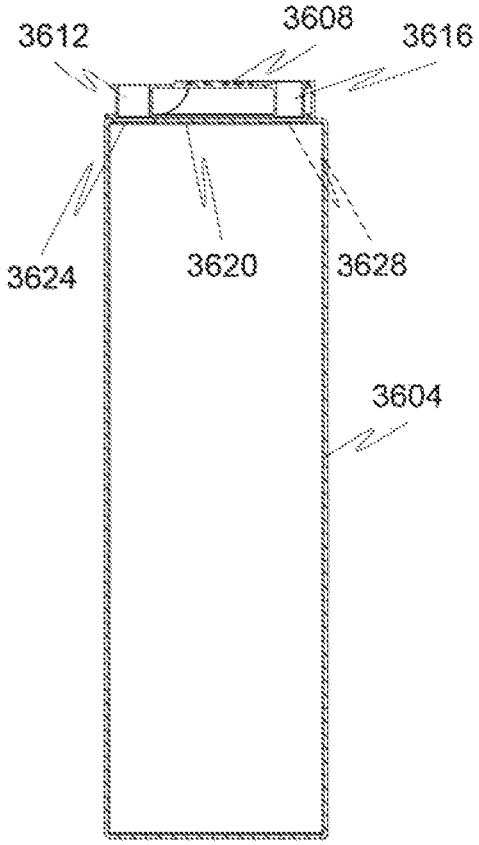
Figure 36B:
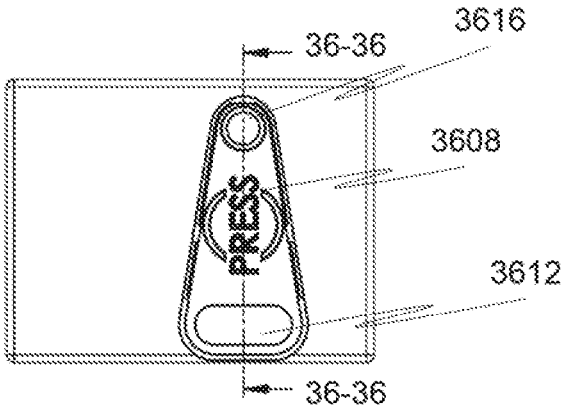

FIG. 34 shows additional detail of the mouth edge 3304 and how the mouth edge 3304 has a thickness that is at least as thigh as the walls of the measuring cup 3120. In some embodiments, the mouth edge 3304 may further extend into the measuring cup 3120 so as to provide an expanded lip on which the cap 3112 can rest. It can also be seen that the mouth edge 3304 is slanted toward the pivot feature 3408 provided in the measuring cup 3120. The pivot feature 3408 may correspond to a pin or hole for a pin that interfaces with a corresponding feature on the cap 3112.

FIGS. 35A-D depict additional details of the cap 3112 and show an illustrative construction of the main fluid channel 3140 and air inlet tube 3144 within the cap 3112. In the depicted embodiment, both the main fluid channel 3140 and air inlet tube 3144 are exposed at the cap side edge 3204. These pathways then extend parallel to the top surface of the cap 3112 through at least the first quarter length of the cap 3112. The two pathways are then exposed at the bottom surface of the cap 3112 by a hole in the bottom surface 3504 for the main fluid channel 3140 and by an air tube entry 3208. The air tube entry 3208 corresponds to a single point where the air inlet tube 3144 comes into fluid communication with the secondary container volume 3124. There are embodiments that envision multiple air tube entries 3208 rather than a single air tube entry 3208 since there is the possibility of multiple air inlet tubes 3144 extending through the cap 3112. Alternatively, it may be possible to have a single air inlet tube 3144 exposed at the cap side edge 3204 and that single air inlet tube 3144 may be exposed at the bottom of the cap 3112 by a single air tube entry 3208. In the depicted embodiment, the hole 3504 is nearer the cap side edge 3204 that exposes the main fluid channel 3140 as compared to the air tube entry 3208. With the directional pouring enforced by the pivoting of the cap 3112, this causes the fluid in the secondary container volume 3124 to first encounter the hole 3504 and flow out of the main fluid channel 3140. As the fluid begins flowing out of the main fluid channel 3140, air begins to flow into the air inlet tube(s) 3144 because the air tube entry 3208 is not yet carrying fluid in the other direction (e.g., out of the secondary container volume 3124). In some embodiments, it is also desirable to configure the hole 3504 to have a cross-sectional area that is substantially larger than the air tube entry 3208 (e.g., at least five or ten times larger). This may also coerce fluid to flow out of the main fluid channel 3140 first, thereby causing air to flow through the air inlet tubes 3144 first. Once both flows are induced, it is unlikely that fluid will be able to flow out of the air inlet tubes 3144 due to the air flowing through the air inlet tubes 3144 in the opposite direction (e.g., into the secondary container volume 3124).

With reference now to FIGS. 36A-37C, another container 3600 will be described in accordance with at least some embodiments of the present disclosure. The container 3600 is shown to include a container body 3604 having a body top face 3620 on which a depressible tab 3608 is provided. The container body 3604 may be constructed of any suitable material such as a plastic (e.g., polyethylene), metal (e.g., aluminum), paper board, wood pulp, or a combination of such materials in composite or layered laminate form. Any known type of manufacturing process may be used to fold or otherwise form the body 3604 from a sheet of material or laminated materials.

In the depicted embodiment, the depressible tab 3608 is provided with a main fluid channel 3612 and an air inlet 3616. The length of the main fluid channel 3612 and air inlet 3616 may be substantially similar or identical. The main fluid channel 3612 may be provided with a first end 3708 and second end 3712 that are connected by a substantially straight tube of material. The air inlet 3616 may also include a first end 3716 and second end 3720 that are connected by a substantially straight tube of material. The distance between the first end 3708 and second end 3712 of the main fluid channel 3612 may be substantially similar to the distance between the first end 3716 and second end 3720 of the air inlet 3616.

Prior to being pressed into the body top face 3620, the first ends 3708, 3716 may rest or sit above the body top face 3620. In some embodiments, the first ends 3708, 3716 sit atop a first foil patch 3624 and second foil patch 3628, respectively. The first and second foil patches may correspond to any patch of material that hermetically seals the container volume of the body 3604 until such time as the depressible tab 3608 is pressed downward, thereby causing the ends 3708, 3716 to break the patches 3624, 3628, respectively. It may be possible to utilize a single patch rather than two distinct patches 3624, 3628, but the distinct patches help to ensure that inadvertent breaking does not occur until the tab 3608 is purposefully and with an appropriate amount of force pushed into the body top face 3620.

In the depressed position, the first ends 3708, 3716 extend into the container volume of the body 3604. At this point, fluid may be poured from the container 3600 by tilting the body 3604. In some embodiments, the main fluid channel 3612 has a larger cross-sectional area than the air inlet 3616. As such, a user may benefit from pouring/tilting the container 3600 such that fluid encounters the main fluid channel 3612 first (e.g., by tipping the main fluid channel 3612 below the air inlet 3616). Once the flow of fluid begins out of the main fluid channel 3612, air will begin flowing into the container body 3604 via the air inlet 3616, thereby equalizing pressure during pouring and substantially avoiding glugging during the pour of material.

Figure 37A:
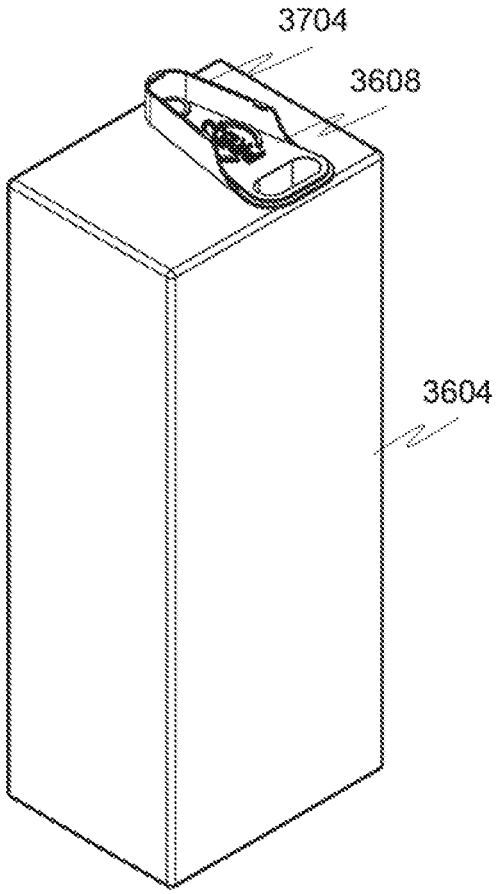
Figure 37C:
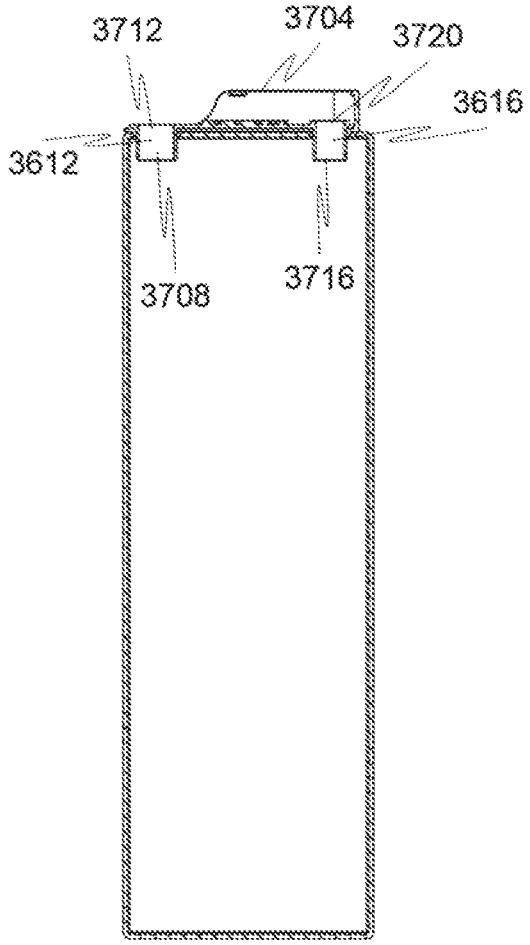
Figure 37B:
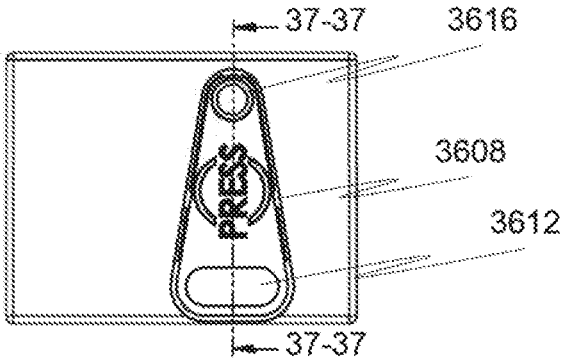
Figure 38A:
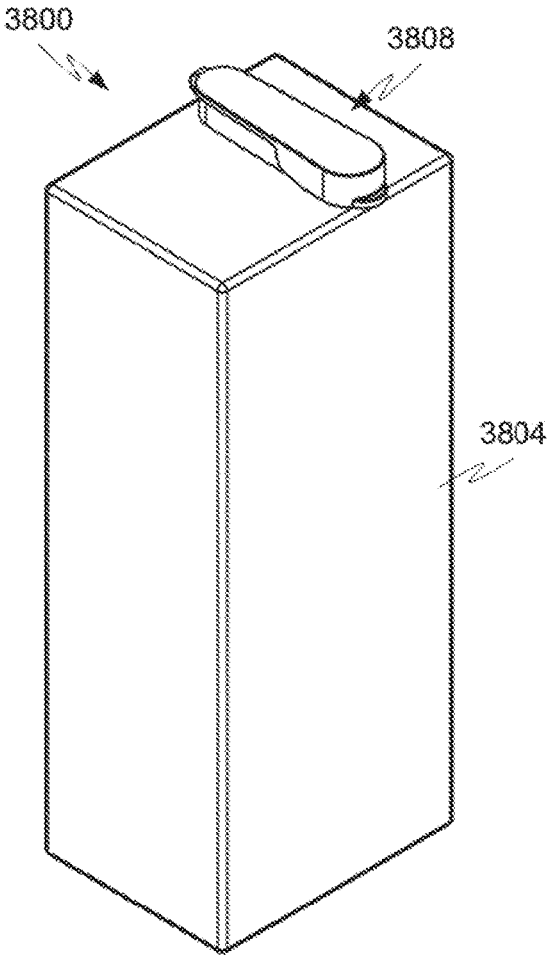
FIGS. 38A-40C depict another example of a breathable container in accordance with embodiments of the present disclosure.
Figure 38C:
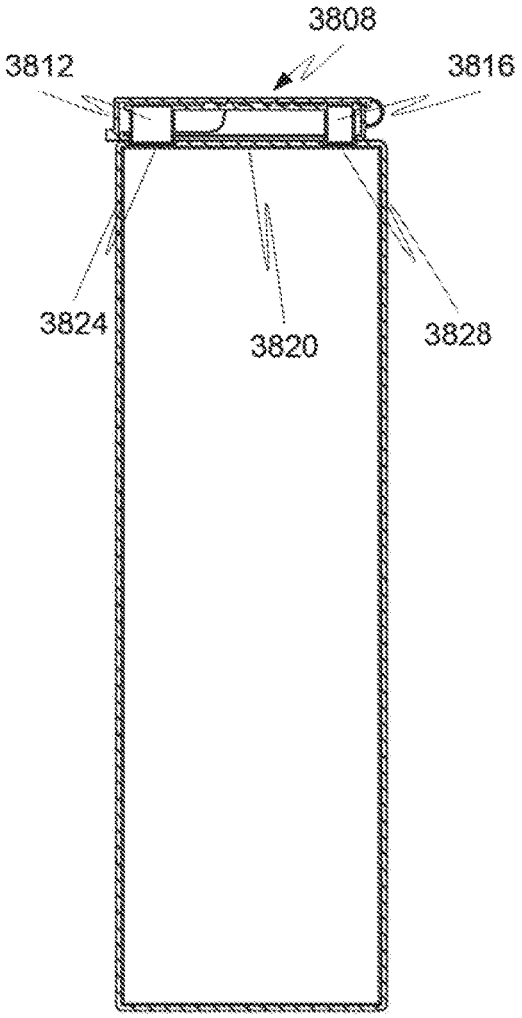
Figure 38B:
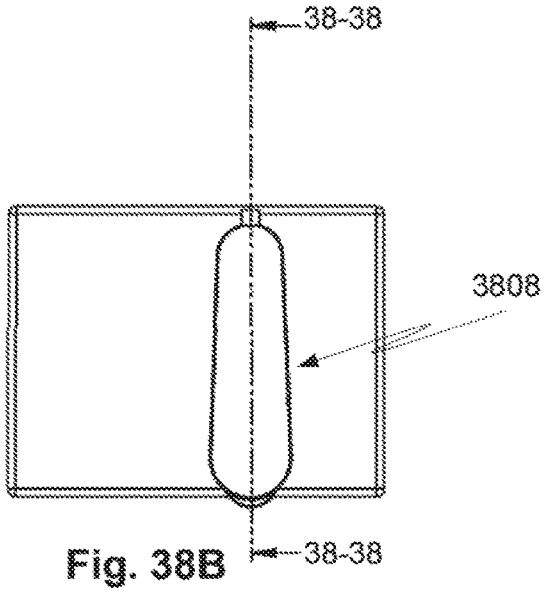
Figure 39A:
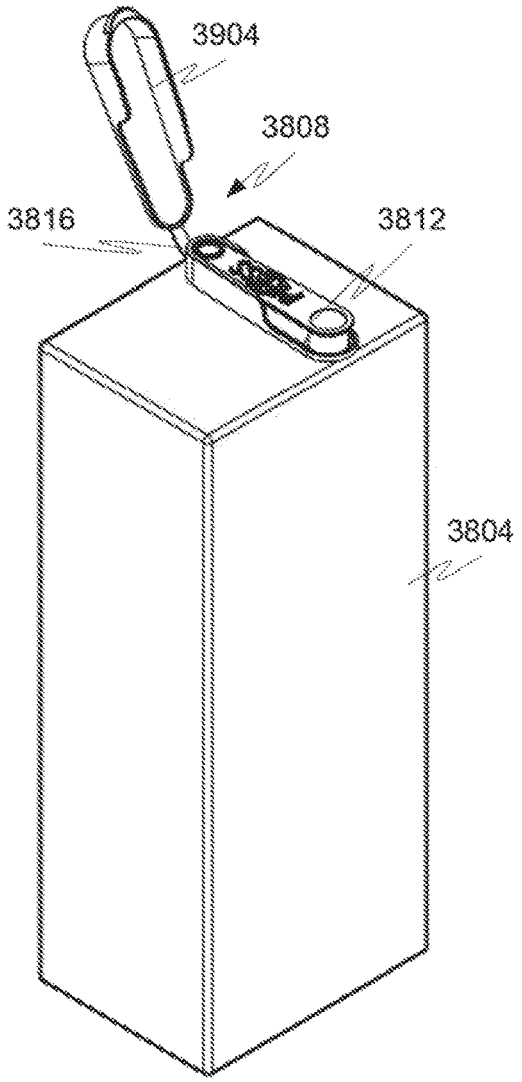
Figure 39C:
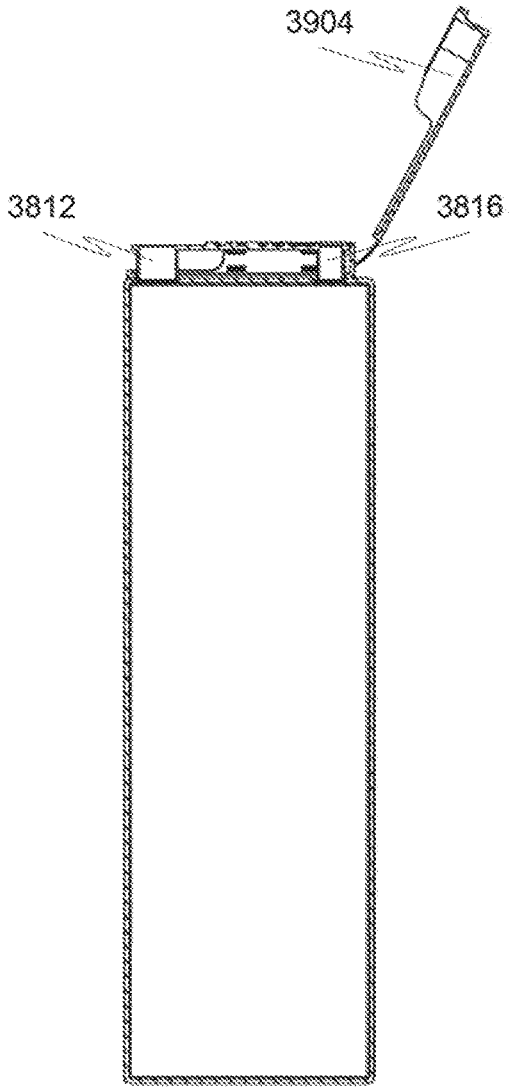
Figure 39B:
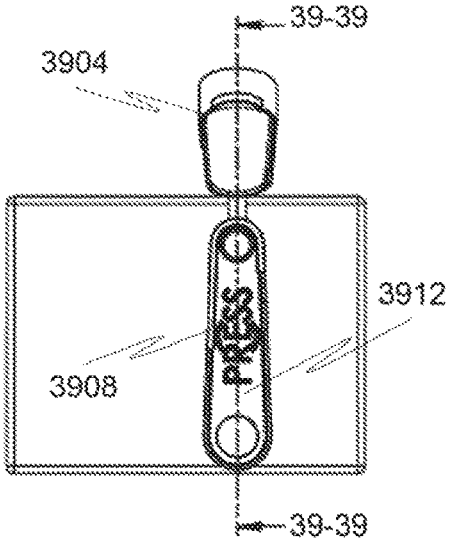
Figure 40A:
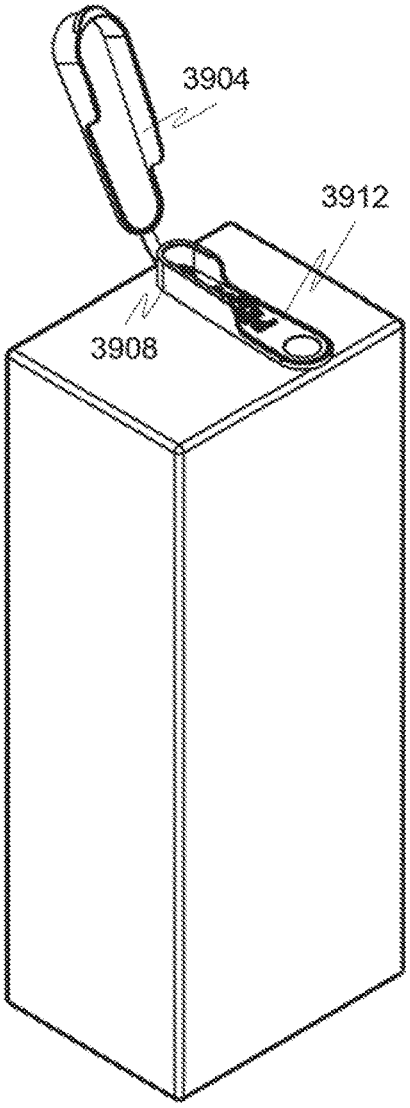
Figure 40C:
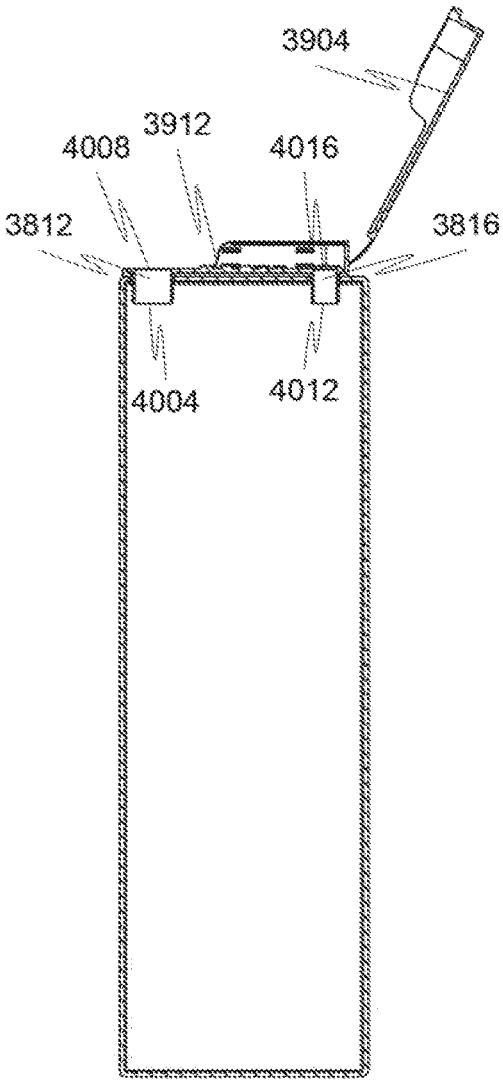
Figure 40B:
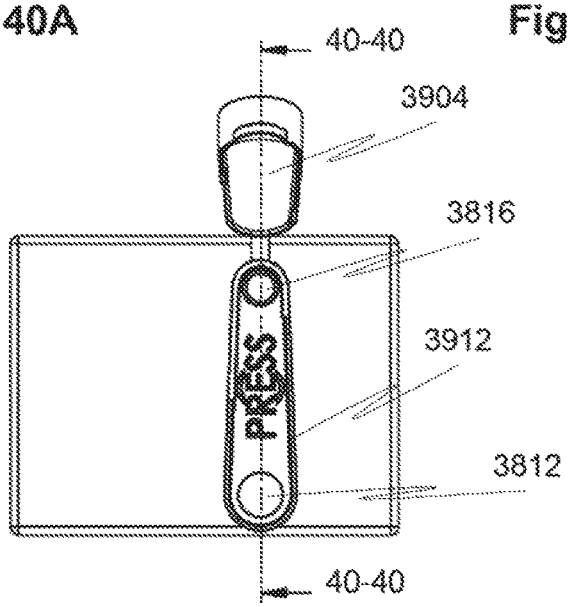
Figure 41A:
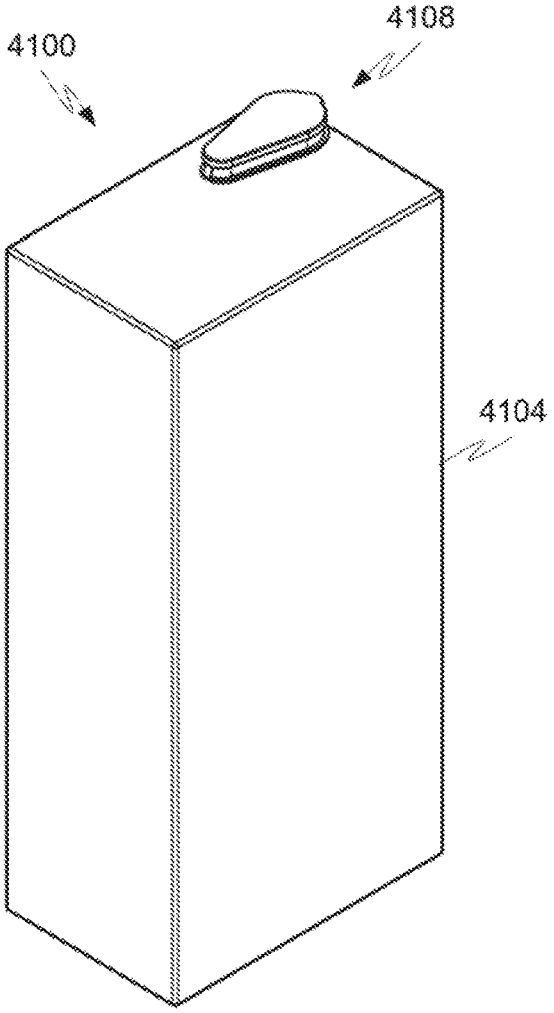
FIGS. 41A-43D depict another example of a breathable container in accordance with embodiments of the present disclosure.
Figure 41C:
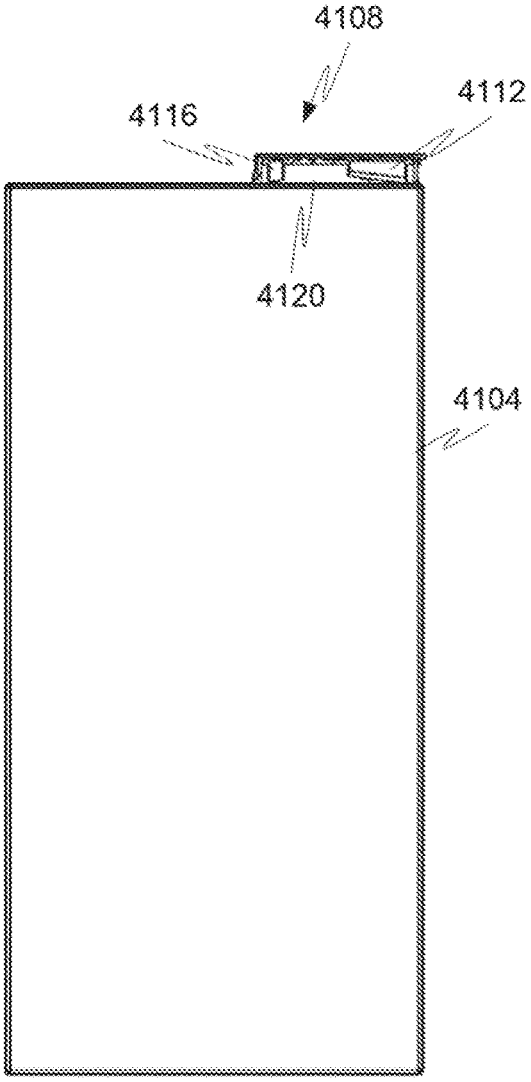
Figure 41B:
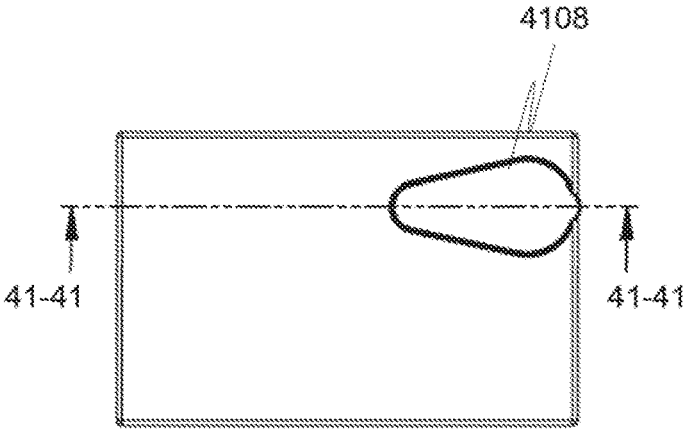
Figure 42A:
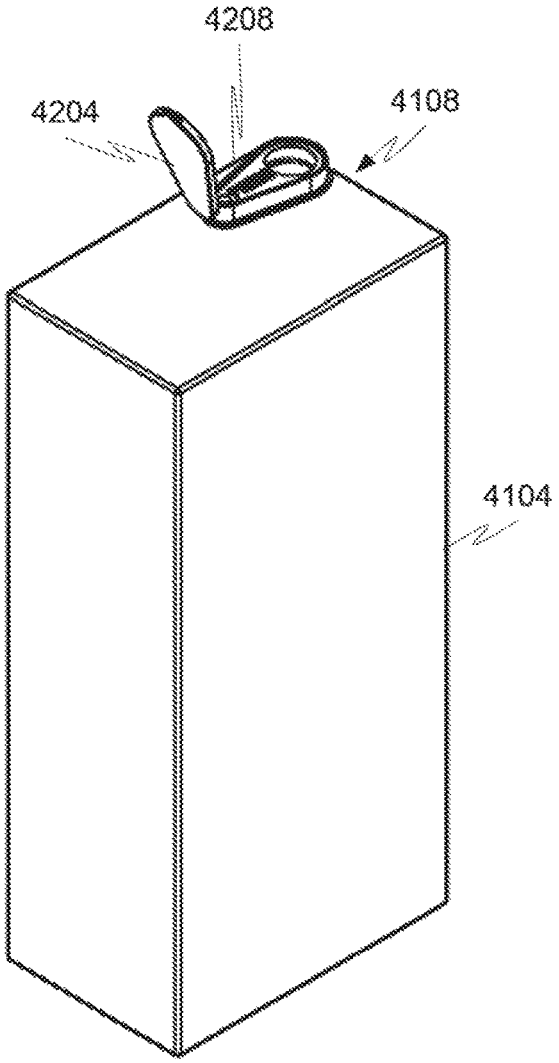
Figure 42C:
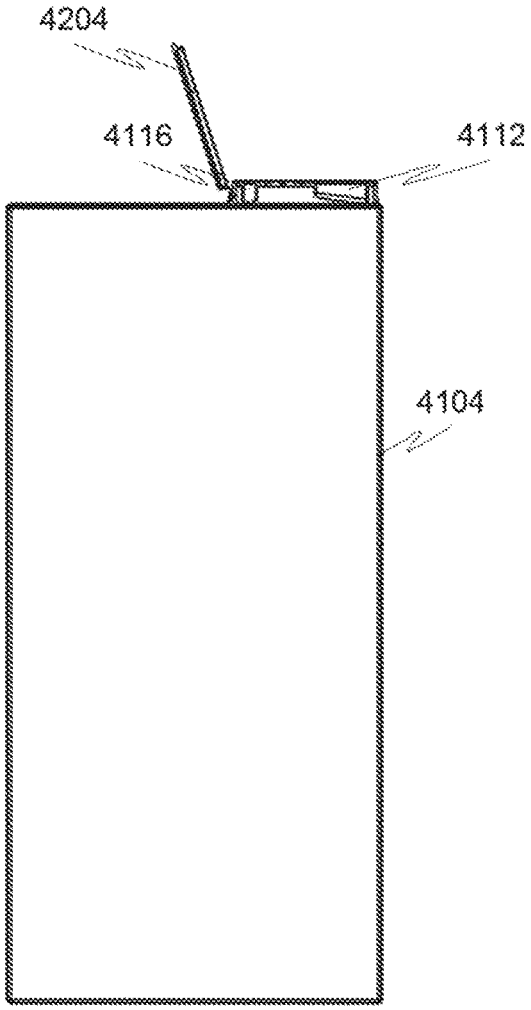
Figure 42B:
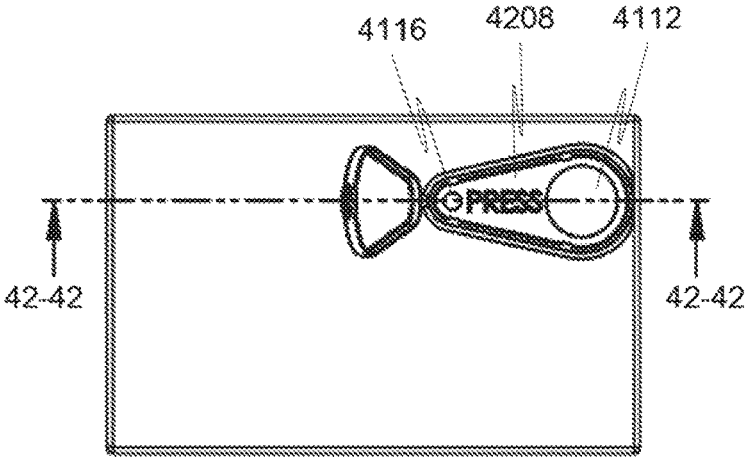

FIGS. 37A and 37C also show that in the depressed state, a protective rim 3704 becomes exposed (e.g., the depressible tab 3608 is pressed below a top of the protective rim 3704. In some embodiments, the protective rim 3704 serves to prevent an inadvertent depression of the depressible tab 3608. The rim 3704 may be configured to have a higher profile near the air inlet 3616 but a lower or non-existent profile near the main fluid channel 3612 to facilitate direct drinking from the container 3600.

FIGS. 38A-40C depict another variation of a container 3800 in accordance with at least some embodiments of the present disclosure. The container 3800 is similar to container 3600 in that container 3800 includes a body 3804 (which may be made of similar or identical material to body 3604) and a depressible tab 3912 positioned in proximity to a body top face 3820. Container 3800 differs from container 3600, however, in that container 3800 further includes a protective cap 3808. The protective cap 3808 is used to further seal or protect the main fluid channel 3812 and air inlet 3816 when closed.

When opened, the protective cap 3808 exposes the tab 3912 for depression. Upon being depressed, a rim 3908 is also exposed above the now-depressed tab 3912. The rim 3908 may be similar to rim 3704 except that rim 3908 may also have one or more features for interfacing and temporarily holding the lid 3904 in place. For instance, a friction fit feature may be provided on the rim 3908 and a corresponding feature may be provided on the lid 3904 to help maintain the lid 3904 in a closed position until it is pushed upward by a user.

The main fluid channel 3812 and air inlet 3816 may also be similar to the main fluid channel 3612 and air inlet 3616, respectively, in that both elements include first and second ends 4004/4008 and 4012/4016. Again, the first ends 4004, 4012 may be configured to set atop foil patches 3624, 3628 until the tab 3912 is pressed downward, thereby causing the ends 4004, 4012 to tear or break the foil patches 3624, 3628.

With reference now to FIGS. 41A-43D yet another container 4100 will be described in accordance with at least some embodiments of the present disclosure. The container 4100 is similar to container 3600, 3800 in that the container 4100 includes a cap 4108 that includes a lid 4204 and depressible tab 4208. The depressible tab 4208 may be contained within a rim 4304 and the rim 4304 may be configured to engage with the lid 4204.

The rim 4304 in this embodiment is shown to completely encircle the tab 4208. When not depressed, the top of the tab 4208 may be in relative proximity to the top of the rim 4304. However, when depressed, the rim 4304 may provide a surface from which fluid in the container 4100 can be consumed directly (e.g., as a juice box, milk carton, etc.).

This particular embodiment may also differ from containers 3600, 3800 in that the body top surface 4120 only has a single foil patch as compared to multiple discrete patches. In this configuration it may be useful to shape the main fluid channel 4112 and air inlet 4116 such that they independently cut the single foil patch in two discrete locations, rather than simply breaking the foil patch and creating a single pathway between the container volume and the external environment. Thus, the depressible tab 4208 is shown to have the main fluid channel 4112 and air inlet 4116 designed with a slight slant or tilted profile at their respective first ends 4304, 4312. The first ends 4304, 4312 may be configured to cut two distinct holes into a single foil patch provided at the body top face 4120. The configuration of the second ends 4308, 4316 may be similar to other embodiments already described herein. Of course, the container 4100 may be provided with two discrete foil patches if desired rather than using a single patch.

Figure 43A:
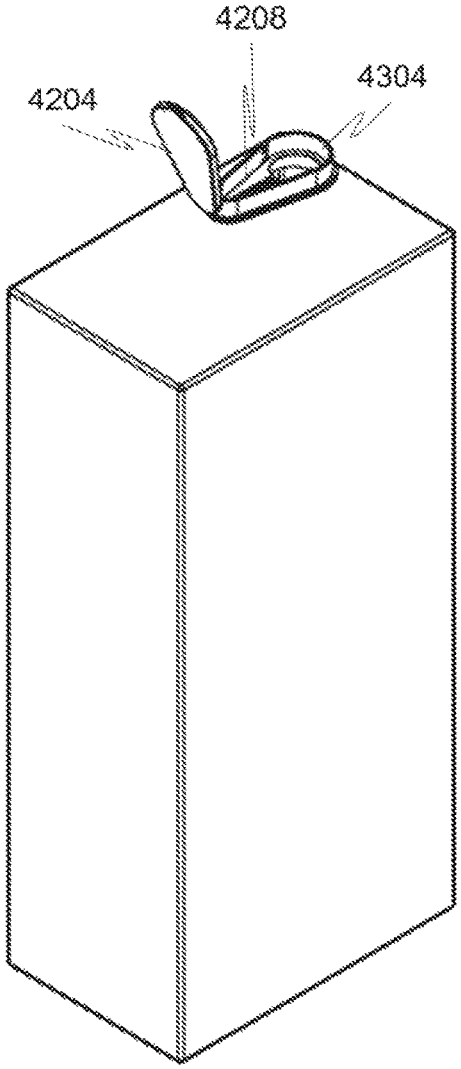
Figure 43C:
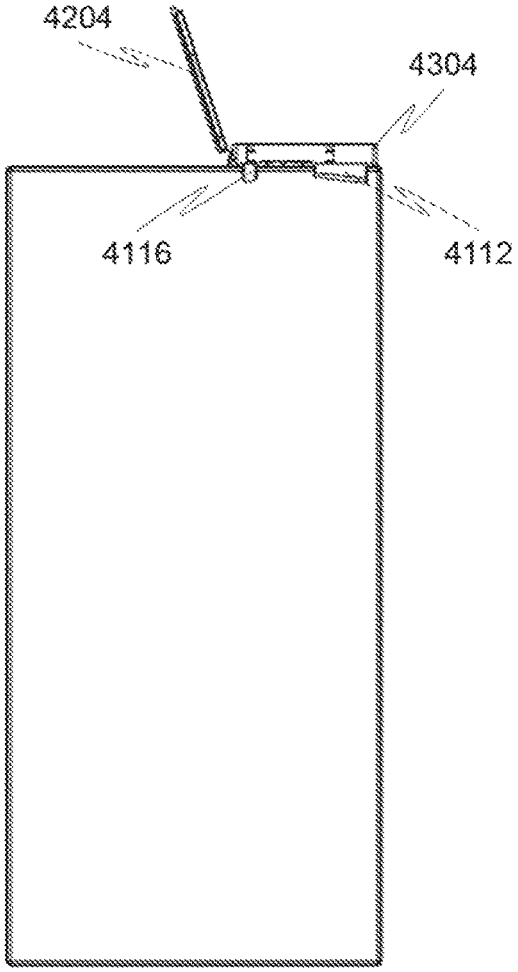
Figure 43B:
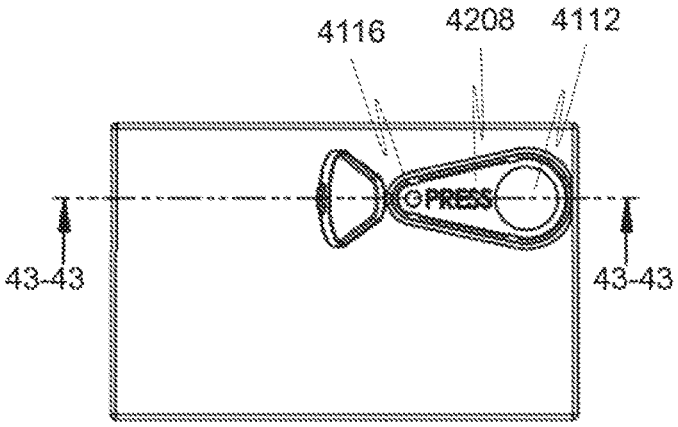
Figure 43D:
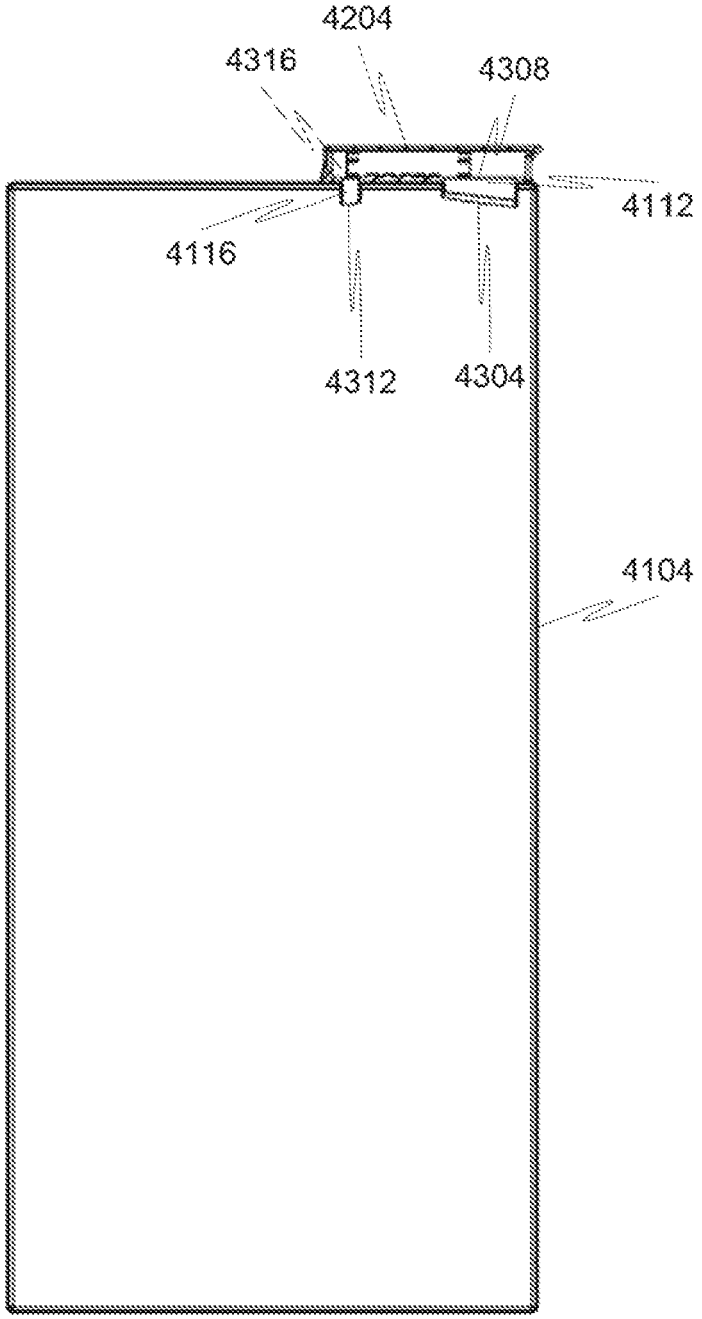
Figure 44:
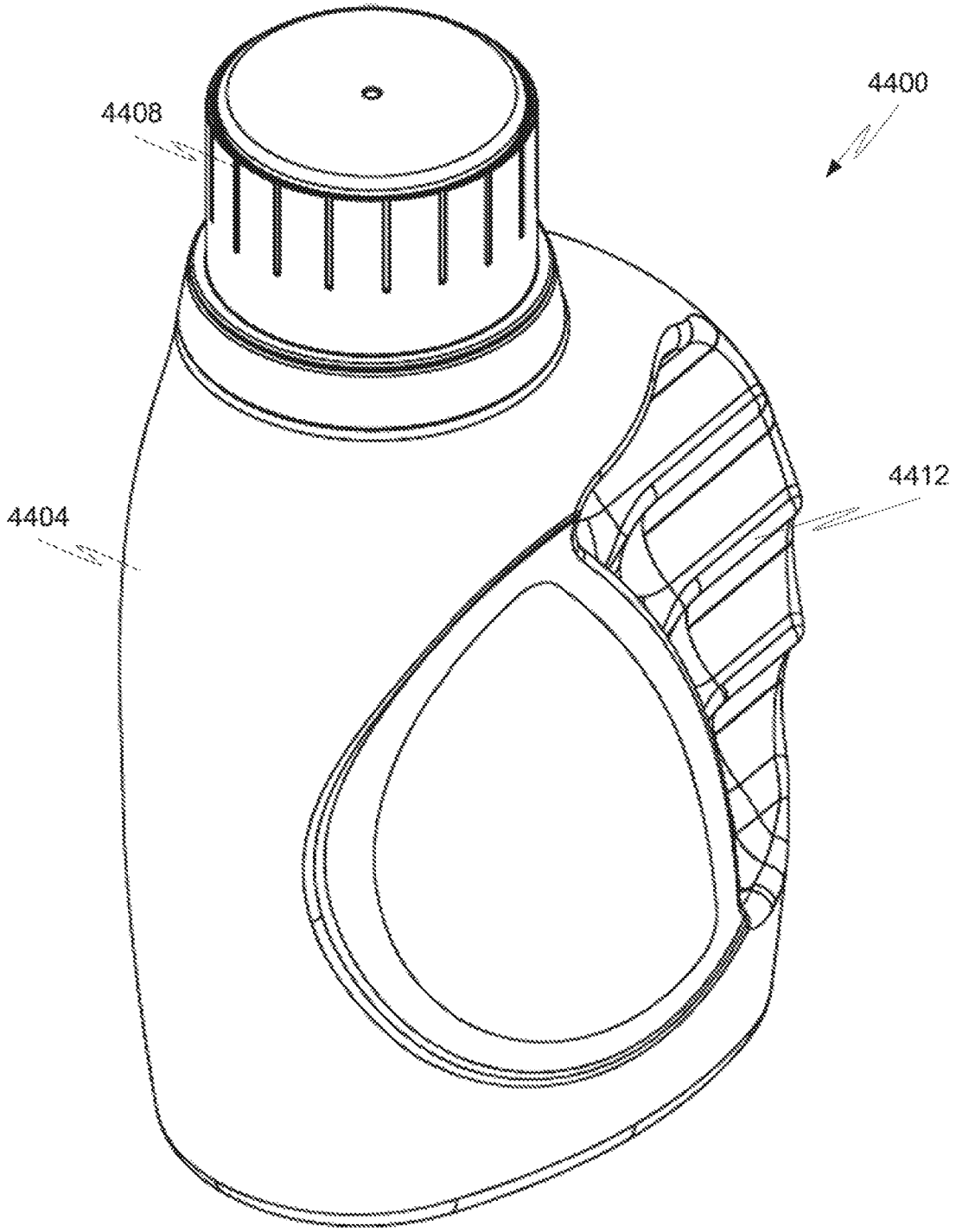
FIG. 44 is an isometric view of an illustrative container according to embodiments of the present disclosure.

This particular embodiment of container 4100 may also be useful in that the rim 4304 can seal with the lid 4204, at least partially, so that a fluid does not spill from the container body 4104 inadvertently. This is particularly useful for a direct-drink applications or pourable applications where not all of the fluid within the container body 4104 is consumed in a single setting. Thus, as seen in FIG. 43D, the lid 4204 may be closed back over the rim 4304 with the tab 4208 remaining in a depressed state. Fluid may splash out of the primary volume of the container body 4104, but the lid 4204 in cooperation with the rim 4304 may prevent fluid from further spilling outside the cap 4108.

As provided above, one or more embodiments of the present disclosure include a pressure equalizer insert for placement in a container to allow a liquid to be poured from the container while at the same time substantially equalizing air pressure within the container with atmospheric air pressure. As a result, the liquid can be poured from the container without the typical glugging phenomena that generally accompanies pouring liquid from a container that does not possess the pressure equalizer. One or more additional embodiments include containers having container necks with the pressure equalizer device integrally formed within the container during manufacture of the container. For example, a plastic container, carton, or jug can be manufactured with the pressure equalizer device integrally formed in the container neck of the container, top of the carton, or neck of the jug when the container, carton, or jug is produced.

Referring now to FIGS. 44-48C, various embodiments of a container 4400 and elements thereof will be described in accordance with at least some embodiments of the present disclosure. The container 4400 is shown to include a main body 4404 configured to contain liquid. The main body portion 4404 may or may not include a handle 4412 that facilitates a directional pouring of liquid from the main body portion 4404. A cap 4408 may also be provided to contain liquid in the main body portion 4404 unless and until the cap 4408 is removed therefrom. As can be appreciated, the main body portion 4404 does not require a handle 4412 or any other element that facilitates directional pouring of liquid therefrom. Rather, the main body portion 4404 may be symmetrical without departing from the scope of the present disclosure.

Figure 45:
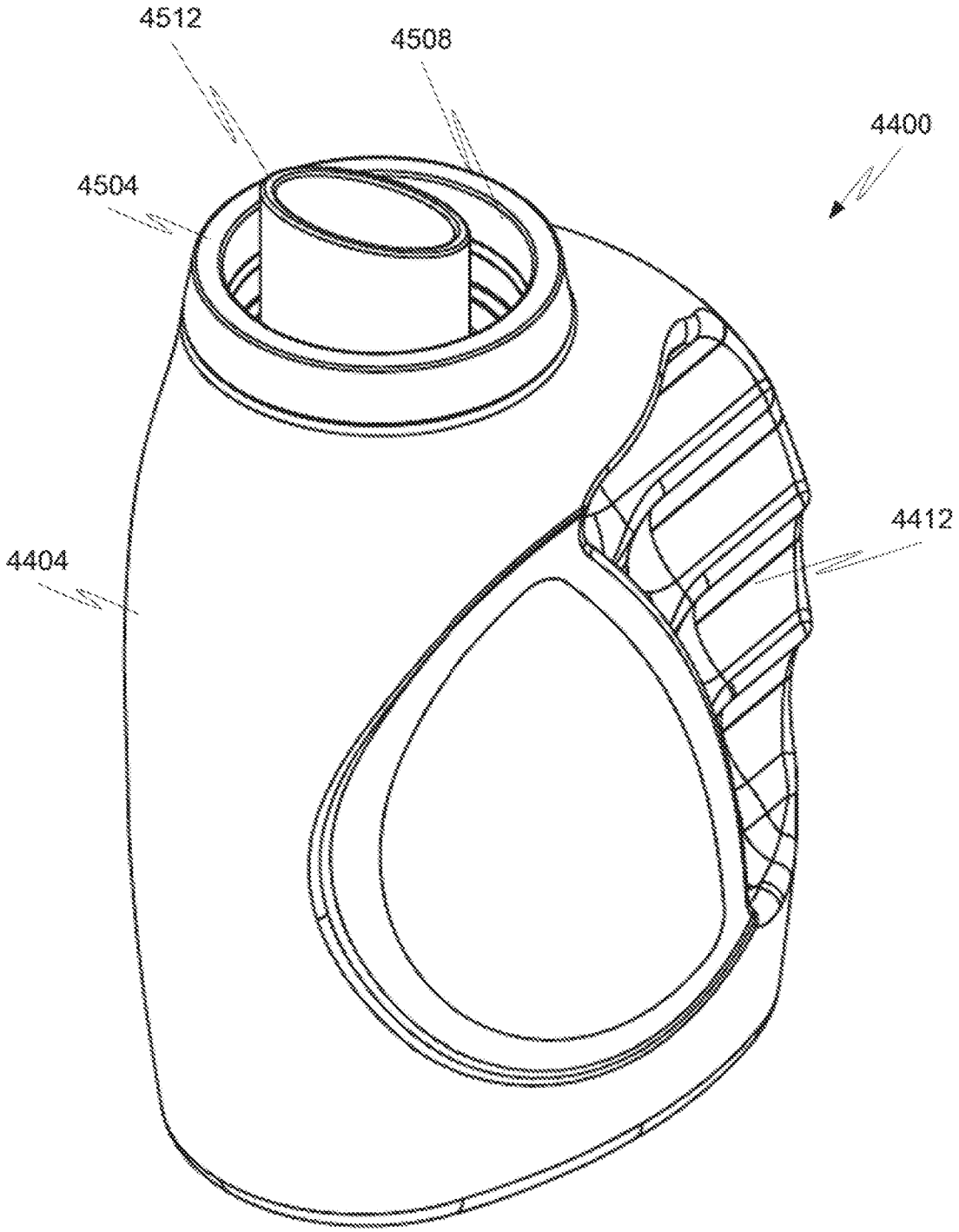
FIG. 45 is an isometric view of an illustrative container without a cap according to embodiments of the present disclosure.

FIG. 45 depicts additional details of the container 4400 when the cap 4408 is removed therefrom. The main body portion 4404 may have a spout attached at its top. The spout may include a spout outer lip 4504, a spout outer wall 4508, and a spout inner wall 4512. The spout outer lip 4504 may be situated at the top of the spout outer wall 4508. The spout inner wall 4512 may be positioned within the spout outer wall 4508. In some embodiments, the spout outer wall 4508 has a larger diameter or perimeter as compared to the spout inner wall 4512. In some embodiments, the spout inner wall 4512 may be concentrically situated with respect to the spout outer wall 4508, but such a configuration is not required. For instance, in the depicted embodiment, the spout inner wall 4512 is biased away from the handle 4512, meaning that a center of the spout inner wall 4512 is further away from the handle 4512 than a center of the spout outer wall 4508. In such a configuration, the spout inner wall 4512 may facilitate a more efficient pouring of liquid from the container main body portion 4404 when a person is pouring with their hand on the handle 4412.

Figure 46A:
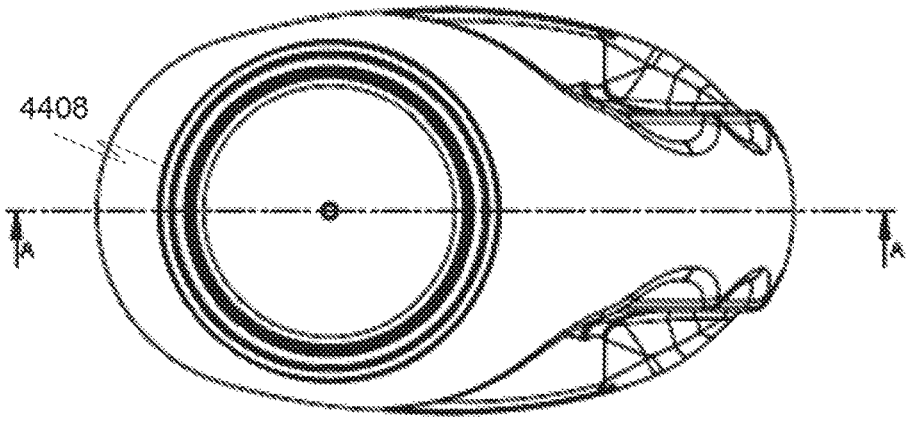
FIG. 46A is a top view of the container depicted in FIG. 45.

With reference now to FIGS. 46A-48C, additional details of a spout 4700 and its components will be described in accordance with at least some embodiments of the present disclosure. The spout 4700 shown in FIGS. 46A and 46B is integrated with the main body portion 4404 of the container 4400.

It should be appreciated that the spout 4700 may be manufactured separately from the main body portion 4404 and then attached thereto via ultrasonic welding, adhesives, friction fittings, welding, melting, combinations thereof, or the like. In other embodiments, the spout 4700 may be integral with the material of the main body portion 4404, meaning that both elements are formed from a common material and have no discernable border where one element ends and the other begins.

Figure 46B:
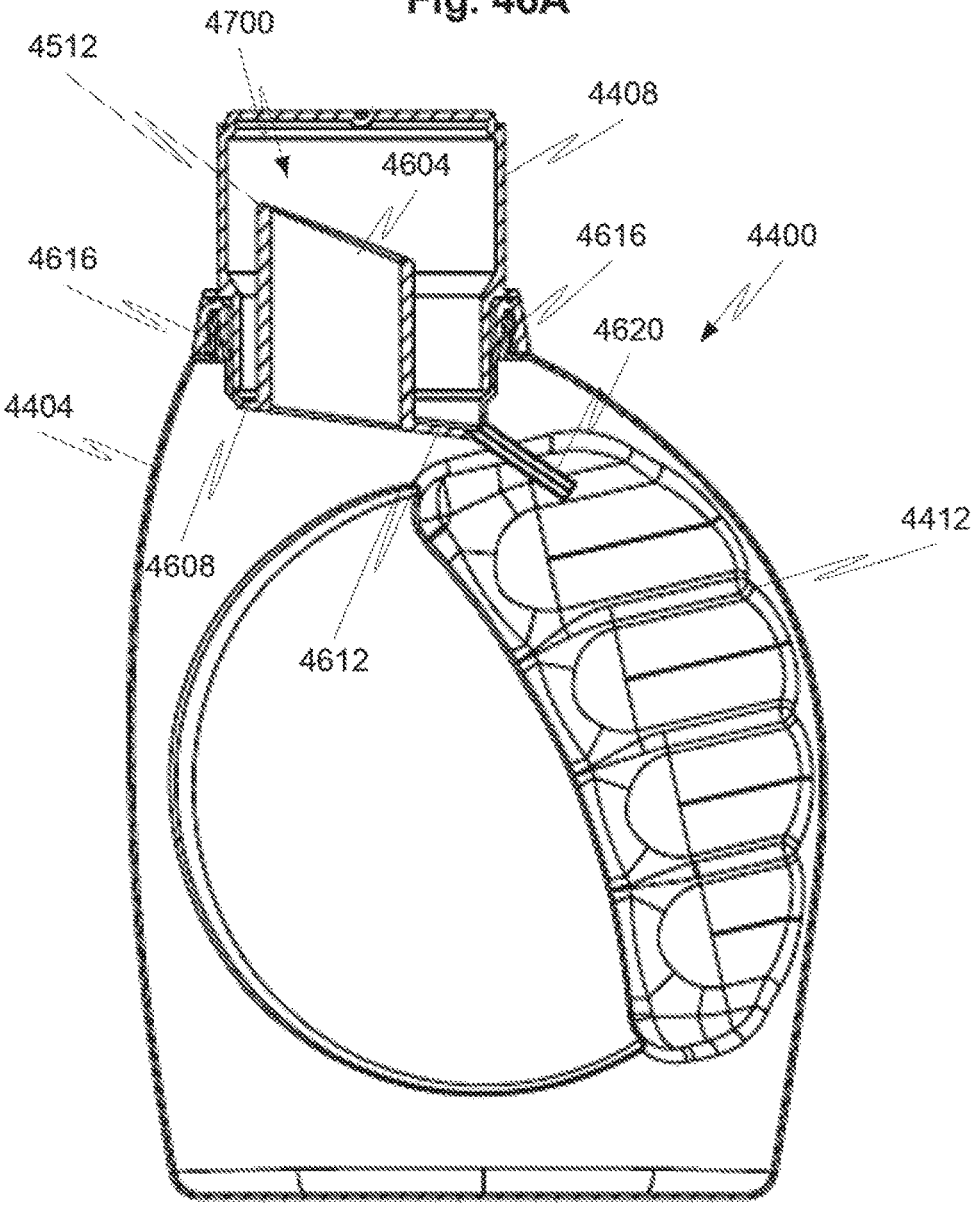
FIG. 46B is a cross-sectional view of the container depicted in FIG. 46A across line A-A.

As shown in FIG. 46B, the spout 4700 may include a main pouring channel 4604 defined by the spout inner wall 4512 and a second channel created by a combination of the spout outer wall 4508 and an air inlet 4620. The embodiment of FIGS. 46A and 46B show a spout 4700 to further include a tilted chamber bottom that comprises a front portion 4608 and rear portion 4612. The front portion 4608 and rear portion 4612 may collectively create the tilted chamber bottom that functions to collect liquid that drips from the spout inner wall 4512 during and after pouring. The main pouring channel 4604 is positioned further away from the handle 4412 than the air inlet 4620. This effectively enables the air inlet 4620 to equalize pressure in the main body portion 4404 when liquid is flowing out of the main pouring channel 4604. Additional details of an air inlet as used in connection with a pressure equalizer are described in U.S. Pat. No. 8,857,639 to Meager, the entire contents of which are hereby incorporated herein by reference.

In some embodiments, the air inlet 4620 is attached at a lowest point of the rear portion 4612, thereby enabling the air inlet 4620 to also collect liquids from the tilted chamber bottom and return those liquids back to the main body portion 4404. It should be appreciated that additional air inlets 4620 may be provided as part of the spout 4700 to facilitate either air inflow to the main body portion 4404 during liquid pouring (e.g., when the main body portion 4404 is not vertically oriented) and to facilitate flowing of liquid back into the main body portion 4404 when the main body portion 4404 is substantially vertically oriented. When vertically oriented, the opening of the air inlet 4620 is positioned below the opening of the main channel 4604 (e.g., the top of the spout inner wall 4512). Thus, the main pouring channel 4604 may operate as a pathway for air out of the main body portion 4404 when liquid is flowing back into the main body portion 4404 from the spout 4700. It can also be seen in FIG. 46B that the bottom opening of the air inlet 4620 is positioned below the bottom opening of the main pouring channel 4604 and that the bottom opening of the main pouring channel 4604 is positioned further away from the handle 4412 than the air inlet 4620. This relative positioning of air inlet 4620 and main pouring channel 4604 enables liquid to pour from the main pouring channel 4604 when the container 4400 is held at the handle 4412 and tilted forward (e.g., with the spout inner wall 4512 receiving liquid from the main body portion 4404 before the liquid reaches the air inlet 4620).

Figure 47A:
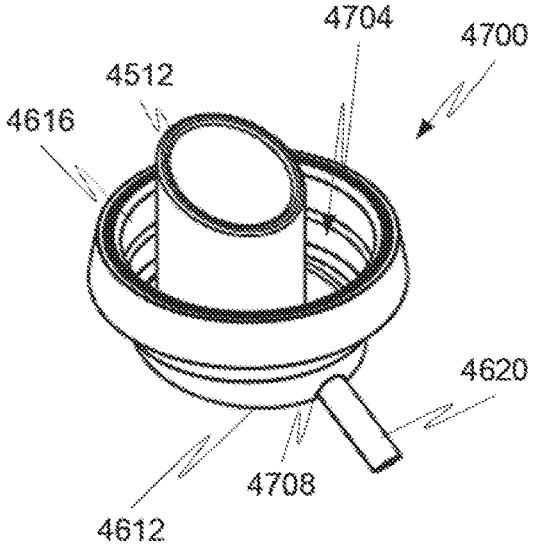
FIG. 47A is an isometric view of a container spout according to embodiments of the present disclosure.
Figure 47B:
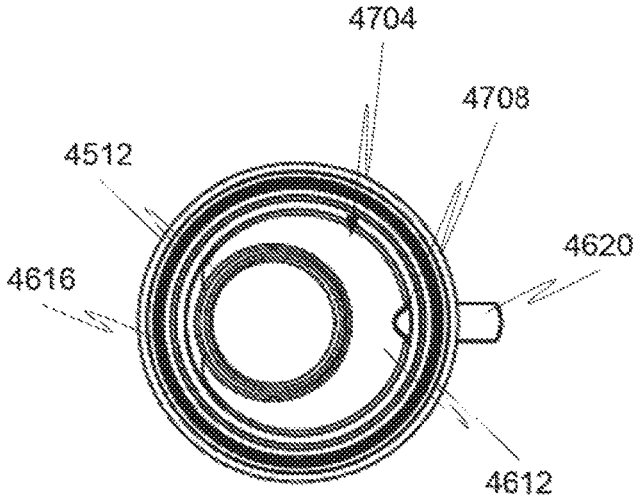
FIG. 47B is a top view of the container spout depicted in FIG. 47A.
Figure 47C:
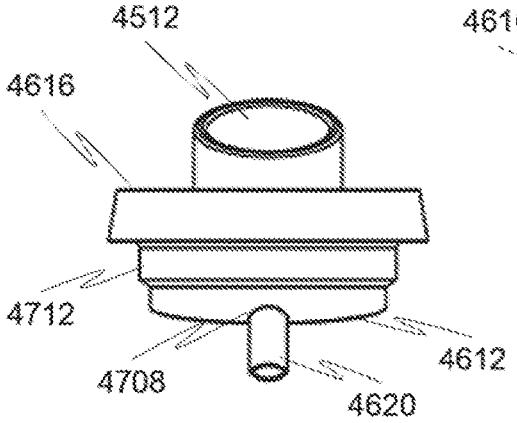
FIG. 47C is a first side view of the container spout depicted in FIG. 47A.
Figure 47D:
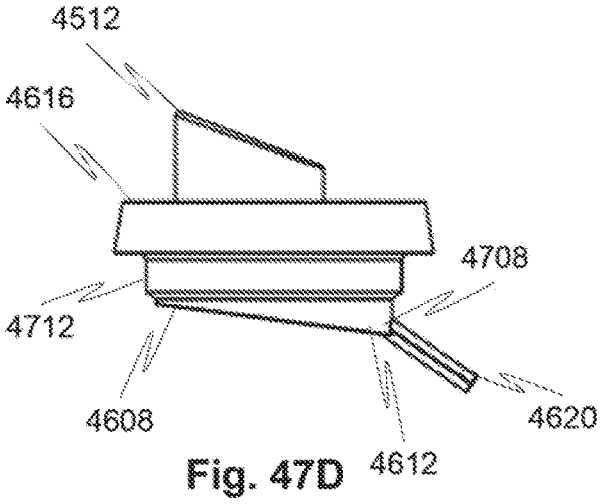
FIG. 47D is a second side view of the container spout depicted in FIG. 47A.
Figure 48C:
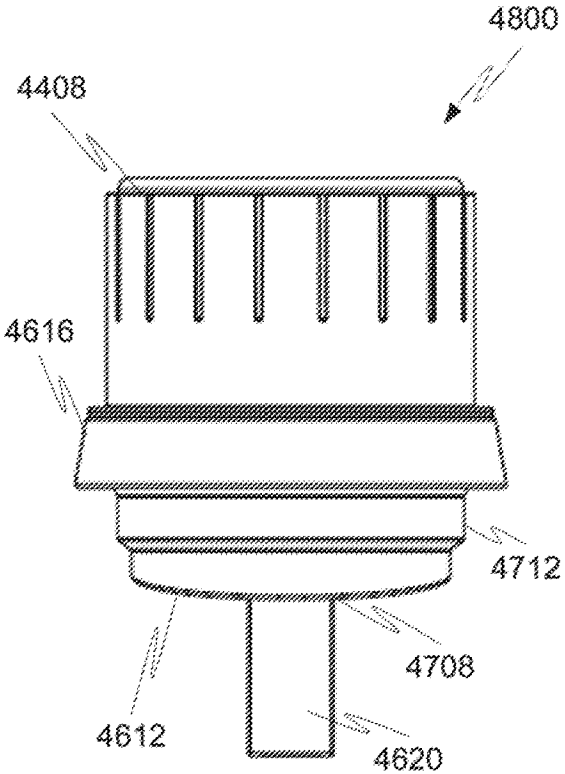
FIG. 48C is a second side view of the container top depicted in FIG. 48A.
Figure 48B:
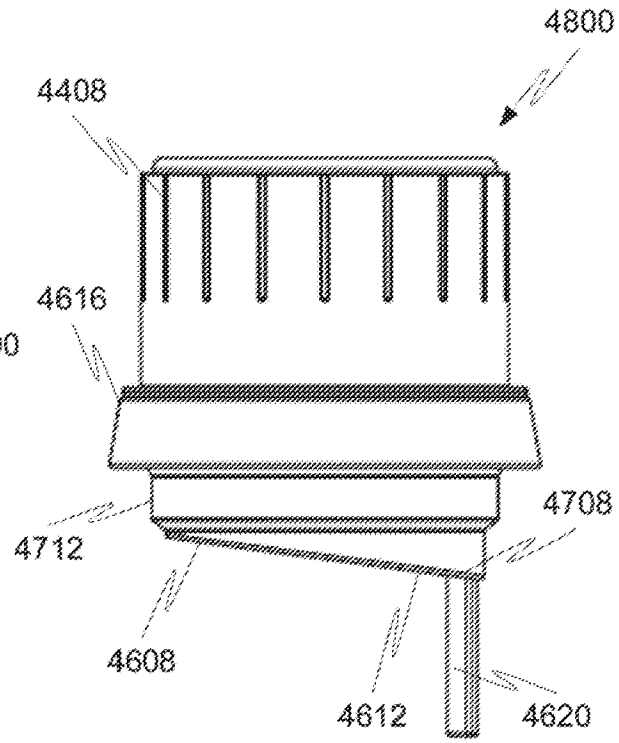
FIG. 48B is a first side view of the container top depicted in FIG. 48A.
Figure 48A:
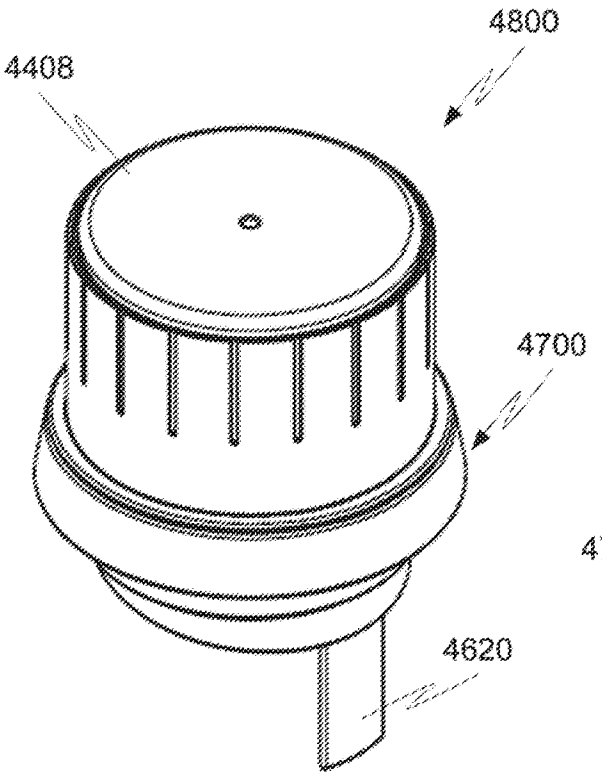
FIG. 48A is an isometric view of a container top according to embodiments of the present disclosure.

Furthermore, FIGS. 46A-47D depict a spout 4700 configuration where the air inlet 4620 is diagonally oriented with respect to the main pouring channel 4604. Specifically, the spout inner wall 4512 is shown to have vertical walls when the container 4400 is resting vertically. The air inlet 4620, however, is diagonally oriented (e.g., neither vertically oriented nor horizontally oriented) when the container 4400 is resting vertically. FIGS. 48A-48C depict an alternative configuration where the air inlet 4620 has an orientation similar or identical to the main pouring channel 4604. In other words, the air inlet 4620 is shown to have a vertical configuration that is parallel to the vertical orientation of the main pouring channel 4604 when the container 4400 is resting vertically.

Referring back to FIGS. 46A-47D, the spout 4700 is shown to receive the cap 4408 of the container 4400. In some embodiments, the spout 4700 comprises a threaded outer wall 4616 that cooperates with threading on the cap

4408. The outer wall 4616 may correspond to the spout outer wall 4508 in some embodiments. In some embodiments, the cap 4408 comprises a diameter that is less than a diameter of the threaded outer wall 4616. This way, the cap 4408 is inserted into the spout 4700 as a male piece while the spout 4700 is a female piece that receives the cap 4408. Such a configuration enables a user to pour liquid from the main body portion 4404 into the cap 4408 and then use the cap 4408 to pour the liquid into some other vessel (e.g., the cap 4408 acts as a pouring intermediary). Advantageously, since the cap 4408 sits inside the spout 4700, any liquid sitting within the inner volume of the cap 4408 will drip into the spout 4700, contact the tilted chamber bottom of the spout 4700, and exit the spout 4700 via the air inlet 4620. Accordingly, any possible mess associated with liquid draining from the cap 4408 is avoided thanks to the positioning of the cap 4408 within the spout outer wall 4616 and thanks to the positioning of the air inlet 4620 relative to the tilted chamber bottom.

The outer wall 4616 is shown to connect directly with both the front portion 4608 and rear portion 4612 of the tilted chamber bottom. The outer wall 4616 helps to contain and collect liquid that drips from the spout inner wall 4512. The tilted chamber bottom facilitates liquid to flow from the front portion 4608 toward the rear portion 4612 and eventually into the air inlet 4620 when the container 4400 is substantially vertically oriented. The air inlet 4620 may receive liquid from the tilted chamber bottom at an integration point 4708 where the air inlet 320 is connected with the rear portion 312 of the tilted chamber bottom. FIG. 47A specifically shows a drip pan 4704 that is created between the spout inner wall 4512 and the outer wall 4616. The drip pan 4704 is also defined by the tilted chamber bottom and operates to collect liquid dripping from spout inner wall 4512 back into the air inlet 4620.

It should be appreciated that the air inlet 4620 may be integrally formed with the rest of the spout 4700 or the air inlet 4620 may be formed separately and then attached to the integration point 4708 of the spout 4700 via adhesive, ultrasonic welding, friction fitting, blow molding, melting, welding, etc. The spout 4700 also includes an attachment face 4712 that provides an interface between the spout 4700 and the main body portion 4404. As mentioned above, the spout 4700 may be manufactured separate from the main body portion 4404 and then attached thereto at the attachment interface 4712. This attachment may occur before or after liquid has been poured into the main body portion 4404.

As shown in FIGS. 48A-48C, the spout 4700 may be provided as part of a larger container top 4800. The container top 4800 may include the spout 4700 and the cap 4408 attached thereto. In some embodiments, the container top 4800 is manufactured separated from the main body portion 4404 and then secured to the main body portion 4404 after the form of the main body portion 4404 has been established. In some embodiments, the container top 4800 is attachable to the main body portion 4404 via the attachment interface 4712 of the spout 4700.

The spout 4700 of FIGS. 48A-48C is similar to the spout 4700 of other embodiments depicted herein with the exception of the orientation of the air inlet 4620. In particular, the air inlet 4620 is shown to have a vertical orientation (e.g., parallel with the spout inner wall 4612 or spout outer wall 4508). This particular orientation may be preferred to the diagonal orientation for certain container shapes whereas the diagonal orientation may be preferable for other container shapes. Regardless of orientation, the air inlet 4620 is shown to be connected to the tilted chamber bottom at the rear portion 4612. This simultaneously enables the air inlet 4620 to carry air into the main body portion 4404 during pouring of liquid out of the main pouring channel 4604 when pouring and then carry dripped liquid back into the main body portion 4404 when not pouring.

The present disclosure may be embodied in other specific forms without departing from its spirit or essential characteristics. The described embodiments are to be considered in all respects only as illustrative and not restrictive. The scope of the disclosure is, therefore, indicated by the appended claims rather than by the foregoing description. All changes which come within the meaning and range of equivalency of the claims are to be embraced within their scope.

The one or more present disclosures, in various embodiments, include components, methods, processes, systems and/or apparatus substantially as depicted and described herein, including various embodiments, subcombinations, and subsets thereof. Those of skill in the art will understand how to make and use the present disclosure after understanding the present disclosure.

The present disclosure, in various embodiments, includes providing devices and processes in the absence of items not depicted and/or described herein or in various embodiments hereof, including in the absence of such items as may have been used in previous devices or processes (e.g., for improving performance, achieving ease and/or reducing cost of implementation).

The foregoing discussion of the disclosure has been presented for purposes of illustration and description. The foregoing is not intended to limit the disclosure to the form or forms disclosed herein. In the foregoing Detailed Description for example, various features of the disclosure are grouped together in one or more embodiments for the purpose of streamlining the disclosure. This method of disclosure is not to be interpreted as reflecting an intention that the claimed disclosure requires more features than are expressly recited in each claim. Rather, as the following claims reflect, inventive aspects lie in less than all features of a single foregoing disclosed embodiment. Thus, the following claims are hereby incorporated into this Detailed Description, with each claim standing on its own as a separate preferred embodiment of the disclosure.

Moreover, though the description of the disclosure has included description of one or more embodiments and certain variations and modifications, other variations and modifications are within the scope of the disclosure (e.g., as may be within the skill and knowledge of those in the art, after understanding the present disclosure). It is intended to obtain rights which include alternative embodiments to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

The exemplary systems and methods of this disclosure have been described in relation to pressurization apparatuses for containers. However, to avoid unnecessarily obscuring the present disclosure, the preceding description omits a number of known structures and devices. This omission is not to be construed as a limitation of the scope of the claimed disclosure. Specific details are set forth to provide an understanding of the present disclosure. It should, however, be appreciated that the present disclosure may be practiced in a variety of ways beyond the specific detail set forth herein.

A number of variations and modifications of the disclosure can be used. It would be possible to provide for some features of the disclosure without providing others.

Embodiments include a breathable container, comprising: a container body configured to retain a fluid therein, the container body including a body top face with at least one patch of material provided thereon; and a depressible tab comprising a main fluid channel and an air inlet positioned in proximity with the at least one patch of material, wherein the main fluid channel and air inlet are configured to puncture at least one hole into the at least one patch when the depressible tab is pressed into the body top face.

Aspects of the above breathable container include wherein the main fluid channel comprises a cross-sectional area that is at least twice as large as a cross-sectional area of the air inlet. Aspects of the above breathable container include wherein the main fluid channel comprises a cross-sectional area that is at least ten times as large as a cross-sectional area of the air inlet. Aspects of the above breathable container include wherein the at least one patch comprises a first patch and a second patch, wherein a first end of the main fluid channel is configured to puncture the first patch, and wherein a first end of the air inlet is configured to puncture the second patch. Aspects of the above breathable container include wherein the at least one patch comprises a single patch, wherein a first end of the main fluid channel is configured to puncture a first discrete portion of the single patch, and wherein a first end of the air inlet is configured to puncture a second discrete portion single patch. Aspects of the above breathable container include wherein the first end of the main fluid channel is tilted with respect to the body top face and wherein the first end of the air inlet is tilted with respect to the body top face. Aspects of the above breathable container include wherein the container body comprises at least one of plastic, metal, paper board, wood pulp, or a combination of materials in composite or layered laminate form. Aspects of the above breathable container further comprising a rim that at least partially surrounds the depressible tab and a lid that interfaces with the rim and closes over the depressible tab.

Embodiments include a breathable container, comprising: a container body configured to retain a fluid therein, the container body including a primary container volume; a measuring cup positioned at least partially within the container body and defining a secondary container volume within the primary container volume, wherein the measuring cup comprises a first opening and second opening that both enable fluid communication between the primary container volume and secondary container volume; and a cap that is positioned over a top of the container body, wherein the cap is also interface with the measuring cup such that a measured amount of fluid contained in the measuring cup is pourable from the measuring cup without allowing any substantial amount of fluid to be poured from the primary container volume.

Aspects of the above breathable container include wherein the first opening comprises a vent and the second opening comprises a mouth. Aspects of the above breathable container include wherein an area of the mouth is at least ten times as large as an area of the vent and wherein the mouth comprises a mouth edge that is configured to interface with the cap when the cap is moved into an open position that exposes the secondary container volume to an environment outside the container body. Aspects of the above breathable container include wherein the cap comprises a main fluid channel and an air inlet that are both exposed via a cap side edge. Aspects of the above breathable container include wherein the main fluid channel extends into the secondary container volume via a hole established in a bottom face of the cap and wherein the air inlet extends into the secondary container volume via an air tube entry that is at least five times smaller than the hole established in the bottom face of the cap for the main fluid channel. Aspects of the above breathable container include wherein the air tube entry is positioned nearer the mouth of the measuring cup as compared to the hole established in the bottom face of the cap. Aspects of the above breathable container include wherein the cap is pivotable between an open and closed position, wherein the cap substantially closes the second opening when in the open position.

Embodiments include a container, comprising: a main body portion configured to contain a liquid; a spout connected to the main body portion, the spout comprising a tilted chamber bottom positioned between a spout inner wall and a spout outer wall, wherein the spout inner wall defined a main pouring channel for the liquid when the container is in a non-vertical orientation; and an air inlet interfacing with the spout at a rear portion of the tilted chamber bottom, wherein the air inlet is configured to carry air into the main body portion when liquid is exiting the main body portion from the main pouring channel, and wherein the air inlet is configured to collect liquid that drips from the spout inner wall into the tilted chamber bottom and return the liquid that drips back into the main body portion.

Aspects of the above container include wherein the air inlet is oriented diagonally with respect to the spout inner wall. Aspects of the above container include wherein the air inlet is oriented parallel with respect to the spout inner wall. Aspects of the above container include wherein a top opening of the air inlet is positioned below a bottom opening of the main pouring channel. Aspects of the above container include wherein a center of the main pouring channel is positioned further away from a handle of the main body portion as compared to a center of the air inlet.

Any one or more of the aspects/embodiments as substantially disclosed herein.

Any one or more of the aspects/embodiments as substantially disclosed herein optionally in combination with any one or more other aspects/embodiments as substantially disclosed herein.

One or more means adapted to perform any one or more of the above aspects/embodiments as substantially disclosed herein.

What is claimed is:

1. A breathable container, comprising:

a container body configured to retain a fluid therein, the container body including a body top face with at least one patch of material provided thereon;

a depressible tab comprising a main fluid channel comprising a first tube, a pressing portion, and an air inlet comprising a second tube, wherein the first tube and second tube are separated by the pressing portion and wherein the depressible tab is positioned in proximity with the at least one patch of material, wherein the main fluid channel and the air inlet are at least partially surrounded by a rim, wherein the main fluid channel and air inlet are configured to puncture at least one hole into the at least one patch when the depressible tab is pressed into the body top face, and wherein the depressible tab is pressed below a top of the rim to cause the main fluid channel and the air inlet to puncture the at one hole into the at least one patch while the pressing portion rests atop the body top face; and a lid that interfaces with the rim and closes over the depressible tab when the depressible tab is pressed below the top of the rim.

2. The breathable container of claim 1, wherein the main fluid channel comprises a cross-sectional area that is at least twice as large as a cross-sectional area of the air inlet.

3. The breathable container of claim 1, wherein the main fluid channel comprises a cross-sectional area that is at least ten times as large as a cross-sectional area of the air inlet.

4. The breathable container of claim 1, wherein the at least one patch comprises a first patch and a second patch, wherein a first end of the main fluid channel is configured to puncture the first patch, and wherein a first end of the air inlet is configured to puncture the second patch.

5. The breathable container of claim 1, wherein the at least one patch comprises a single patch, wherein a first end of the main fluid channel is configured to puncture a first discrete portion of the single patch, and wherein a first end of the air inlet is configured to puncture a second discrete portion single patch.

6. The breathable container of claim 1, wherein the first end of the main fluid channel is tilted with respect to the body top face and wherein the first end of the air inlet is tilted with respect to the body top face.

7. The breathable container of claim 1, wherein the container body comprises at least one of plastic, metal, paper board, wood pulp, or a combination of materials in composite or layered laminate form.

8. The breathable container of claim 1, wherein the lid covers the top of the rim when the depressible tab is pressed below the top of the rim.

9. The breathable container of claim 1, wherein a bottom of the main fluid channel extends farther away from the top of the rim when the depressible tab is pressed below the top of the rim.

10. A depressible tab for use with a breathable container, the depressible tab comprising:

a protective rim;

a main fluid channel at least partially surrounded by the protective rim, wherein the main fluid channel comprises a first tube;

an air inlet at least partially surrounded by the protective rim, wherein the air inlet comprises a second tube separated from the first tube by a planar pressing portion, wherein the main fluid channel and air inlet are configured to puncture at least one hole into at least one patch provided on a breathable container when pressed into the breathable container, and wherein the main fluid channel and the air inlet move relative to the protective rim to puncture the at least one hole into the at least one patch; and a lid that interfaces with the protective rim and that closes over the protective rim.

11. The depressible tab of claim 10, wherein the main fluid channel comprises a cross-sectional area that is at least twice as large as a cross-sectional area of the air inlet.

12. The depressible tab of claim 10, wherein the main fluid channel comprises a cross-sectional area that is at least ten times as large as a cross-sectional area of the air inlet.

13. The depressible tab of claim 10, wherein the at least one patch comprises a first patch and a second patch, wherein a first end of the main fluid channel is configured to puncture the first patch, and wherein a first end of the air inlet is configured to puncture the second patch.

14. The depressible tab of claim 10, wherein the at least one patch comprises a single patch, wherein a first end of the main fluid channel is configured to puncture a first discrete portion of the single patch, and wherein a first end of the air inlet is configured to puncture a second discrete portion single patch.

15. The depressible tab of claim 10, wherein the first tube and the second tube both comprise a circular cross-sectional area.

16. The depressible tab of claim 15, wherein a length of the main fluid channel is substantially identical to a length of the air inlet.

17. The depressible tab of claim 15, wherein the main fluid channel and the air inlet each move relative to the protective rim.

18. The depressible tab of claim 10, wherein a bottom of the main fluid channel extends farther away from a top of the protective rim when pressed into the breathable container.

* * * * *